US008004813B2

(12) United States Patent
May

(10) Patent No.: US 8,004,813 B2
(45) **Date of Patent: *Aug. 23, 2011**

(54) METHOD AND AN ARRAY FOR MAGNETIZING A MAGNETIZABLE OBJECT

(75) Inventor: Lutz May, Geretsried (DE)

(73) Assignee: NCTEngineering GmbH, Ottobrunn (DE)

( * ) Notice: Subject to any disclaimer, the term of this patent is extended or adjusted under 35 U.S.C. 154(b) by 692 days.

This patent is subject to a terminal disclaimer.

(21) Appl. No.: 11/815,059

(22) PCT Filed: Mar. 16, 2006

(86) PCT No.: PCT/EP2006/002424

§ 371 (c)(1),
(2), (4) Date: Jul. 30, 2008

(87) PCT Pub. No.: WO2006/097308

PCT Pub. Date: Sep. 21, 2006

(65) Prior Publication Data

US 2008/0316669 A1 Dec. 25, 2008

(30) Foreign Application Priority Data

Mar. 16, 2005 (EP) ..... 05005732

(51) Int. Cl.
*H01H 47/00* (2006.01)

(52) U.S. Cl. ..... 361/143

(58) Field of Classification Search ..... 361/143
See application file for complete search history.

(56) References Cited

U.S. PATENT DOCUMENTS

| | | | | |
|---|---|---|---|---|
| 3,846,819 | A * | 11/1974 | Warren | 386/44 |
| 4,471,403 | A | 9/1984 | Dress, Jr. et al. | |
| 4,811,609 | A | 3/1989 | Nishibe et al. | |
| 6,635,994 | B1 * | 10/2003 | Yoshiyuki et al. | 315/8 |
| 7,411,753 | B2 * | 8/2008 | Sakai | 360/31 |
| 7,460,324 | B2 * | 12/2008 | Ohinata et al. | 360/66 |

FOREIGN PATENT DOCUMENTS

| | | |
|---|---|---|
| EP | 1049115 | 11/2000 |
| WO | 01/13081 | 2/2001 |
| WO | 02/063262 | 8/2002 |

* cited by examiner

*Primary Examiner* — Stephen W Jackson
(74) *Attorney, Agent, or Firm* — Fay Kaplun & Marcin, LLP

(57) ABSTRACT

Described is a method and array for magnetizing a magnetizable object. The method includes the steps of (a) applying a first degaussing signal to the magnetizable object to degauss the magnetizable object and the first degaussing signal is an alternating electrical signal having a first frequency and a first amplitude; (b) applying a magnetizing signal to the degaussed magnetizable object to magnetize the magnetizable object; and (c) applying a second degaussing signal to the magnetized magnetizable object to partially degauss the magnetized magnetizable object and the second degaussing signal is an alternating electrical signal having a second frequency and a second amplitude.

36 Claims, 37 Drawing Sheets x
8
6
2
16
12
4
14
10

2
20

2
4
16
12
3
A
3
14
10
A'

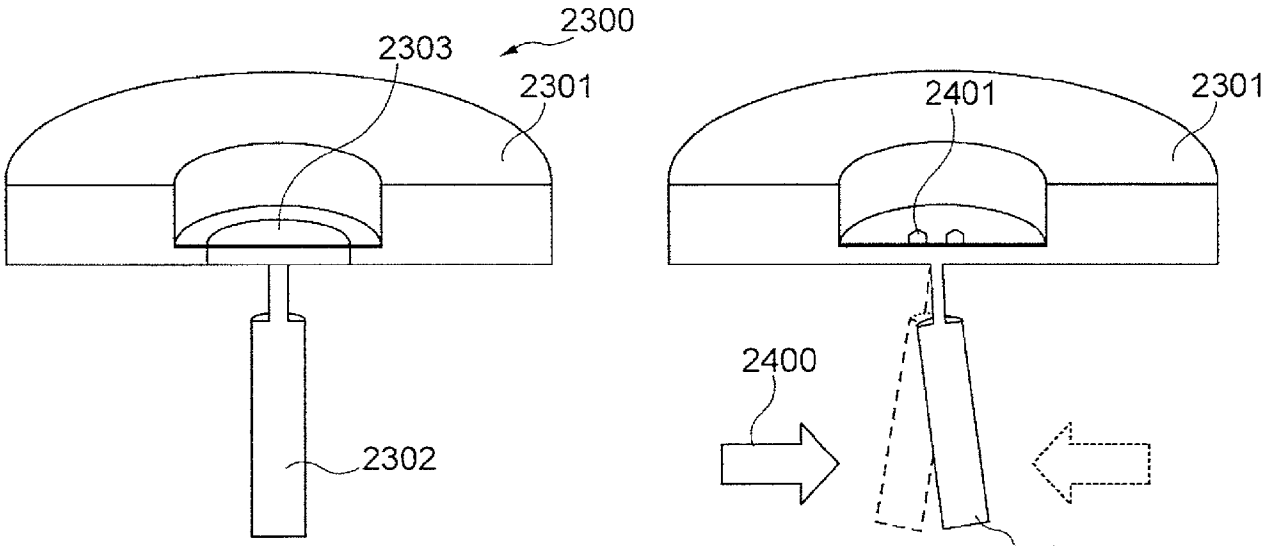
Fig. 91
Fig. 92
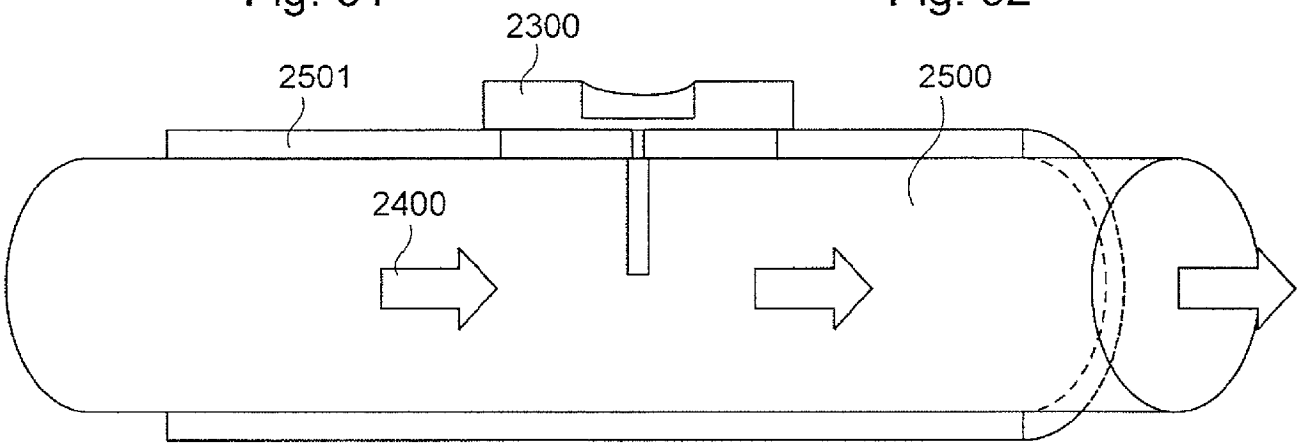
Fig. 93

METHOD AND AN ARRAY FOR MAGNETIZING A MAGNETIZABLE OBJECT

FIELD OF THE INVENTION

The present invention relates to a method and an array for magnetizing a magnetizable object.

DESCRIPTION OF THE RELATED ART

Magnetic transducer technology finds application in the measurement of torque and position. It has been especially developed for the non-contacting measurement of torque in a shaft or any other part being subject to torque or linear motion. A rotating or reciprocating element can be provided with a magnetized region, i.e. a magnetic encoded region, and when the shaft is rotated or reciprocated, such a magnetic encoded region generates a characteristic signal in a magnetic field detector (like a magnetic coil) enabling to determine torque or position of the shaft.

For such kind of sensors which are disclosed, for instance, in WO 02/063262, it is important to have a magnetically encoded region extending along a spatially accurately defined portion of the shaft. However, when a part of a shaft is magnetized in longitudinal direction, as described in WO 02/063262, it may happen that a region at the border between a non-magnetized portion and a magnetized portion of the shaft does not have well-defined magnetic properties. In other words, a magnetization may be obtained in such a border area which has intermediate values between the magnetization of the non-magnetized and the magnetization of the magnetized portion. Such a non-well defined region deteriorates the sensitivity of a torque sensor or a position sensor, since it has an influence to the detection signal captured by a magnetic field detector.

Further, it is important for magnetic sensors that they are magnetized in a manner that disturbing effects and inhomogeneities are avoided. When a magnetized shaft is used as a sensor, for instance as a torque sensor or as a position sensor, it may happen that the sensor signal varies, due to artefacts, along a circumferential trajectory around a cylindrical shaft.

SUMMARY OF THE INVENTION

According to an exemplary embodiment of the invention, a method for magnetizing a magnetizable object is provided, the method comprising the steps of applying a first degaussing signal to the magnetizable object to degauss the magnetizable object, wherein the first degaussing signal is an alternating electrical signal having a first frequency and a first amplitude, applying a magnetizing signal to the degaussed magnetizable object to magnetize the magnetizable object, and applying a second degaussing signal to the magnetized magnetizable object to partially degauss the magnetized magnetizable object, wherein the second degaussing signal is an alternating electrical signal having a second frequency and a second amplitude.

According to another exemplary embodiment of the invention, an array for magnetizing a magnetizable object is provided, the array comprising an electrical signal source. The electrical signal source may be adapted to apply a first degaussing signal to the magnetizable object to degauss the magnetizable object, wherein the first degaussing signal is an alternating electrical signal having a first frequency and a first amplitude, apply a magnetizing signal to the degaussed magnetizable object to magnetize the magnetizable object, and apply a second degaussing signal to the magnetized magnetizable object to partially degauss the magnetized magnetizable object, wherein the second degaussing signal is an alternating electrical signal having a second frequency and a second amplitude.

According to an exemplary embodiment of the invention, a method for adjusting a magnetization of a magnetizable object is provided. The method comprises the steps of providing an object having a magnetized portion extending along at least a part of the object, arranging at least one degaussing element adjacent to the magnetized portion, and degaussing a part of the magnetized portion by activating the degaussing element to adjust the magnetization of the magnetizable object by forming a demagnetized portion of the object directly adjacent to a remaining magnetized portion of the object.

Further, an array for adjusting a magnetization of a magnetizable object is provided according to an exemplary embodiment of the invention, comprising an object having a magnetized portion extending along at least a part of the object, and at least one degaussing element arranged adjacent to the magnetized portion, the at least one degaussing element being adapted to be activated to degauss a part of the magnetized portion to adjust the magnetization of the magnetizable object by forming a demagnetized portion of the object directly adjacent to a remaining magnetized portion of the object.

Moreover, according to an exemplary embodiment of the invention, the invention teaches the use of at least one activatable degaussing element to degauss a part of a magnetized portion of an object to adjust the magnetization of the magnetizable object by forming a demagnetized portion of the object directly adjacent to a remaining magnetized portion of the object.

One idea according to the invention may be seen in the fact that an advantageous magnetization scheme is provided which can be realized with low effort. According to this magnetization scheme, a sequence of different signals may be applied to a magnetizable object to magnetize the same in a defined manner and in a way that parasitic effects are prevented.

According to this magnetization scheme, the sequence of these signals may be applied directly to the magnetizable object (for instance via an ohmic connection), so that a very simple magnetization scheme is provided without the necessity to complicatedly adjust or arrange coils or the like. According to that scheme, any remaining magnetization of the object can be cancelled at the beginning by applying a first degaussing signal which may be performed by applying a large current with a low frequency.

Subsequently, the object may be magnetized by applying a corresponding magnetizing signal. There are several opportunities to realize this method step. For instance, a coil may be arranged around the shaft, and a large current may be directed through the coil to magnetize the shaft enclosed by the coil. Or, one or more current pulses are directly applied to the shaft to magnetize the same.

After that, a second degaussing signal can be applied which may be an alternating electrical signal having a higher frequency and a lower amplitude than the first degaussing signal. By this second degaussing signal, surface magnetizing contributions may be removed so that parasitic effects may be suppressed. Parasitic effects particularly denote effects resulting from surface magnetization which yield, when using the magnetized object as a magnetic sensor, signal inhomogeneities in the surrounding of the shaft in a cross-sectional plane perpendicular to the extension direction of the shaft.

Since also the magnetizing signal can be applied, implementing the so-called PCME technology, directly to the shaft (and both degaussing signals as well), a very easy scheme of three subsequent electrical signals is provided allowing for a precisely defined magnetization characteristics of the magnetizable object.

It is noted that this scheme can be followed by a further degaussing step in which border line regions of the magnetized portion can be selectively degaussed to have a further refined magnetization characteristics.

Another idea of the invention may be seen in the fact that a magnetized object (e.g. magnetized with a treatment according to WO 02/063262) undergoes a post-treating in which an exactly definable border area between a magnetized region and a non-magnetized region of the magnetizable object is securely demagnetized to obtain a step-like spatial dependency in the magnetization which allows to separate a magnetized region from a non-magnetized region. For this purpose, a degaussing element like a coil is arranged adjacent to the magnetized portion to define the portion to be demagnetized and is degaussed by activating the degaussing element to form a well-defined demagnetized portion which is arranged directly next to a remaining magnetized portion. Thus, the invention allows a fine-tuning of the magnetization profile along the length of the object. A gradual transition of the magnetization profile along an extension of the object is thus eliminated and replaced by a step-like magnetization profile. Thus, the magnetization properties are fine-tuned and may be adjusted to special requirements for a position sensor, or a torque sensor, increasing the sensitivity of the respective sensor.

The invention introduces the use of a degaussing element, for example a magnetic coil, wherein the magnetic coil may be slid along the object (e.g. a magnetizable shaft, for instance made of a magnetizable steel). The magnetic coil is slid at such a position of the previously magnetized object that only such a part of the object which shall be demagnetized is located inside the coil opening. Then, an activating current is applied to the coil which has such an orientation, time dependence and strength that the elementary magnets of the portion to be demagnetized are at least partially randomized. Since a portion of the object arranged within the coil can be properly separated from a portion outside the coil, the spatial arrangement of a demagnetized portion and a of a remaining magnetized portion can be separated with high accuracy.

The concept of the invention to degauss a part of a partially magnetized object by surrounding a portion to be demagnetized with a magnetic coil as a degaussing element can be applied to a longitudinally magnetized shaft as disclosed by WO 02/063262, or can be alternatively applied to an object which has previously been magnetized according to the so-called PCME technology ("Pulse Current Modulated Encoding"). The PCME technology will be described in detail below and allows, by introducing a pulse current to the shaft, to generate, inside the object, an inner magnetized region which is surrounded by an outer magnetized region, wherein the magnetization direction of the two regions are oppositely to one another.

Such a magnetization configuration can be achieved by applying a pulse current directly to a predefined portion of a shaft as an example for the object. An effectively used encoding portion is defined by the positions on a shaft at which the current for forming a circumferential magnetic field are applied. The fine-tuning of such an encoding region is achieved with the method of the invention in which a border of the magnetized region in which the magnetization gradually decreases from a high value to zero is transformed into an almost step-like magnetization profile by applying a degaussing signal to a degaussing element.

In the following, exemplary embodiments of the method for magnetizing a magnetizable object according to the invention will be described. However, these embodiments also apply for the array for magnetizing a magnetizable object, for the method and the array for adjusting a magnetization of a magnetizable object and for the use of at least one activatable degaussing element to degauss a part of a magnetized portion of an object.

At least one of the first degaussing signal, the magnetizing signal and the second degaussing signal may be applied directly to the magnetizable object. Particularly, the two degaussing signals may simply be performed by forcing an electric current having a predetermined frequency and amplitude to flow through the magnetizable shaft.

At least one of the first degaussing signal, the magnetizing signal and the second degaussing signal may be an electrical current which may be injected into the magnetizable object. For this purpose, electrical contacts may be attached to the magnetizable object defining a region through which the injected currents shall flow. This can be carried out, for instance, by a plate-like contact attached to end surfaces of a cylindrical object, by a ring-like contact circumferentially attached to a cylindrical object, or by circumferentially arranging a plurality of tooth-like contacts.

The first frequency may be smaller than the second frequency. In other words, the first degaussing signal may be a low frequency signal, and the second degaussing signal may have a higher frequency.

Further, the first amplitude may be larger than the second amplitude. Thus, the first degaussing signal can have a higher current value than the second degaussing signal, since the second degaussing signal is simply provided for selectively demagnetizing surface portions of the magnetizable object. According to this scheme, the so-called skin-effect is advantageously used.

Particularly, the first frequency may be less or equal to 50 Hz. For instance, for a shaft having a diameter of 50 mm, a first frequency may be in the range between 1 and 2 Hz. For a shaft having a diameter of 25 mm, the frequency may be, for instance, 10 Hz. For a shaft having a diameter of for instance 5 mm, the first frequency may be 50 Hz. For a shaft having a diameter of 20 mm, the frequency may be in the range between 30 and 50 Hz. Generally, the range of the first frequency may be between 1 and 50 Hz, and the current value may be 30 A to 50 A at a voltage of 30 V.

The second frequency may be larger than or equal to 100 Hz. For instance, a shaft having a diameter of 10 mm may be degaussed by a second frequency of larger or equal 100 Hz. For a shaft diameter of 5 mm, the frequency may be 300 Hz or more.

The first amplitude may be larger than or equal to 20 A. The second amplitude may be less than or equal to 10 A. Particularly, the first amplitude may be in the range between 30 A and 50 A. The second amplitude may be in the range between 5 A and 10 A.

The second degaussing signal may be selected in such a manner that parasitic effects are suppressed. In other words, surface magnetization contributions shall be eliminated by the second degaussing step which results in a higher circumferential symmetry of the signal of the magnetized object which signal can be measured when the magnetized object is used as a sensor, for instance a torque sensor, a position sensor, a bending force sensor, or the like.

The second degaussing signal may be selected in such a manner that a surface magnetization is removed from the magnetizable object. In other words, surface contributions of the magnetization may be selectively eliminated.

The alternating electrical signals according to the first degaussing signal and/or the second degaussing signal may be selected from the group consisting of a sine signal, a cosine signal, a triangle signal, a saw tooth signal, a pulse signal and a rectangular signal. A sine signal is a good solution, since this can be realized with the lowest effort. However, other signal shapes are possible.

Furthermore, the method according to the invention may comprise, after having applied the second degaussing signal, adjusting the magnetization of the magnetizable object by arranging at least one degaussing element adjacent the magnetized object, and degaussing a part of the magnetized object by activating the degaussing element to adjust the magnetization of the magnetizable object by forming a demagnetized portion of the object directly adjacent a remaining magnetized portion of the object. Thus, after having defined the magnetization in the surface region of the shaft, the magnetization may further be defined in a lateral direction so that a magnetizable shaft is provided with a magnetization which is accurately defined. This allows to use the magnetized shaft as a highly sensitive sensor according to a magnetic measuring principle.

As a degaussing element, a degaussing coil may be used which may be arranged to surround a portion of the magnetized object to be demagnetized. Alternatively, the degaussing element may be realized as an electromagnet.

In both cases, the degaussing element may be activated by applying a time-varying electrical signal. This may be an alternating current or an alternating voltage which selectively cancels out magnetic field contributions in border portions of a magnetized region. Thereby, the dimension of the magnetized portion can be limited to a desired range.

The alternating current or the alternating voltage may alternate with the frequency being substantially smaller than 50 Hz. More preferably, the alternating current or the alternating voltage may alternate with a frequency less than 5 Hz.

Alternatively, a degaussing element may be realized as a permanent magnet, which may be activated by moving the permanent magnet in the vicinity of the object in a time-varying manner.

According to another embodiment of the invention, applying a magnetizing signal to magnetize the magnetizable object may include activating a magnetizing coil being arranged to surround an object to be magnetized. This magnetizing scheme relates to a technology which is disclosed, for instance, in WO 02/063262.

Activating the magnetizing coil may be realized by applying a direct current or a direct voltage.

Alternatively, applying a magnetizing signal to magnetize a magnetizable object may include applying at least two current pulses to the object such that in a direction essentially perpendicular to the surface of the object, a magnetic field structure is generated such that there is a first magnetic flow in a first direction and a second magnetic flow in a second direction, wherein the first direction is opposite to the second direction.

This so-called PCME technology ("Pulse Current Modulated Encoding" technology) may be applied, and is described in this application particularly referring to FIG. 1 to FIG. 67. According to the PCME technology, a magnetized portion of an object may be formed by applying two current pulses to the object such that in a direction essentially perpendicular to a surface of the object, a magnetic field structure is generated such that there is a first magnetic flow in a first direction and a second magnetic flow in a second direction. The two directions may be opposite to one another. In a time versus current diagram, each of the at least two current pulses may have a fast raising edge being essentially vertical and a slow falling edge (see for instance FIG. 81).

The object may be a shaft, particularly one of the group consisting of an engine shaft, a reciprocable work cylinder, and a push-pull-rod.

Only one of the at least one degaussing element may be activated at a time. Alternatively, at least two degaussing elements may be activated at a time.

The first degaussing signal may be applied to the magnetizable object in such a manner as to degauss the entire magnetizable object. In other words, any potential remaining magnetization shall be removed by this step.

According to an exemplary embodiment of the method, the first degaussing signal may be a damped alternating electrical signal. In other words, the oscillating signal may have a damping envelope like an exponential function.

According to another exemplary embodiment of the method, the second degaussing signal is a damped alternating electrical signal. In other words, the oscillating signal may have a damping envelope like an exponential function.

In the following, exemplary embodiments of the array for magnetizing a magnetizable object according to the invention will be described. However, these embodiments also apply for the method for magnetizing a magnetizable object, for the method and the array for adjusting a magnetization of a magnetizable object and for the use of at least one activatable degaussing element to degauss a part of a magnetized portion of an object.

The array may further comprise an electrical connection element adapted to electrically connect the electrical signal source with a magnetizable object. Thus, electrical contacts may be provided to be coupled electrically to a magnetizable object to directly apply signals to the magnetizable object.

The array may further comprise an electrical conductor adapted to surround a magnetizable object or to be surrounded by a magnetizable object. According to one embodiment, the electrical conductor may be a coil surrounding the magnetizable object. According to another embodiment, the electrical conductor may be a cylindrical conductor which is surrounded by a hollow magnetizable object.

In the following, exemplary embodiments of the method for adjusting a magnetization of a magnetizable object according to the invention will be described.

However, these embodiments also apply for the method and the array for magnetizing a magnetizable object, for the array for adjusting a magnetization of a magnetizable object and for the use of at least one activatable degaussing element to degauss a part of a magnetized portion of an object.

According to the method of the invention, an object may be provided having the magnetized portion extending along the entire object. According to this embodiment, first, the entire object is magnetized, and then a remaining magnetized portion is defined by demagnetizing selectable portions of the previously entirely magnetized object.

Alternatively, an object may be provided having a plurality of alternating magnetized and unmagnetized portions. According to this configuration, which is particularly advantageous for a position sensor of a reciprocating object wherein the position sensing is realized by measuring the magnetic field generated by the different magnetic regions of the reciprocating object, the object (like a reciprocating shaft) may first be magnetized in selectable portions, and afterwards the invention is implemented to fine-tune the magnetization of the sequence of magnetized and non-magnetized regions, by generating a magnetization profile which follows a mathematical step function.

At least one of the at least degaussing elements may be a degaussing coil. With a degaussing coil, i.e. a magnetic coil, the region of demagnetization can be properly defined by sliding the coil along the object, for instance a shaft.

Thus, the degaussing coil may be arranged to surround a portion of the magnetized portion to be demagnetized. This allows a proper positioning and definition of the region of the magnetized object to be demagnetized.

At least one of the at least one degaussing element may be an electromagnet. Using an electromagnet being controlled to form a time-dependent magnetic field is an alternative to a magnetic coil. Since an electromagnet can be provided in different shapes, sizes and geometries, it is also very suitable to properly define a portion to be demagnetized.

At least one of the degaussing elements may be activated by applying a time-varying electric signal. A time-varying electric signal (for instance an alternating current or an alternating voltage) produces a time-dependent magnetic field which, applied to a magnetized portion, may randomize the ordered magnetized elementary magnets, thus achieving a secure demagnetization.

Particularly, the at least one degaussing element may be activated by applying an alternating current or an alternating voltage.

The alternating current or the alternating voltage alternates for example with a frequency which is substantially smaller than 50 Hz. Due to the so-called skin effect, it is preferred to use a sufficiently small frequency to allow a proper demagnetization also in the inner parts of the object, for instance close to the center of a shaft. This can be achieved by using sufficiently small frequencies, wherein, in a first approximation, the frequency value can be selected to be inversely proportional to the cross-sectional area of the object.

Thus, a proper value for the frequency of the time-varying demagnetization signal sensitively depends on the application used, but such a frequency is for example considerably smaller than 50 Hz. For instance, a frequency region between 0.01 Hz and 20 Hz is suitable, a particularly preferred range is between 0.01 Hz and 5 Hz.

When selecting parameters defining the degaussing signal, there is an interplay between time, amplitude and frequency of the applied electrical signal (e.g. voltage or current). As a rule of thumb, the demagnetization should be continued until an almost complete randomization of the elementary magnets of the magnetized region to be demagnetized is achieved.

Further preferable, the alternating current or the alternating voltage may alternate with a frequency less than 5 Hz.

As an alternative to a configuration in which the degaussing element is realized as a coil or as an electromagnet, a permanent magnet may be used as degaussing element and may be activated by moving the permanent magnet in the vicinity of the object in a time-varying manner. By such a motion (e.g. a mechanical oscillation), a time-dependent demagnetization field is effective to the portion of the object to be demagnetized. Such a configuration makes the use of electrical degaussing signals indispensable, since a pure mechanical degaussing sequence is possible using a permanent magnet.

The magnetized portion of the object may be formed by magnetizing magnetizable material of the object by activating a magnetizing coil which is arranged to surround the portion of the object to be magnetized. Such a technology of magnetizing an object is disclosed, for instance, in WO 02/063262. According to this magnetization sequence, a portion of a magnetizable object (e.g. a metallic object like a shaft made of industrial steel) may be magnetized, wherein quality problems may occur at the border between the magnetized region and a non-magnetized region. Such a shaft may then be treated according to the fine-tuning of the magnetization profile according to the invention to improve the transition between magnetized and unmagnetized regions.

According to the described aspect, the magnetizing coil may be activated by applying a direct current or a direct voltage.

Alternatively to the magnetization method of WO 02/063262, the so-called PCME technology ("Pulse Current Modulated Encoding") technology may be applied, which will be described in detail below. According to this technology, the magnetized portion of the object may be formed by applying at least two current pulses to the object such that in a direction essentially perpendicular to a surface of the object, a magnetic field structure is generated such that there is a first magnetic flow in a first direction and a second magnetic flow in a second direction, wherein the first direction is opposite to the second direction. According to this magnetization scheme, in a time versus current diagram, each of the at least two current pulses has a fast raising edge which is essentially vertical and has a slow falling edge.

As the object, a shaft may be provided. Particularly, the shaft may be one of the group consisting of an engine shaft, a reciprocatable work cylinder, and a push-pull-rod.

Such an engine shaft may be used in a vehicle like a car to measure the torque of the engine. A reciprocatable work cylinder may be used in a concrete (cement) processing apparatus wherein one or more magnetically encoding regions on such a reciprocating work cylinder may be used to determine the actual position of the work cylinder within the concrete processing apparatus to allow an improved control of the operation of the reciprocating cylinder. A push-pull-rod, or a plurality of push-pull-rods, may be provided in a gear box of a vehicle and may be provided with one or more magnetic encoded regions to allow a position detection of the push-pull-rod.

For example, only one of the at least one degaussing element is activated at a time. By activating each of the degaussing elements separately and one after another, the fine-tuning of the magnetization can be performed with a very high accuracy, and regions to remain magnetized are prevented from being demagnetized.

Alternatively, at least two degaussing elements may be activated at a time. This configuration allows a very fast fine-tuning and is therefore a very cost effective alternative.

In the following, exemplary embodiments of the array for adjusting a magnetization of a magnetizable object according to the invention will be described. However, these embodiments also apply for the method and the array for magnetizing a magnetizable object, for the method for adjusting a magnetization of a magnetizable object and for the use of at least one activatable degaussing element to degauss a part of a magnetized portion of an object according to the invention.

In the array, the object may be a shaft.

The shaft may have a first unmagnetized (non-magnetized) portion and may have a second unmagnetized portion, the magnetized portion being arranged between the first unmagnetized portion and the second unmagnetized portion.

The array may have a first degaussing coil and may have a second degaussing coil as degaussing elements, wherein the first degaussing coil may be arranged surrounding a portion of the magnetized portion adjacent the first unmagnetized portion, and the second degaussing coil may be arranged surrounding a portion of the magnetized portion adjacent the second unmagnetized portion.

The first degaussing coil may have a first connection and may have a second connection. The second degaussing coil may have a first connection and may have a second connection. A first voltage may be applied between the first connection and the second connection of the first degaussing coil, and the second voltage may be applied between the first connection and the second connection of the second degaussing coil. In other words, according to this configuration, the two degaussing coils are electrically decoupled from one another. Thus, demagnetization signals for two borders between magnetized and unmagnetized portions may be generated one after another, yielding a high quality of the produced magnetization profile.

Alternatively, the first degaussing coil may have a first connection and may have a second connection, and the second degaussing coil may have a first connection and a second connection. A voltage may be applied between the first connection of the first degaussing coil and the second connection of the second degaussing coil, wherein the second connection of the first degaussing coil may be coupled with the first connection of the second degaussing coil. According to this configuration, a single voltage and thus a single voltage supply is sufficient to operate the array, since two connections of the degaussing coils are coupled allowing to simultaneously produce a demagnetization signal for two borders between magnetized and unmagnetized portions.

Further, the array of the invention may have a first stopper coil and may have a second stopper coil, the first stopper coil being arranged surrounding a portion of the magnetized portion adjacent the first degaussing coil, and the second stopper coil may be arranged surrounding a portion of the magnetized portion adjacent the second degaussing coil in such a manner that the first and second stopper coils are arranged between the first and second degaussing coils. Such an electrical signal can be applied to the first and the second stopper coils that the region between the first and second stopper coils are prevented from being demagnetized when the degaussing elements are activated. According to this configuration, small stopper coils or stopper inductors may be placed at a specific end of the degaussing elements, and the inductivity of the stopper coils may be significantly lower than the inductivity of the degaussing coils. Thus, the area which is affected by the demagnetization procedure can be defined even better.

The magnetized portion may be a longitudinally magnetized region of the object, for instance generated according to the technology described in WO 02/063262.

Alternatively, the magnetized portion may be a circumferentially magnetized region of the reciprocating object. This can be achieved by implementing the so-called PCME technology described below.

According to the latter aspect, the magnetized portion may be formed by a first magnetic flow region oriented in a first direction and by a second magnetic flow region oriented in a second direction, wherein the first direction is opposite to the second direction. Thus, in a cross-sectional view of the object, there may be the first circular magnetic flow having the first direction and a first radius, and the second circular magnetic flow may have the second direction and a second radius, wherein the first radius may be larger than the second radius.

The above and other aspects, objects, features and advantages of the present invention will become apparent from the following description and the appended claim, taken in conjunction with the accompanying drawings in which like parts or elements are denoted by like reference numbers.

BRIEF DESCRIPTION OF THE DRAWINGS

The accompanying drawings, which are included to provide a further understanding of the invention and constitute a part of the specification illustrate embodiments of the invention.

In the drawings:

FIG. 91 to FIG. 93 illustrate a flow sensor according to an exemplary embodiment of the invention.

DETAILED DESCRIPTION OF EXEMPLARY EMBODIMENTS OF THE INVENTION

Figures 1, 2A, 2B:
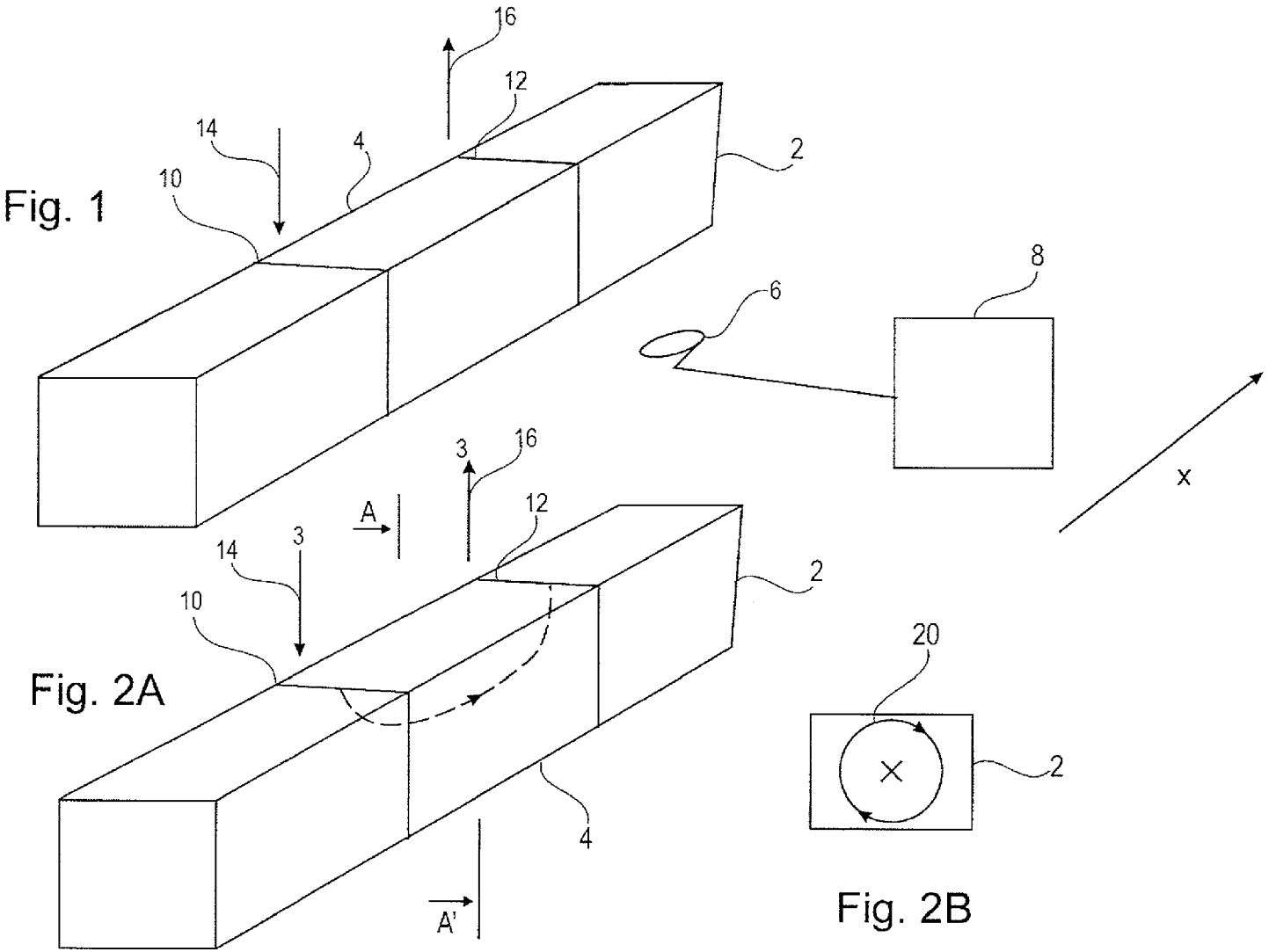
FIG. 1 shows a torque sensor with a sensor element according to an exemplary embodiment of the present invention for explaining a method of manufacturing a torque sensor according to an exemplary embodiment of the present invention.
FIG. 2*a* shows an exemplary embodiment of a sensor element of a torque sensor according to the present invention for further explaining a principle of the present invention and an aspect of an exemplary embodiment of a manufacturing method of the present invention.
FIG. 2*b* shows a cross-sectional view along AA' of FIG. 2*a*.

It is disclosed a sensor having a sensor element such as a shaft wherein the sensor element may be manufactured in accordance with the following manufacturing steps applying a first current pulse to the sensor element;

wherein the first current pulse is applied such that there is a first current flow in a first direction along a longitudinal axis of the sensor element;

wherein the first current pulse is such that the application of the current pulse generates a magnetically encoded region in the sensor element.

It is disclosed that a further second current pulse may be applied to the sensor element. The second current pulse may be applied such that there is a second current flow in a direction along the longitudinal axis of the sensor element.

It is disclosed that the directions of the first and second current pulses may be opposite to each other. Also, each of the first and second current pulses may have a raising edge and a falling edge. For example, the raising edge is steeper than the falling edge.

It is believed that the application of a current pulse may cause a magnetic field structure in the sensor element such that in a cross-sectional view of the sensor element, there is a first circular magnetic flow having a first direction and a second magnetic flow having a second direction. The radius of the first magnetic flow may be larger than the radius of the second magnetic flow. In shafts having a non-circular cross-section, the magnetic flow is not necessarily circular but may have a form essentially corresponding to and being adapted to the cross-section of the respective sensor element.

It is believed that if no torque is applied to a sensor element, there is no magnetic field or essentially no magnetic field detectable at the outside. When a torque or force is applied to the sensor element, there is a magnetic field emanated from the sensor element which can be detected by means of suitable coils. This will be described in further detail in the following.

A torque sensor may have a circumferential surface surrounding a core region of the sensor element. The first current pulse is introduced into the sensor element at a first location at the circumferential surface such that there is a first current flow in the first direction in the core region of the sensor element. The first current pulse is discharged from the sensor element at a second location at the circumferential surface. The second location is at a distance in the first direction from the first location. The second current pulse may be introduced into the sensor element at the second location or adjacent to the second location at the circumferential surface such that there is the second current flow in the second direction in the core region or adjacent to the core region in the sensor element. The second current pulse may be discharged from the sensor element at the first location or adjacent to the first location at the circumferential surface.

As already indicated above, the sensor element may be a shaft. The core region of such shaft may extend inside the shaft along its longitudinal extension such that the core region surrounds a center of the shaft. The circumferential surface of the shaft is the outside surface of the shaft. The first and second locations are respective circumferential regions at the outside of the shaft. There may be a limited number of contact portions which constitute such regions. Real contact regions may be provided, for example, by providing electrode regions made of brass rings as electrodes. Also, a core of a conductor may be looped around the shaft to provide for a good electric contact between a conductor such as a cable without isolation and the shaft.

The first current pulse and also the second current pulse may be not applied to the sensor element at an end face of the sensor element. The first current pulse may have a maximum between 40 and 1400 Ampere or between 60 and 800 Ampere or between 75 and 600 Ampere or between 80 and 500 Ampere. The current pulse may have a maximum such that an appropriate encoding is caused to the sensor element. However, due to different materials which may be used and different forms of the sensor element and different dimensions of the sensor element, a maximum of the current pulse may be adjusted in accordance with these parameters. The second pulse may have a similar maximum or may have a maximum approximately 10, 20, 30, 40 or 50% smaller than the first maximum. However, the second pulse may also have a higher maximum such as 10, 20, 40, 50, 60 or 80% higher than the first maximum.

A duration of those pulses may be the same. However, it is possible that the first pulse has a significant longer duration than the second pulse. However, it is also possible that the second pulse has a longer duration than the first pulse.

The first and/or second current pulses may have a first duration from the start of the pulse to the maximum and may have a second duration from the maximum to essentially the end of the pulse. The first duration may be significantly longer than the second duration. For example, the first duration may be smaller than 300 ms wherein the second duration may be larger than 300 ms. However, it is also possible that the first duration is smaller than 200 ms whereas the second duration is larger than 400 ms. Also, the first duration may be between 20 to 150 ms wherein the second duration may be between 180 to 700 ms.

As already indicated above, it is possible to apply a plurality of first current pulses but also a plurality of second current pulses. The sensor element may be made of steel whereas the steel may comprise nickel. The sensor material used for the primary sensor or for the sensor element may be 50NiCr13 or X4CrNi13-4 or X5CrNiCuNb16-4 or X20CrNi17-4 or X46Cr13 or X20Cr13 or 14NiCr14 or S155 as set forth in DIN 1.2721 or 1.4313 or 1.4542 or 1.2787 or 1.4034 or 1.4021 or 1.5752 or 1.6928.

The first current pulse may be applied by means of an electrode system having at least a first electrode and a second electrode. The first electrode is located at the first location or adjacent to the first location and the second electrode is located at the second location or adjacent to the second location.

Each of the first and second electrodes may have a plurality of electrode pins. The plurality of electrode pins of each of the first and second electrodes may be arranged circumferentially around the sensor element such that the sensor element is contacted by the electrode pins of the first and second electrodes at a plurality of contact points at an outer circumferential surface of the shaft at the first and second locations.

As indicated above, instead of electrode pins laminar or two-dimensional electrode surfaces may be applied. For example, electrode surfaces are adapted to surfaces of the shaft such that a good contact between the electrodes and the shaft material may be ensured.

At least one of the first current pulse and at least one of the second current pulse may be applied to the sensor element such that the sensor element has a magnetically encoded region such that in a direction essentially perpendicular to a surface of the sensor element, the magnetically encoded region of the sensor element has a magnetic field structure such that there is a first magnetic flow in a first direction and a second magnetic flow in a second direction. The first direction may be opposite to the second direction.

In a cross-sectional view of the sensor element, there may be a first circular magnetic flow having the first direction and a first radius and a second circular magnetic flow having the second direction and a second radius. The first radius may be larger than the second radius.

Furthermore, the sensor elements may have a first pinning zone adjacent to the first location and a second pinning zone adjacent to the second location.

The pinning zones may be manufactured in accordance with the following manufacturing method. According to this method, for forming the first pinning zone, at the first location or adjacent to the first location, a third current pulse is applied on the circumferential surface of the sensor element such that there is a third current flow in the second direction. The third current flow is discharged from the sensor element at a third location which is displaced from the first location in the second direction.

For forming the second pinning zone, at the second location or adjacent to the second location, a forth current pulse may be applied on the circumferential surface to the sensor element such that there is a forth current flow in the first direction. The forth current flow is discharged at a forth location which is displaced from the second location in the first direction.

A torque sensor may be provided comprising a first sensor element with a magnetically encoded region wherein the first sensor element has a surface. In a direction essentially perpendicular to the surface of the first sensor element, the magnetically encoded region of the first sensor element may have a magnetic field structure such that there is a first magnetic flow in a first direction and a second magnetic flow in a second direction. The first and second directions may be opposite to each other.

The torque sensor may further comprise a second sensor element with at least one magnetic field detector. The second sensor element may be adapted for detecting variations in the magnetically encoded region. More precisely, the second sensor element may be adapted for detecting variations in a magnetic field emitted from the magnetically encoded region of the first sensor element.

The magnetically encoded region may extend longitudinally along a section of the first sensor element, but does not extend from one end face of the first sensor element to the other end face of the first sensor element. In other words, the magnetically encoded region does not extend along all of the first sensor element but only along a section thereof.

The first sensor element may have variations in the material of the first sensor element caused by at least one current pulse or surge applied to the first sensor element for altering the magnetically encoded region or for generating the magnetically encoded region. Such variations in the material may be caused, for example, by differing contact resistances between electrode systems for applying the current pulses and the surface of the respective sensor element. Such variations may, for example, be burn marks or color variations or signs of an annealing.

The variations may be at an outer surface of the sensor element and not at the end faces of the first sensor element since the current pulses are applied to outer surface of the sensor element but not to the end faces thereof.

A shaft for a magnetic sensor may be provided having, in a cross-section thereof, at least two circular magnetic loops running in opposite direction. Such shaft is believed to be manufactured in accordance with the above-described manufacturing method.

Furthermore, a shaft may be provided having at least two circular magnetic loops which are arranged concentrically.

A shaft for a torque sensor may be provided which is manufactured in accordance with the following manufacturing steps where firstly a first current pulse is applied to the shaft. The first current pulse is applied to the shaft such that there is a first current flow in a first direction along a longitudinal axis of the shaft. The first current pulse is such that the application of the current pulse generates a magnetically encoded region in the shaft. This may be made by using an electrode system as described above and by applying current pulses as described above.

An electrode system may be provided for applying current surges to a sensor element for a torque sensor, the electrode system having at least a first electrode and a second electrode wherein the first electrode is adapted for location at a first location on an outer surface of the sensor element. A second electrode is adapted for location at a second location on the outer surface of the sensor element. The first and second electrodes are adapted for applying and discharging at least one current pulse at the first and second locations such that current flows within a core region of the sensor element are caused. The at least one current pulse is such that a magnetically encoded region is generated at a section of the sensor element.

The electrode system may comprise at least two groups of electrodes, each comprising a plurality of electrode pins. The electrode pins of each electrode are arranged in a circle such that the sensor element is contacted by the electrode pins of the electrode at a plurality of contact points at an outer surface of the sensor element.

The outer surface of the sensor element does not include the end faces of the sensor element.

FIG. 1 shows an exemplary embodiment of a torque sensor according to the present invention. The torque sensor comprises a first sensor element or shaft 2 having a rectangular cross-section. The first sensor element 2 extends essentially along the direction indicated with X. In a middle portion of the first sensor element 2, there is the encoded region 4. The first location is indicated by reference numeral 10 and indicates one end of the encoded region and the second location is indicated by reference numeral 12 which indicates another end of the encoded region or the region to be magnetically encoded 4. Arrows 14 and 16 indicate the application of a current pulse. As indicated in FIG. 1, a first current pulse is applied to the first sensor element 2 at an outer region adjacent or close to the first location 10. For example, as will be described in further detail later on, the current is introduced into the first sensor element 2 at a plurality of points or regions close to the first location and for example surrounding the outer surface of the first sensor element 2 along the first location 10. As indicated with arrow 16, the current pulse is discharged from the first sensor element 2 close or adjacent or at the second location 12 for example at a plurality or locations along the end of the region 4 to be encoded. As already indicated before, a plurality of current pulses may be applied in succession they may have alternating directions from location 10 to location 12 or from location 12 to location 10.

Reference numeral 6 indicates a second sensor element which is for example a coil connected to a controller electronic 8. The controller electronic 8 may be adapted to further process a signal output by the second sensor element 6 such that an output signal may output from the control circuit corresponding to a torque applied to the first sensor element 2. The control circuit 8 may be an analog or digital circuit. The second sensor element 6 is adapted to detect a magnetic field emitted by the encoded region 4 of the first sensor element.

It is believed that, as already indicated above, if there is no stress or force applied to the first sensor element 2, there is essentially no field detected by the second sensor element 6. However, in case a stress or a force is applied to the secondary sensor element 2, there is a variation in the magnetic field emitted by the encoded region such that an increase of a magnetic field from the presence of almost no field is detected by the second sensor element 6.

It has to be noted that according to other exemplary embodiments of the present invention, even if there is no stress applied to the first sensor element, it may be possible that there is a magnetic field detectable outside or adjacent to the encoded region 4 of the first sensor element 2. However, it is to be noted that a stress applied to the first sensor element 2 causes a variation of the magnetic field emitted by the encoded region 4.

In the following, with reference to FIGS. 2*a*, 2*b*, 3*a*, 3*b* and 4, a method of manufacturing a torque sensor according to an exemplary embodiment of the present invention will be described. In particular, the method relates to the magnetization of the magnetically encoded region 4 of the first sensor element 2.

As may be taken from FIG. 2*a*, a current I is applied to an end region of a region 4 to be magnetically encoded. This end region as already indicated above is indicated with reference numeral 10 and may be a circumferential region on the outer surface of the first sensor element 2. The current I is discharged from the first sensor element 2 at another end area of the magnetically encoded region (or of the region to be magnetically encoded) which is indicated by reference numeral 12 and also referred to a second location. The current is taken from the first sensor element at an outer surface thereof, for example circumferentially in regions close or adjacent to location 12. As indicated by the dashed line between locations 10 and 12, the current I introduced at or along location 10 into the first sensor element flows through a core region or parallel to a core region to location 12. In other words, the current I flows through the region 4 to be encoded in the first sensor element 2.

FIG. 2*b* shows a cross-sectional view along AA'. In the schematic representation of FIG. 2*b*, the current flow is indicated into the plane of the FIG. 2*b* as a cross. Here, the current flow is indicated in a center portion of the cross-section of the first sensor element 2. It is believed that this introduction of a current pulse having a form as described above or in the following and having a maximum as described above or in the following causes a magnetic flow structure 20 in the cross-sectional view with a magnetic flow direction into one direction here into the clockwise direction. The magnetic flow structure 20 depicted in FIG. 2*b* is depicted essentially circular. However, the magnetic flow structure 20 may be adapted to the actual cross-section of the first sensor element 2 and may be, for example, more elliptical.

Figure 3A:
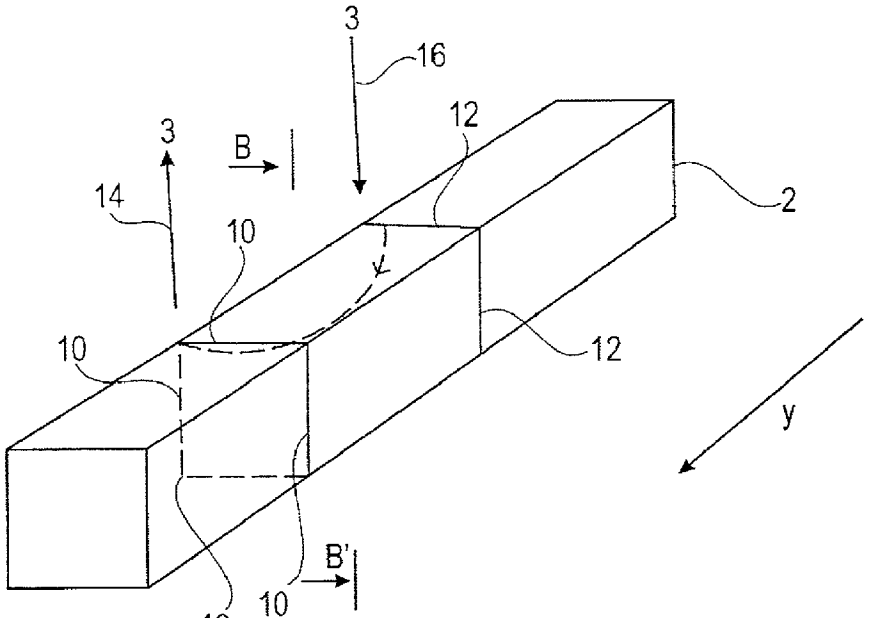
FIG. 3*a* shows another exemplary embodiment of a sensor element of a torque sensor according to the present invention for further explaining a principle of the present invention and an exemplary embodiment of a method of manufacturing a torque sensor according to the present invention.
Figure 3B:
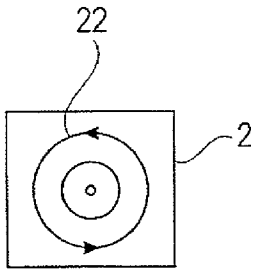
FIG. 3*b* shows a cross-sectional representation along BB' of FIG. 3*a*.

FIGS. 3*a* and 3*b* show a step of the method according to an exemplary embodiment of the present invention which may be applied after the step depicted in FIGS. 2*a* and 2*b*. FIG. 3*a* shows a first sensor element according to an exemplary embodiment of the present invention with the application of a second current pulse and FIG. 3*b* shows a cross-sectional view along BB' of the first sensor element 2.

As may be taken from FIG. 3*a*, in comparison to FIG. 2*a*, in FIG. 3*a*, the current I indicated by arrow 16 is introduced into the sensor element 2 at or adjacent to location 12 and is discharged or taken from the sensor element 2 at or adjacent to the location 10. In other words, the current is discharged in FIG. 3*a* at a location where it was introduced in FIG. 2*a* and vice versa. Thus, the introduction and discharging of the current I into the first sensor element 2 in FIG. 3*a* may cause a current through the region 4 to be magnetically encoded opposite to the respective current flow in FIG. 2*a*.

The current is indicated in FIG. 3*b* in a core region of the sensor element 2. As may be taken from a comparison of FIGS. 2*b* and 3*b*, the magnetic flow structure 22 has a direction opposite to the current flow structure 20 in FIG. 2*b*.

Figure 4:
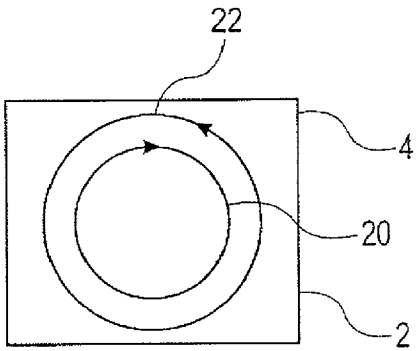
FIG. 4 shows a cross-sectional representation of the sensor element of the torque sensor of FIGS. 2*a* and 3*a* manufactured in accordance with a method according to an exemplary embodiment of the present invention.

As indicated before, the steps depicted in FIGS. 2*a*, 2*b* and 3*a* and 3*b* may be applied individually or may be applied in succession of each other. When firstly, the step depicted in FIGS. 2*a* and 2*b* is performed and then the step depicted in FIGS. 3*a* and 3*b*, a magnetic flow structure as depicted in the cross-sectional view through the encoded region 4 depicted in FIG. 4 may be caused. As may be taken from FIG. 4, the two current flow structures 20 and 22 are encoded into the encoded region together. Thus, in a direction essentially perpendicular to a surface of the first sensor element 2, in a direction to the core of the sensor element 2, there is a first magnetic flow having a first direction and then underlying there is a second magnetic flow having a second direction. As indicated in FIG. 4, the flow directions may be opposite to each other.

Thus, if there is no torque applied to the first torque sensor element 2, the two magnetic flow structures 20 and 22 may cancel each other such that there is essentially no magnetic field at the outside of the encoded region. However, in case a stress or force is applied to the first sensor element 2, the magnetic field structures 20 and 22 cease to cancel each other such that there is a magnetic field occurring at the outside of the encoded region which may then be detected by means of the secondary sensor element 6. This will be described in further detail in the following.

Figure 5:
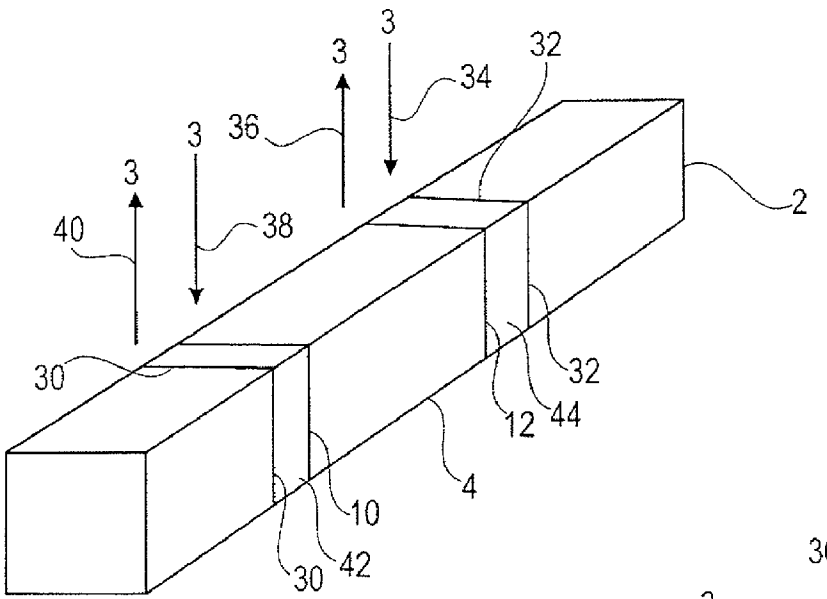
FIG. 5 shows another exemplary embodiment of a sensor element of a torque sensor according to the present invention for further explaining an exemplary embodiment of a manufacturing method of manufacturing a torque sensor according to the present invention.

FIG. 5 shows another exemplary of a first sensor element 2 according to an exemplary embodiment of the present invention as may be used in a torque sensor according to an exemplary embodiment which is manufactured according to a manufacturing method according to an exemplary embodiment of the present invention. As may be taken from FIG. 5, the first sensor element 2 has an encoded region 4 which is for example encoded in accordance with the steps and arrangements depicted in FIGS. 2*a*, 2*b*, 3*a*, 3*b* and 4.

Adjacent to locations 10 and 12, there are provided pinning regions 42 and 44. These regions 42 and 44 are provided for avoiding a fraying of the encoded region 4. In other words, the pinning regions 42 and 44 may allow for a more definite beginning and end of the encoded region 4.

In short, the first pinning region 42 may be adapted by introducing a current 38 close or adjacent to the first location 10 into the first sensor element 2 in the same manner as described, for example, with reference to FIG. 2*a*. However, the current I is discharged from the first sensor element 2 at a first location 30 which is at a distance from the end of the encoded region close or at location 10. This further location is indicated by reference numeral 30. The introduction of this further current pulse I is indicated by arrow 38 and the discharging thereof is indicated by arrow 40. The current pulses may have the same form shaping maximum as described above.

For generating the second pinning region 44, a current is introduced into the first sensor element 2 at a location 32 which is at a distance from the end of the encoded region 4 close or adjacent to location 12. The current is then discharged from the first sensor element 2 at or close to the location 12. The introduction of the current pulse I is indicated by arrows 34 and 36.

The pinning regions 42 and 44 for example are such that the magnetic flow structures of these pinning regions 42 and 44 are opposite to the respective adjacent magnetic flow structures in the adjacent encoded region 4. As may be taken from FIG. 5, the pinning regions can be coded to the first sensor element 2 after the coding or the complete coding of the encoded region 4.

Figure 6:
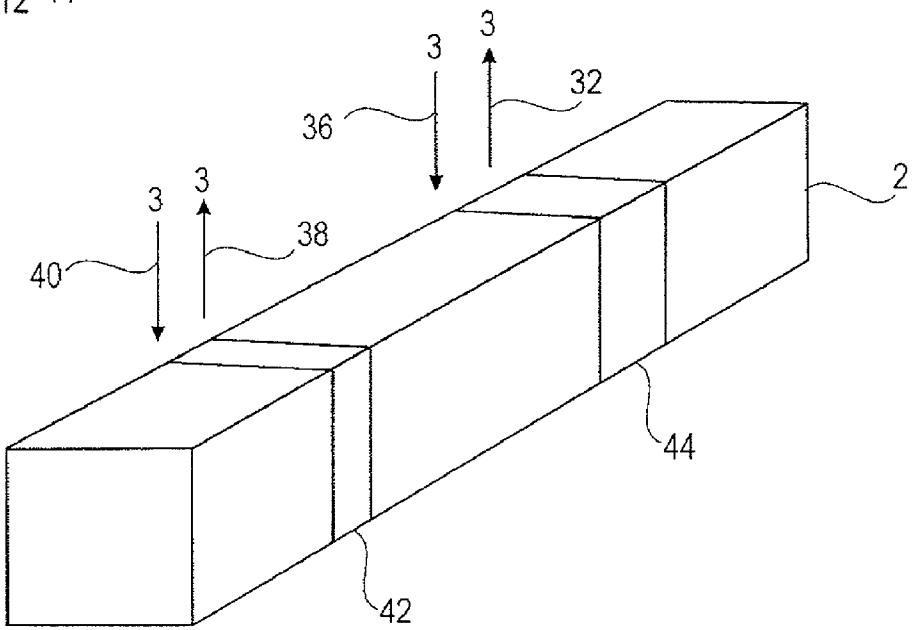
FIG. 6 shows another exemplary embodiment of a sensor element of a torque sensor according to the present invention for further explaining an exemplary embodiment of a manufacturing method for a torque sensor according to the present invention.

FIG. 6 shows another exemplary embodiment of the present invention where there is no encoding region 4. In other words, according to an exemplary embodiment of the present invention, the pinning regions may be coded into the first sensor element 2 before the actual coding of the magnetically encoded region 4.

Figure 7:
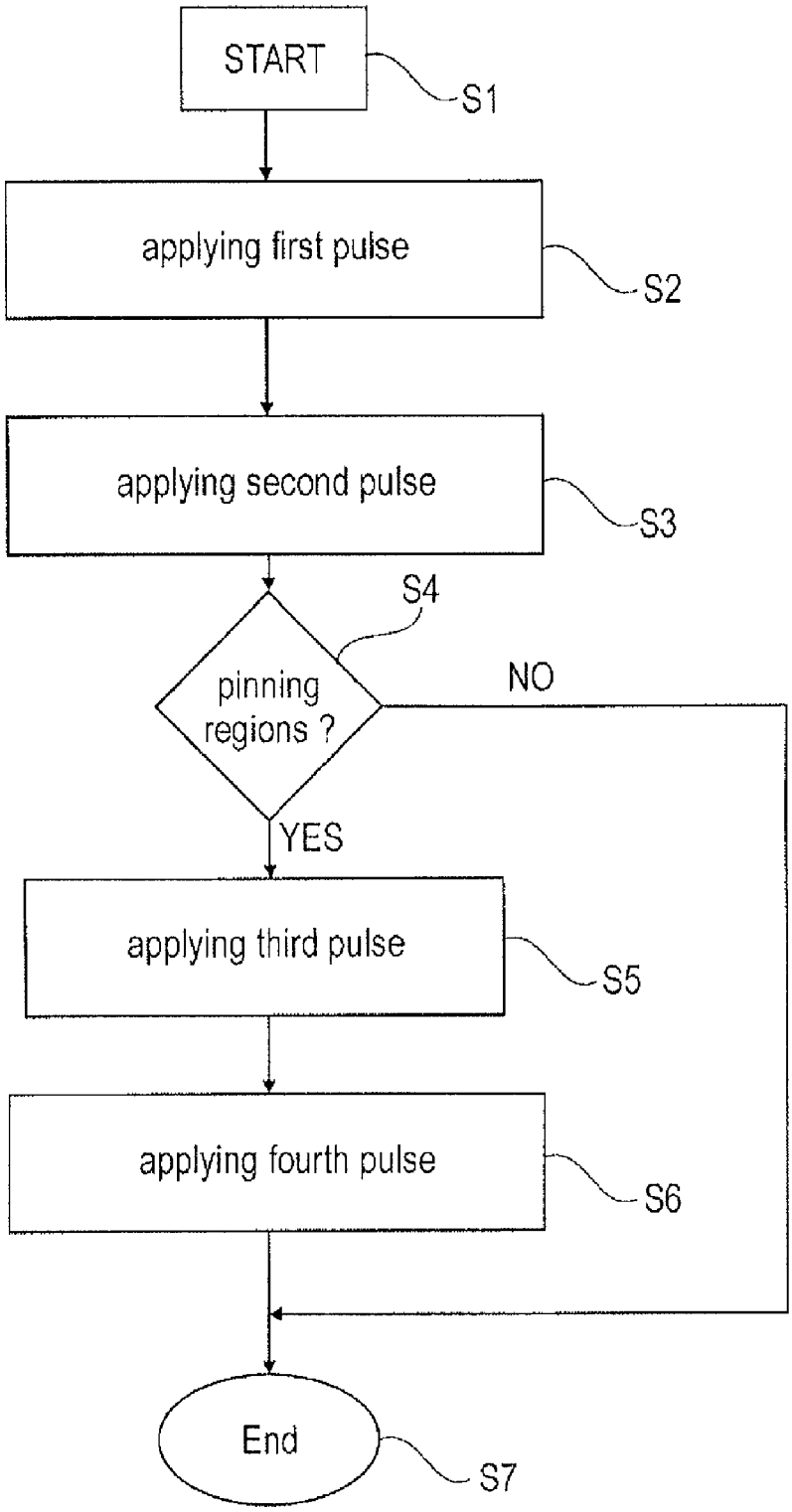
FIG. 7 shows a flow-chart for further explaining an exemplary embodiment of a method of manufacturing a torque sensor according to the present invention.

FIG. 7 shows a simplified flow-chart of a method of manufacturing a first sensor element 2 for a torque sensor according to an exemplary embodiment of the present invention.

After the start in step S1, the method continues to step S2 where a first pulse is applied as described as reference to FIGS. 2*a* and 2*b*. Then, after step S2, the method continues to step S3 where a second pulse is applied as described with reference to FIGS. 3*a* and 3*b*.

Then, the method continues to step S4 where it is decided whether the pinning regions are to be coded to the first sensor element 2 or not. If it is decided in step S4 that there will be no pinning regions, the method continues directly to step S7 where it ends.

If it is decided in step S4 that the pinning regions are to be coded to the first sensor element 2, the method continues to step S5 where a third pulse is applied to the pinning region 42 in the direction indicated by arrows 38 and 40 and to pinning region 44 indicated by the arrows 34 and 36. Then, the method continues to step S6 where force pulses applied to the respective pinning regions 42 and 44. To the pinning region 42, a force pulse is applied having a direction opposite to the direction indicated by arrows 38 and 40. Also, to the pinning region 44, a force pulse is applied to the pinning region having a direction opposite to the arrows 34 and 36. Then, the method continues to step S7 where it ends.

In other words, for example two pulses are applied for encoding of the magnetically encoded region 4. Those current pulses for example have an opposite direction. Furthermore, two pulses respectively having respective directions are applied to the pinning region 42 and to the pinning region 44.

Figure 8:
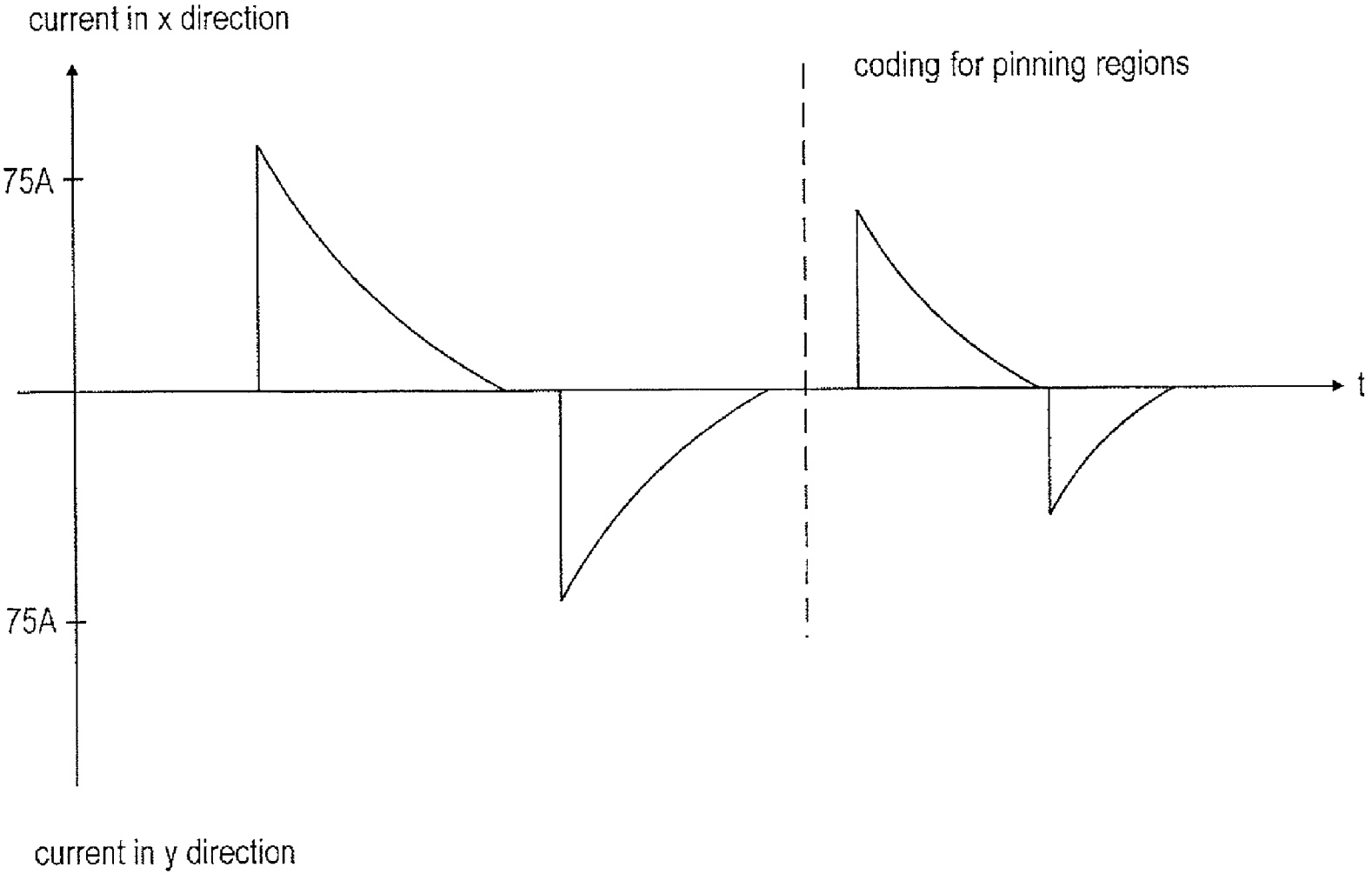
FIG. 8 shows a current versus time diagram for further explaining a method according to an exemplary embodiment of the present invention.

FIG. 8 shows a current versus time diagram of the pulses applied to the magnetically encoded region 4 and to the pinning regions. The positive direction of the y-axis of the diagram in FIG. 8 indicates a current flow into the x-direction and the negative direction of the y-axis of FIG. 8 indicates a current flow in the y-direction.

As may be taken from FIG. 8 for coding the magnetically encoded region 4, firstly a current pulse is applied having a direction into the x-direction. As may be taken from FIG. 8, the raising edge of the pulse is very sharp whereas the falling edge has a relatively long direction in comparison to the direction of the raising edge. As depicted in FIG. 8, the pulse may have a maximum of approximately 75 Ampere. In other applications, the pulse may be not as sharp as depicted in FIG. 8. However, the raising edge should be steeper or should have a shorter duration than the falling edge.

Then, a second pulse is applied to the encoded region 4 having an opposite direction. The pulse may have the same form as the first pulse. However, a maximum of the second pulse may also differ from the maximum of the first pulse. Although the immediate shape of the pulse may be different.

Then, for coding the pinning regions, pulses similar to the first and second pulse may be applied to the pinning regions as described with reference to FIGS. 5 and 6. Such pulses may be applied to the pinning regions simultaneously but also successfully for each pinning region. As depicted in FIG. 8, the pulses may have essentially the same form as the first and second pulses. However, a maximum may be smaller.

Figures 9, 10A:
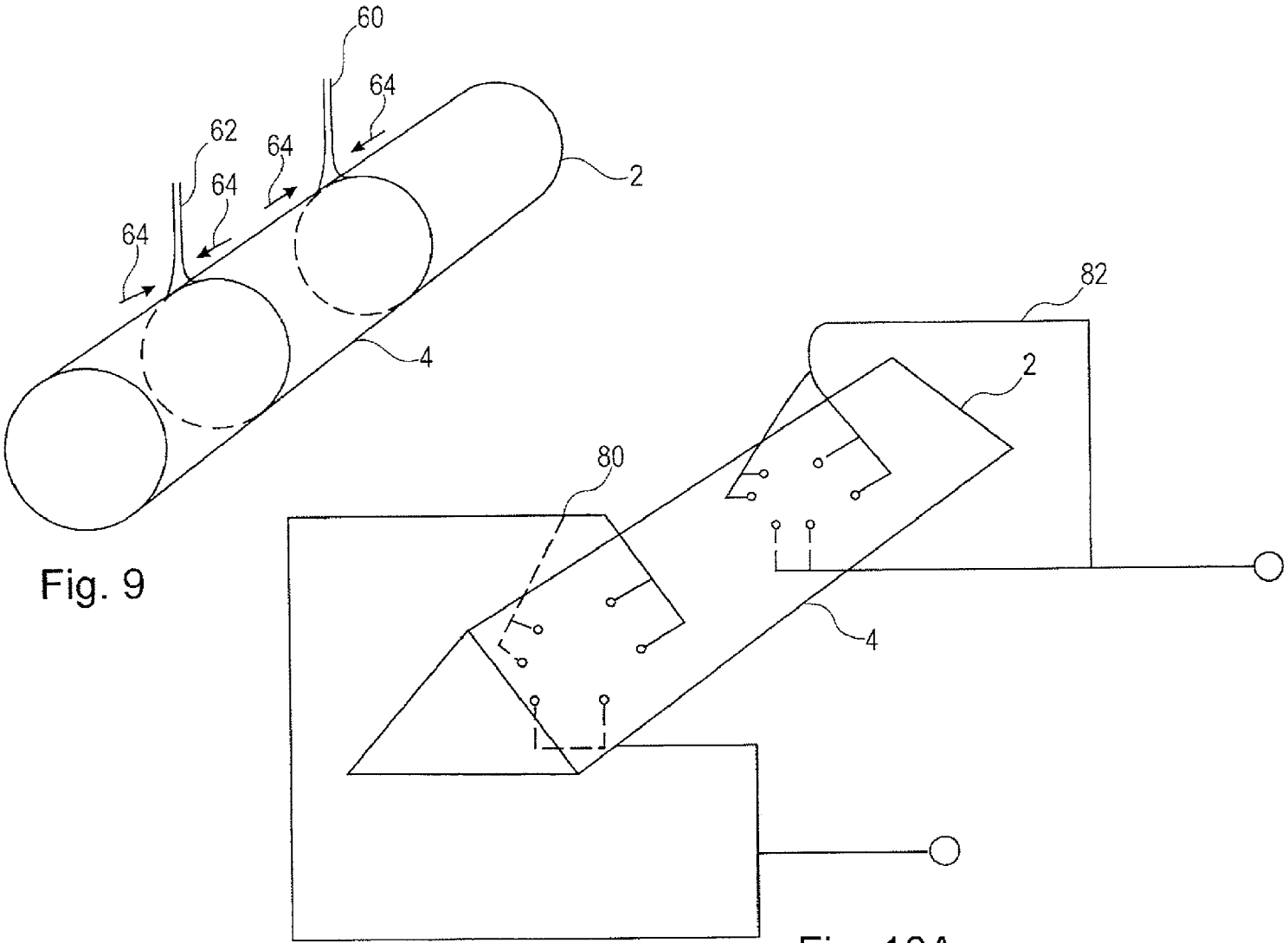
FIG. 9 shows another exemplary embodiment of a sensor element of a torque sensor according to the present invention with an electrode system according to an exemplary embodiment of the present invention.
FIG. 10*a* shows another exemplary embodiment of a torque sensor according to the present invention with an electrode system according to an exemplary embodiment of the present invention.
Figure 10B:
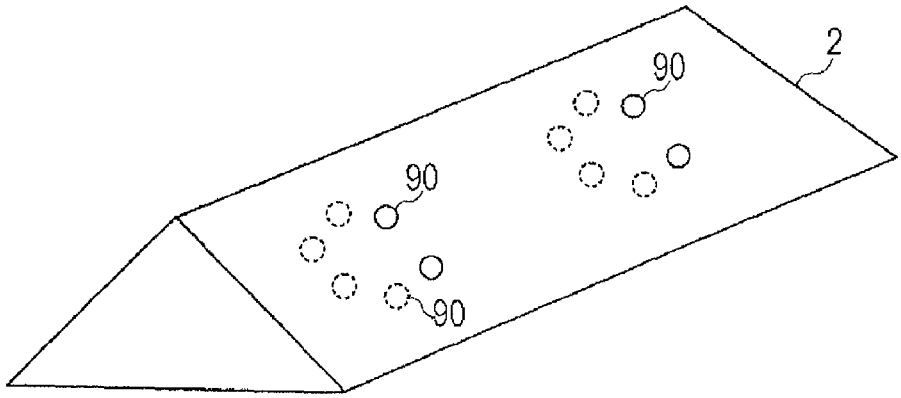
FIG. 10*b* shows the sensor element of FIG. 10*a* after the application of current surges by means of the electrode system of FIG. 10*a*.

FIG. 9 shows another exemplary embodiment of a first sensor element of a torque sensor according to an exemplary embodiment of the present invention showing an electrode arrangement for applying the current pulses for coding the magnetically encoded region 4. As may be taken from FIG. 9, a conductor without an isolation may be looped around the first sensor element 2 which is may be taken from FIG. 9 may be a circular shaft having a circular cross-section. For ensuring a close fit of the conductor on the outer surface of the first sensor element 2, the conductor may be clamped as shown by arrows 64.

FIG. 10*a* shows another exemplary embodiment of a first sensor element according to an exemplary embodiment of the present invention. Furthermore, FIG. 10*a* shows another exemplary embodiment of an electrode system according to an exemplary embodiment of the present invention. The electrode system 80 and 82 depicted in FIG. 10*a* contacts the first sensor element 2 which has a triangular cross-section with two contact points at each phase of the triangular first sensor element at each side of the region 4 which is to be encoded as magnetically encoded region. Overall, there are six contact points at each side of the region 4. The individual contact points may be connected to each other and then connected to one individual contact points.

If there is only a limited number of contact points between the electrode system and the first sensor element 2 and if the current pulses applied are very high, differing contact resistances between the contacts of the electrode systems and the material of the first sensor element 2 may cause burn marks at the first sensor element 2 at contact point to the electrode systems. These burn marks 90 may be color changes, may be welding spots, may be annealed areas or may simply be burn marks. According to an exemplary embodiment of the present invention, the number of contact points is increased or even a contact surface is provided such that such burn marks 90 may be avoided.

Figure 11:
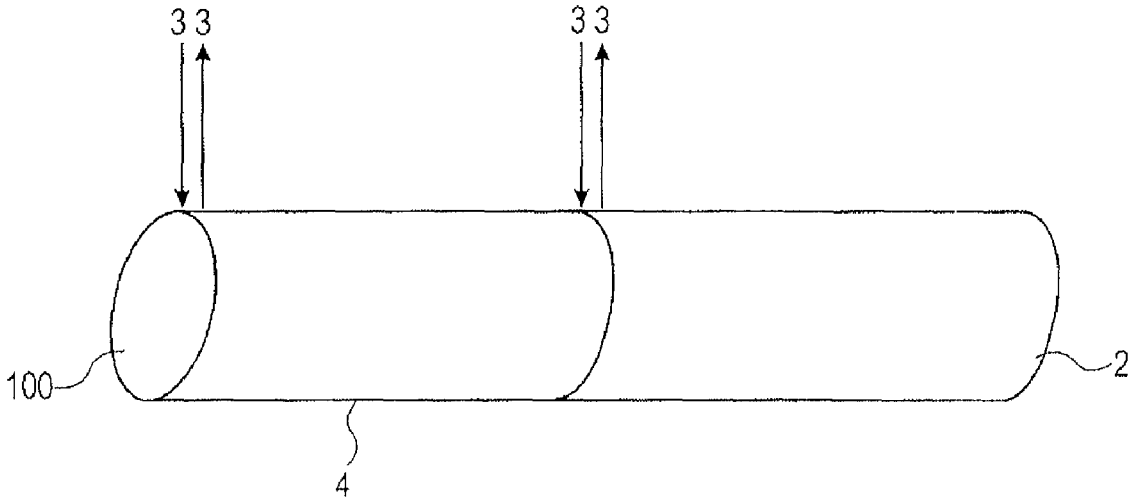
FIG. 11 shows another exemplary embodiment of a torque sensor element for a torque sensor according to the present invention.

FIG. 11 shows another exemplary embodiment of a first sensor element 2 which is a shaft having a circular cross-section according to an exemplary embodiment of the present invention. As may be taken from FIG. 11, the magnetically encoded region is at an end region of the first sensor element 2. According to an exemplary embodiment of the present invention, the magnetically encoded region 4 is not extend over the full length of the first sensor element 2. As may be taken from FIG. 11, it may be located at one end thereof. However, it has to be noted that according to an exemplary embodiment of the present invention, the current pulses are applied from an outer circumferential surface of the first sensor element 2 and not from the end face 100 of the first sensor element 2.

In the following, the so-called PCME ("Pulse-Current-Modulated Encoding") Sensing Technology will be described in detail, which can, according to a exemplary embodiment of the invention, be implemented to magnetize a magnetizable object which is then partially demagnetized according to the invention. In the following, the PCME technology will partly described in the context of torque sensing. However, this concept may implemented in the context of position sensing as well.

In this description, there are a number of acronyms used as otherwise some explanations and descriptions may be difficult to read. While the acronyms "ASIC", "IC", and "PCB" are already market standard definitions, there are many terms that are particularly related to the magnetostriction based NCT sensing technology. It should be noted that in this description, when there is a reference to NCT technology or to PCME, it is referred to exemplary embodiments of the present invention.

Table 1 shows a list of abbreviations used in the following description of the PCME technology.

TABLE 1

List of abbreviations

| Acronym | Description | Category |
|---|---|---|
| ASIC | Application Specific IC | Electronics |
| DF | Dual Field | Primary Sensor |
| EMF | Earth Magnetic Field | Test Criteria |
| FS | Full Scale | Test Criteria |
| Hot-Spotting | Sensitivity to nearby Ferro magnetic material | Specification |
| IC | Integrated Circuit | Electronics |
| MFS | Magnetic Field Sensor | Sensor |
| Component | | |
| NCT | Non Contact Torque | Technology |
| PCB | Printed Circuit Board | Electronics |
| PCME | Pulse Current Modulated Encoding | Technology |
| POC | Proof-of-Concept | |
| RSU | Rotational Signal Uniformity | Specification |
| SCSP | Signal Conditioning & Signal Processing | Electronics |
| SF | Single Field | Primary Sensor |
| SH | Sensor Host | Primary Sensor |
| SPHC | Shaft Processing Holding Clamp | Processing Tool |
| SSU | Secondary Sensor Unit | Sensor Component |

The magnetic principle based mechanical-stress sensing technology allows to design and to produce a wide range of "physical-parameter-sensors" (like Force Sensing, Torque Sensing, and Material Diagnostic Analysis) that can be applied where Ferro-Magnetic materials are used. The most common technologies used to build "magnetic-principle-based" sensors are: Inductive differential displacement measurement (requires torsion shaft), measuring the changes of the materials permeability, and measuring the magnetostriction effects.

Over the last 20 years a number of different companies have developed their own and very specific solution in how to design and how to produce a magnetic principle based torque sensor (i.e. ABB, FAST, Frauenhofer Institute, FT, Kubota, MDI, NCTE, RM, Siemens, and others). These technologies are at various development stages and differ in "how-it-works", the achievable performance, the systems reliability, and the manufacturing/system cost.

Some of these technologies require that mechanical changes are made to the shaft where torque should be measured (chevrons), or rely on the mechanical torsion effect (require a long shaft that twists under torque), or that something will be attached to the shaft itself (press-fitting a ring of certain properties to the shaft surface,), or coating of the shaft surface with a special substance. No-one has yet mastered a high-volume manufacturing process that can be applied to (almost) any shaft size, achieving tight performance tolerances, and is not based on already existing technology patents.

In the following, a magnetostriction principle based Non-Contact-Torque (NCT) Sensing Technology is described that offers to the user a whole host of new features and improved performances, previously not available. This technology enables the realization of a fully-integrated (small in space), real-time (high signal bandwidth) torque measurement, which is reliable and can be produced at an affordable cost, at any desired quantities. This technology is called: PCME (for Pulse-Current-Modulated Encoding) or Magnetostriction Transversal Torque Sensor.

The PCME technology can be applied to the shaft without making any mechanical changes to the shaft, or without attaching anything to the shaft. Most important, the PCME technology can be applied to any shaft diameter (most other technologies have here a limitation) and does not need to rotate/spin the shaft during the encoding process (very simple and low-cost manufacturing process) which makes this technology very applicable for high-volume application.

In the following, a Magnetic Field Structure (Sensor Principle) will be described.

The sensor life-time depends on a "closed-loop" magnetic field design. The PCME technology is based on two magnetic field structures, stored above each other, and running in opposite directions. When no torque stress or motion stress is applied to the shaft (also called Sensor Host, or SH) then the SH will act magnetically neutral (no magnetic field can be sensed at the outside of the SH).

Figure 12:
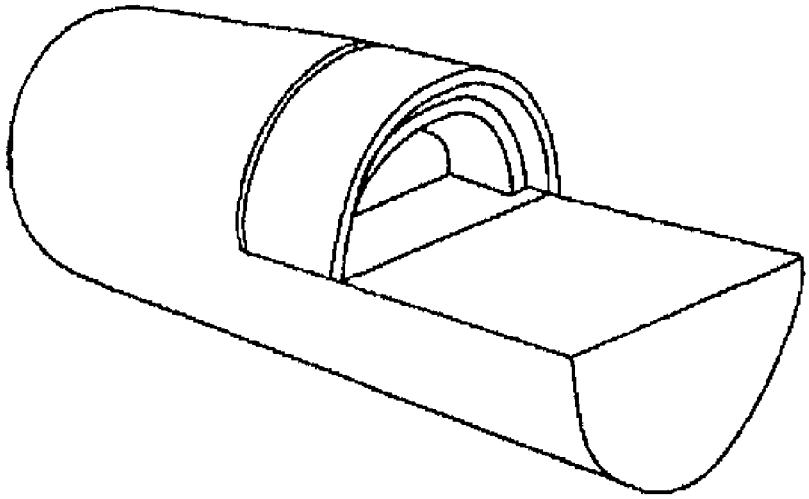
FIG. 12 shows a schematic diagram of a sensor element of a torque sensor according to another exemplary embodiment of the present invention showing that two magnetic fields may be stored in the shaft and running in endless circles.

FIG. 12 shows that two magnetic fields are stored in the shaft and running in endless circles. The outer field runs in one direction, while the inner field runs in the opposite direction.

Figure 13:
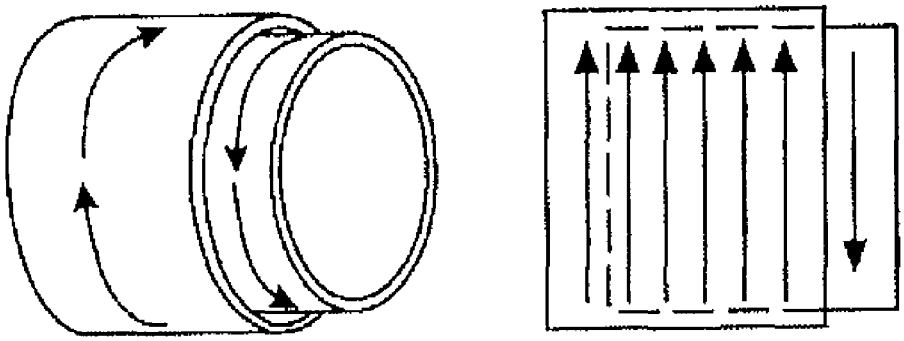
FIG. 13 is another schematic diagram for illustrating PCME sensing technology using two counter cycle or magnetic field loops which may be generated in accordance with a manufacturing method according to the present invention.

FIG. 13 illustrates that the PCME sensing technology uses two Counter-Circular magnetic field loops that are stored on top of each other (Picky-Back mode).

When mechanical stress (like reciprocation motion or torque) is applied at both ends of the PCME magnetized SH (Sensor Host, or Shaft) then the magnetic flux lines of both magnetic structures (or loops) will tilt in proportion to the applied torque.

Figure 14:
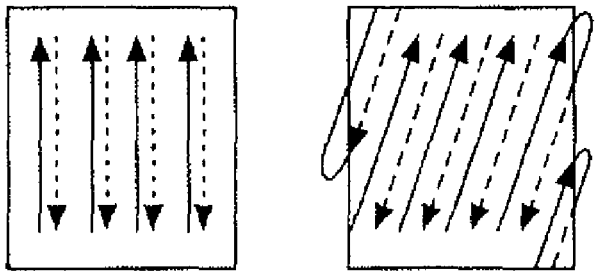
FIG. 14 shows another schematic diagram for illustrating that when no mechanical stress is applied to the sensor element according to an exemplary embodiment of the present invention, magnetic flux lines are running in its original paths.

As illustrated in FIG. 14, when no mechanical stresses are applied to the SH the magnetic flux lines are running in its original path. When mechanical stresses are applied the magnetic flux lines tilt in proportion to the applied stress (like linear motion or torque).

Depending on the applied torque direction (clockwise or anti-clockwise, in relation to the SH) the magnetic flux lines will either tilt to the right or tilt to the left. Where the magnetic flux lines reach the boundary of the magnetically encoded region, the magnetic flux lines from the upper layer will join-up with the magnetic flux lines from the lower layer and visa-versa. This will then form a perfectly controlled toroidal shape.

The benefits of such a magnetic structure are:

- Reduced (almost eliminated) parasitic magnetic field structures when mechanical stress is applied to the SH (this will result in better RSU performances).
- Higher Sensor-Output Signal-Slope as there are two "active" layers that compliment each other when generating a mechanical stress related signal. Explanation: When using a single-layer sensor design, the "tilted" magnetic flux lines that exit at the encoding region boundary have to create a "return passage" from one boundary side to the other. This effort effects how much signal is available to be sensed and measured outside of the SH with the secondary sensor unit.
- There are almost no limitations on the SH (shaft) dimensions where the PCME technology will be applied to. The dual layered magnetic field structure can be adapted to any solid or hollow shaft dimensions.
- The physical dimensions and sensor performances are in a very wide range programmable and therefore can be tailored to the targeted application.
- This sensor design allows to measure mechanical stresses coming from all three dimensions axis, including in-line forces applied to the shaft (applicable as a load-cell). Explanation: Earlier magnetostriction sensor designs (for example from FAST Technology) have been limited to be sensitive in 2 dimensional axis only, and could not measure in-line forces.

Figure 15:
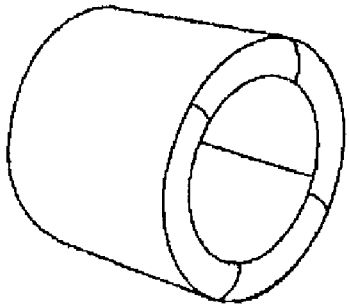
FIG. 15 is another schematic diagram for further explaining a principle of an exemplary embodiment of the present invention.

Referring to FIG. 15, when torque is applied to the SH, the magnetic flux lines from both Counter-Circular magnetic loops are connecting to each other at the sensor region boundaries.

When mechanical torque stress is applied to the SH then the magnetic field will no longer run around in circles but tilt slightly in proportion to the applied torque stress. This will cause the magnetic field lines from one layer to connect to the magnetic field lines in the other layer, and with this form a toroidal shape.

Figure 16:
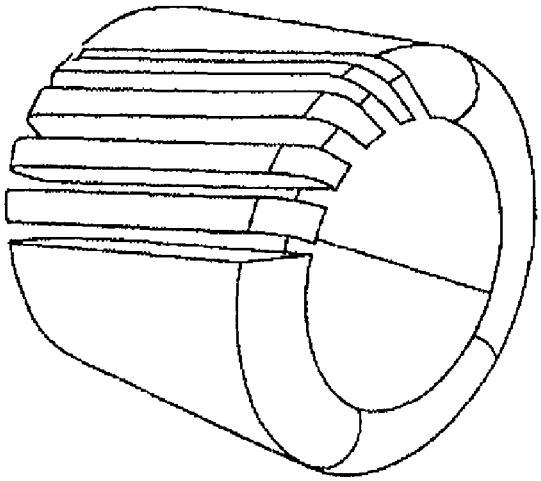
FIG. 16 is another schematic diagram for further explaining the principle of an exemplary embodiment of the present invention.

Referring to FIG. 16, an exaggerated presentation is shown of how the magnetic flux line will form an angled toroidal structure when high levels of torque are applied to the SH.

In the following, features and benefits of the PCM-Encoding (PCME) Process will be described.

The magnetostriction NCT sensing technology from NCTE according to the present invention offers high performance sensing features like:

- No mechanical changes required on the Sensor Host (already existing shafts can be used as they are)
- Nothing has to be attached to the Sensor Host (therefore nothing can fall off or change over the shaft-lifetime=high MTBF)
- During measurement the SH can rotate, reciprocate or move at any desired speed (no limitations on rpm)
- Very good RSU (Rotational Signal Uniformity) performances
- Excellent measurement linearity (up to 0.01% of FS)
- High measurement repeatability
- Very high signal resolution (better than 14 bit)
- Very high signal bandwidth (better than 10 kHz)

Depending on the chosen type of magnetostriction sensing technology, and the chosen physical sensor design, the mechanical power transmitting shaft (also called "Sensor Host" or in short "SH") can be used "as is" without making any mechanical changes to it or without attaching anything to the shaft. This is then called a "true" Non-Contact-Torque measurement principle allowing the shaft to rotate freely at any desired speed in both directions.

The here described PCM-Encoding (PCME) manufacturing process according to an exemplary embodiment of the present invention provides additional features no other magnetostriction technology can offer (Uniqueness of this technology):

- More then three times signal strength in comparison to alternative magnetostriction encoding processes (like the "RS" process from FAST).
- Easy and simple shaft loading process (high manufacturing through-putt).
- No moving components during magnetic encoding process (low complexity manufacturing equipment=high MTBF, and lower cost).
- Process allows NCT sensor to be "fine-tuning" to achieve target accuracy of a fraction of one percent.
- Manufacturing process allows shaft "pre-processing" and "post-processing" in the same process cycle (high manufacturing through-putt).

Sensing technology and manufacturing process is ratiometric and therefore is applicable to all shaft or tube diameters.

The PCM-Encoding process can be applied while the SH is already assembled (depending on accessibility) (maintenance friendly).

Final sensor is insensitive to axial shaft movements (the actual allowable axial shaft movement depends on the physical "length" of the magnetically encoded region).

Magnetically encoded SH remains neutral and has little to non magnetic field when no forces (like torque) are applied to the SH.

Sensitive to mechanical forces in all three dimensional axis.

In the following, the Magnetic Flux Distribution in the SH will be described.

The PCME processing technology is based on using electrical currents, passing through the SH (Sensor Host or Shaft) to achieve the desired, permanent magnetic encoding of the Ferro-magnetic material. To achieve the desired sensor performance and features a very specific and well controlled electrical current is required. Early experiments that used DC currents failed because of luck of understanding how small amounts and large amounts of DC electric current are travelling through a conductor (in this case the "conductor" is the mechanical power transmitting shaft, also called Sensor Host or in short "SH").

Figure 17:
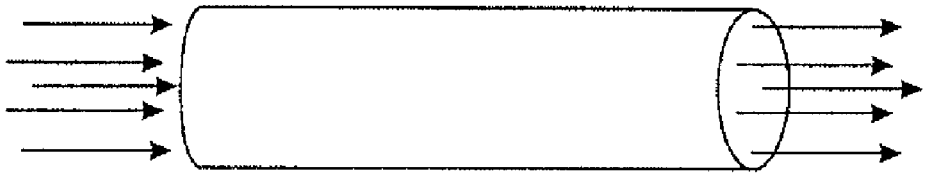
FIGS. 17-22 are schematic representations for further explaining a principle of an exemplary embodiment of the present invention.

Referring to FIG. 17, an assumed electrical current density in a conductor is illustrated.

It is widely assumed that the electric current density in a conductor is evenly distributed over the entire cross-section of the conductor when an electric current (DC) passes through the conductor.

Figure 18:
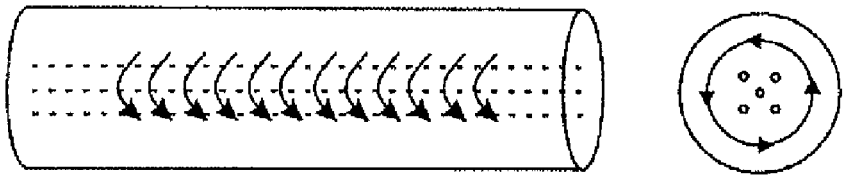

Referring to FIG. 18, a small electrical current forming magnetic field that ties current path in a conductor is shown.

It is our experience that when a small amount of electrical current (DC) is passing through the conductor that the current density is highest at the centre of the conductor. The two main reasons for this are: The electric current passing through a conductor generates a magnetic field that is tying together the current path in the centre of the conductor, and the impedance is the lowest in the centre of the conductor.

Figure 19:
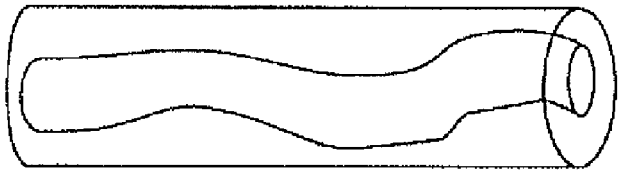

Referring to FIG. 19, a typical flow of small electrical currents in a conductor is illustrated.

In reality, however, the electric current may not flow in a "straight" line from one connection pole to the other (similar to the shape of electric lightening in the sky).

At a certain level of electric current the generated magnetic field is large enough to cause a permanent magnetization of the Ferro-magnetic shaft material. As the electric current is flowing near or at the centre of the SH, the permanently stored magnetic field will reside at the same location: near or at the centre of the SH. When now applying mechanical torque or linear force for oscillation/reciprocation to the shaft, then shaft internally stored magnetic field will respond by tilting its magnetic flux path in accordance to the applied mechanical force. As the permanently stored magnetic field lies deep below the shaft surface the measurable effects are very small, not uniform and therefore not sufficient to build a reliable NCT sensor system.

Figure 20:
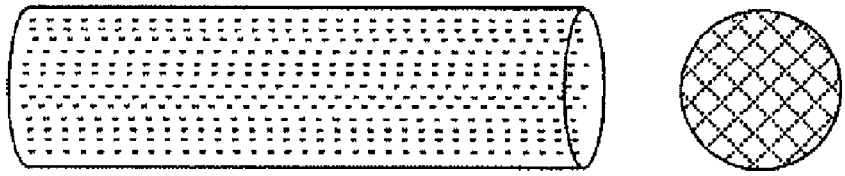

Referring to FIG. 20, a uniform current density in a conductor at saturation level is shown.

Only at the saturation level is the electric current density (when applying DC) evenly distributed at the entire cross section of the conductor. The amount of electrical current to achieve this saturation level is extremely high and is mainly influenced by the cross section and conductivity (impedance) of the used conductor.

Figure 21:
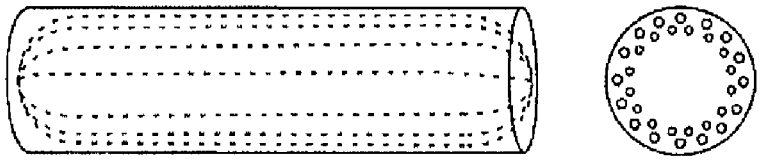

Referring to FIG. 21, electric current travelling beneath or at the surface of the conductor (Skin-Effect) is shown.

It is also widely assumed that when passing through alternating current (like a radio frequency signal) through a conductor that the signal is passing through the skin layers of the conductor, called the Skin Effect. The chosen frequency of the alternating current defines the "Location/position" and "depth" of the Skin Effect. At high frequencies the electrical current will travel right at or near the surface of the conductor (A) while at lower frequencies (in the 5 to 10 Hz regions for a 20 mm diameter SH) the electrical alternating current will penetrate more the centre of the shafts cross section (E). Also, the relative current density is higher in the current occupied regions at higher AC frequencies in comparison to the relative current density near the centre of the shaft at very low AC frequencies (as there is more space available for the current to flow through).

Figure 22:
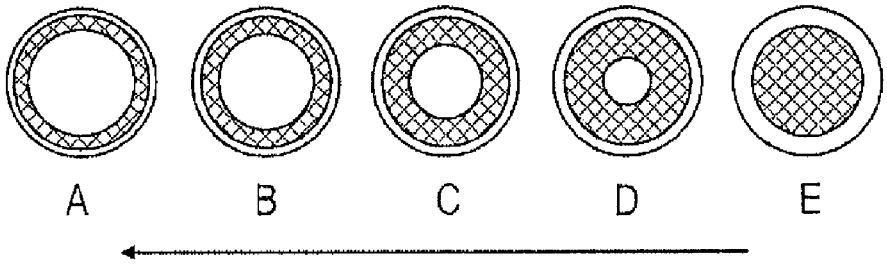

Referring to FIG. 22, the electrical current density of an electrical conductor (cross-section 90 deg to the current flow) when passing through the conductor an alternating current at different frequencies is illustrated.

The desired magnetic field design of the PCME sensor technology are two circular magnetic field structures, stored in two layers on top of each other ("Picky-Back"), and running in opposite direction to each other (Counter-Circular).

Again referring to FIG. 13, a desired magnetic sensor structure is shown: two endless magnetic loops placed on top of each other, running in opposite directions to each other: Counter-Circular "Picky-Back" Field Design.

To make this magnetic field design highly sensitive to mechanical stresses that will be applied to the SH (shaft), and to generate the largest sensor signal possible, the desired magnetic field structure has to be placed nearest to the shaft surface. Placing the circular magnetic fields to close to the centre of the SH will cause damping of the user available sensor-output-signal slope (most of the sensor signal will travel through the Ferro-magnetic shaft material as it has a much higher permeability in comparison to air), and increases the non-uniformity of the sensor signal (in relation to shaft rotation and to axial movements of the shaft in relation to the secondary sensor.

Figure 23:
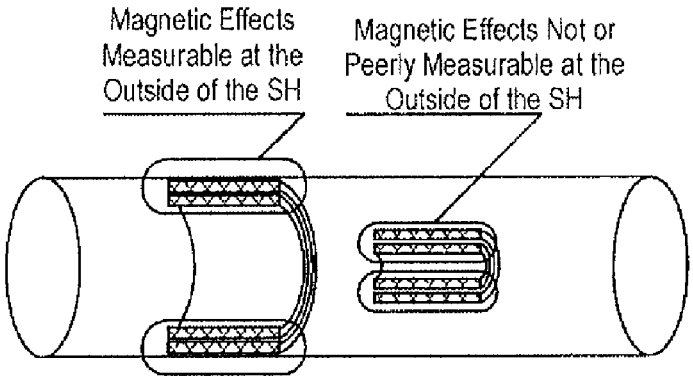
FIG. 23 is another schematic diagram for explaining a principle of an exemplary embodiment of the present invention.

Referring to FIG. 23, magnetic field structures stored near the shaft surface and stored near the centre of the shaft are illustrated.

It may be difficult to achieve the desired permanent magnetic encoding of the SH when using AC (alternating current) as the polarity of the created magnetic field is constantly changing and therefore may act more as a Degaussing system.

The PCME technology requires that a strong electrical current ("uni-polar" or DC, to prevent erasing of the desired magnetic field structure) is travelling right below the shaft surface (to ensure that the sensor signal will be uniform and measurable at the outside of the shaft). In addition a Counter-Circular, "picky back" magnetic field structure needs to be formed.

It is possible to place the two Counter-Circular magnetic field structures in the shaft by storing them into the shaft one after each other. First the inner layer will be stored in the SH, and then the outer layer by using a weaker magnetic force (preventing that the inner layer will be neutralized and deleted by accident. To achieve this, the known "permanent" magnet encoding techniques can be applied as described in patents from FAST technology, or by using a combination of electrical current encoding and the "permanent" magnet encoding.

A much simpler and faster encoding process uses "only" electric current to achieve the desired Counter-Circular "Picky-Back" magnetic field structure. The most challenging part here is to generate the Counter-Circular magnetic field.

A uniform electrical current will produce a uniform magnetic field, running around the electrical conductor in a 90 deg angle, in relation to the current direction (A). When placing two conductors side-by-side (B) then the magnetic field between the two conductors seems to cancel-out the effect of each other (C). Although still present, there is no detectable (or measurable) magnetic field between the closely placed two conductors. When placing a number of electrical conductors side-by-side (D) the "measurable" magnetic field seems to go around the outside the surface of the "flat" shaped conductor.

Figure 24:
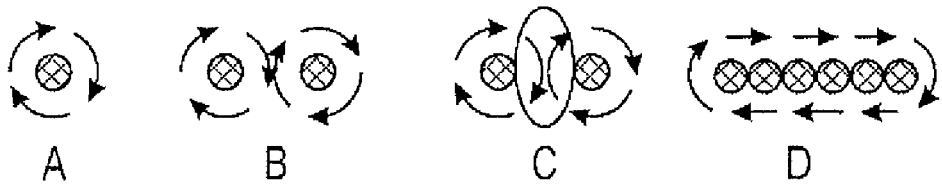
FIGS. 24, 25 and 26 are schematic diagrams for further explaining a principle of an exemplary embodiment of the present invention.

Referring to FIG. 24, the magnetic effects when looking at the cross-section of a conductor with a uniform current flowing through them are shown.

The "flat" or rectangle shaped conductor has now been bent into a "U"-shape. When passing an electrical current through the "U"-shaped conductor then the magnetic field following the outer dimensions of the "U"-shape is cancelling out the measurable effects in the inner halve of the "U".

Figure 25:
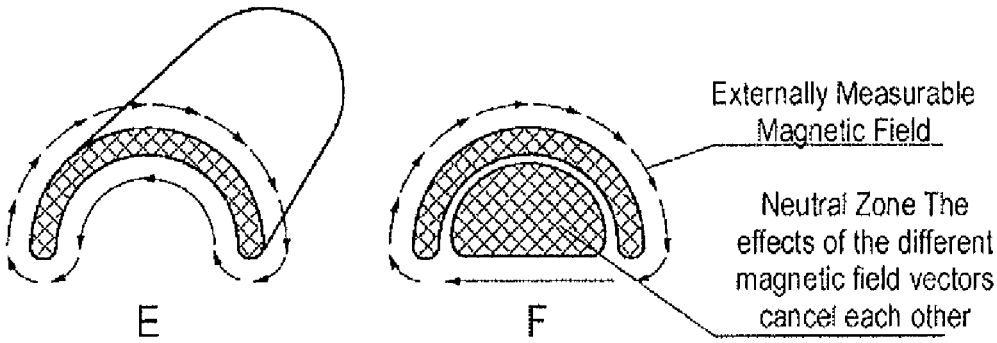

Referring to FIG. 25, the zone inside the "U"-shaped conductor seem to be magnetically "Neutral" when an electrical current is flowing through the conductor.

When no mechanical stress is applied to the cross-section of a "U"-shaped conductor it seems that there is no magnetic field present inside of the "U" (F). But when bending or twisting the "U"-shaped conductor the magnetic field will no longer follow its original path (90 deg angle to the current flow). Depending on the applied mechanical forces, the magnetic field begins to change slightly its path. At that time the magnetic-field-vector that is caused by the mechanical stress can be sensed and measured at the surface of the conductor, inside and outside of the "U"-shape. Note: This phenomena is applies only at very specific electrical current levels.

The same applies to the "O"-shaped conductor design. When passing a uniform electrical current through an "O"-shaped conductor (Tube) the measurable magnetic effects inside of the "O" (Tube) have cancelled-out each other (G).

Figure 26:
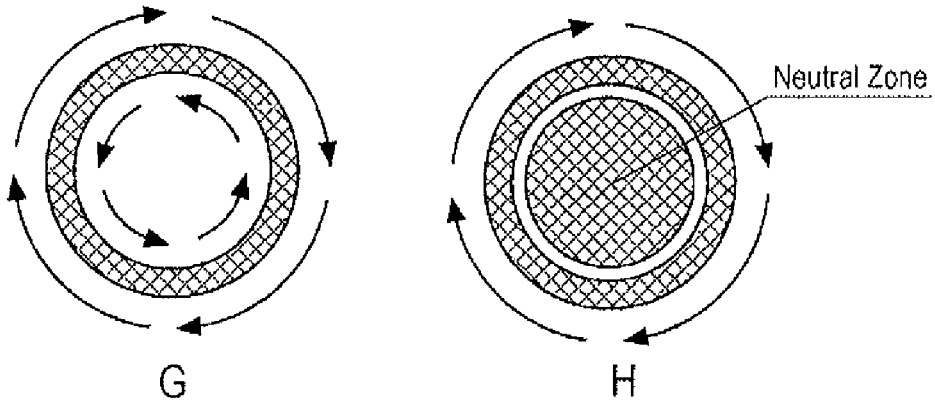

Referring to FIG. 26, the zone inside the "O"-shaped conductor seem to be magnetically "Neutral" when an electrical current is flowing through the conductor.

However, when mechanical stresses are applied to the "O"-shaped conductor (Tube) it becomes evident that there has been a magnetic field present at the inner side of the "O"-shaped conductor. The inner, counter directional magnetic field (as well as the outer magnetic field) begins to tilt in relation to the applied torque stresses. This tilting field can be clearly sensed and measured.

In the following, an Encoding Pulse Design will be described.

To achieve the desired magnetic field structure (Counter-Circular, Picky-Back, Fields Design) inside the SH, according to an exemplary embodiment of a method of the present invention, unipolar electrical current pulses are passed through the Shaft (or SH). By using "pulses" the desired "Skin-Effect" can be achieved. By using a "unipolar" current direction (not changing the direction of the electrical current) the generated magnetic effect will not be erased accidentally.

The used current pulse shape is most critical to achieve the desired PCME sensor design. Each parameter has to be accurately and repeatable controlled: Current raising time, Constant current on-time, Maximal current amplitude, and Current falling time. In addition it is very critical that the current enters and exits very uniformly around the entire shaft surface.

In the following, a Rectangle Current Pulse Shape will be described.

Figure 27:
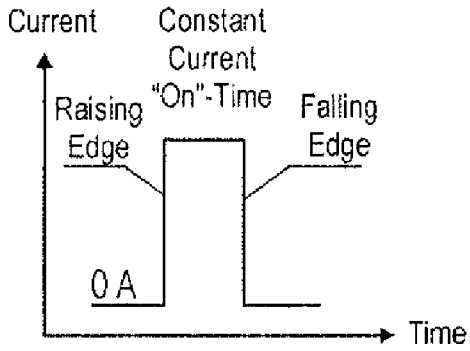
FIG. 27 is a current versus time diagram for illustrating a current pulse which may be applied to a sensor element according to a manufacturing method according to an exemplary embodiment of the present invention.

Referring to FIG. 27, a rectangle shaped electrical current pulse is illustrated.

A rectangle shaped current pulse has a fast raising positive edge and a fast falling current edge. When passing a rectangle shaped current pulse through the SH, the raising edge is responsible for forming the targeted magnetic structure of the PCME sensor while the flat "on" time and the falling edge of the rectangle shaped current pulse are counter productive.

Figure 28:
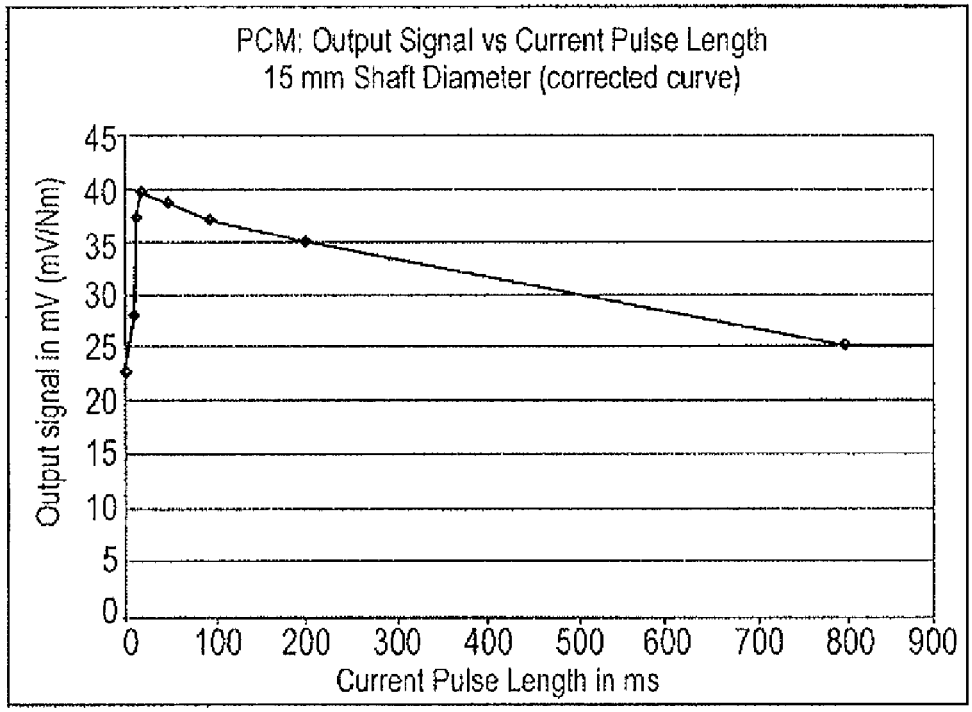
FIG. 28 shows an output signal versus current pulse length diagram according to an exemplary embodiment of the present invention.

Referring to FIG. 28, a relationship between rectangles shaped Current Encoding Pulse-Width (Constant Current On-Time) and Sensor Output Signal Slope is shown.

In the following example a rectangle shaped current pulse has been used to generate and store the Couter-Circilar "Picky-Back" field in a 15 mm diameter, 14CrNi14 shaft. The pulsed electric current had its maximum at around 270 Ampere. The pulse "on-time" has been electronically controlled. Because of the high frequency component in the rising and falling edge of the encoding pulse, this experiment can not truly represent the effects of a true DC encoding SH. Therefore the Sensor-Output-Signal Slope-curve eventually flattens-out at above 20 mV/Nm when passing the Constant-Current On-Time of 1000 ms.

Without using a fast raising current-pulse edge (like using a controlled ramping slope) the sensor output signal slope would have been very poor (below 10 mV/Nm). Note: In this experiment (using 14CrNi14) the signal hysteresis was around 0.95% of the FS signal (FS=75 Nm torque).

Figure 29:
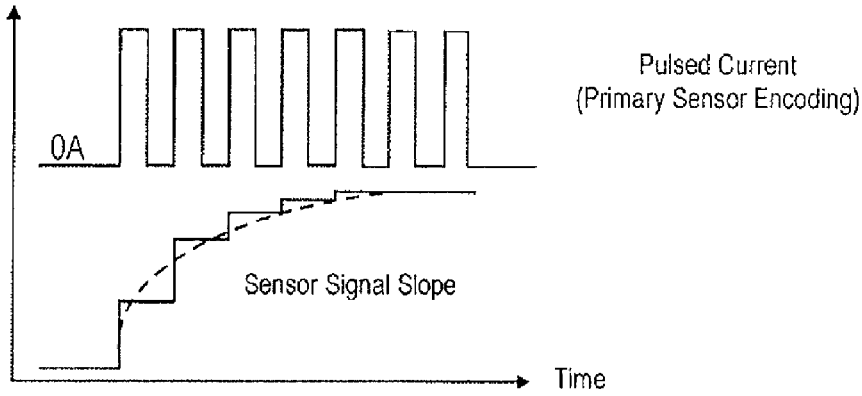
FIG. 29 shows a current versus time diagram with current pulses according to an exemplary embodiment of the present invention which may be applied to sensor elements according to a method of the present invention.

Referring to FIG. 29, increasing the Sensor-Output Signal-Slope by using several rectangle shaped current pulses in succession is shown.

The Sensor-Output-Signal slope can be improved when using several rectangle shaped current-encoding-pulses in successions. In comparisons to other encoding-pulse-shapes the fast falling current-pulse signal slope of the rectangle shaped current pulse will prevent that the Sensor-Output-Signal slope may ever reach an optimal performance level. Meaning that after only a few current pulses (2 to 10) have been applied to the SH (or Shaft) the Sensor-Output Signal-Slope will no longer rise.

In the following, a Discharge Current Pulse Shape is described.

The Discharge-Current-Pulse has no Constant-Current ON-Time and has no fast falling edge. Therefore the primary and most felt effect in the magnetic encoding of the SH is the fast raising edge of this current pulse type.

Figure 30:
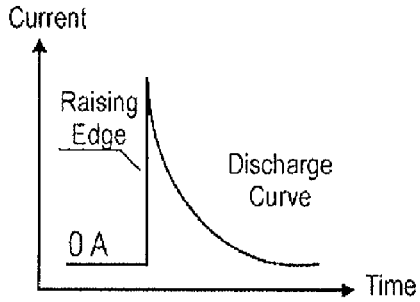
FIG. 30 shows another current versus time diagram showing an exemplary embodiment of a current pulse applied to a sensor element such as a shaft according to a method of an exemplary embodiment of the present invention.

As shown in FIG. 30, a sharp raising current edge and a typical discharging curve provides best results when creating a PCME sensor.

Figure 31:
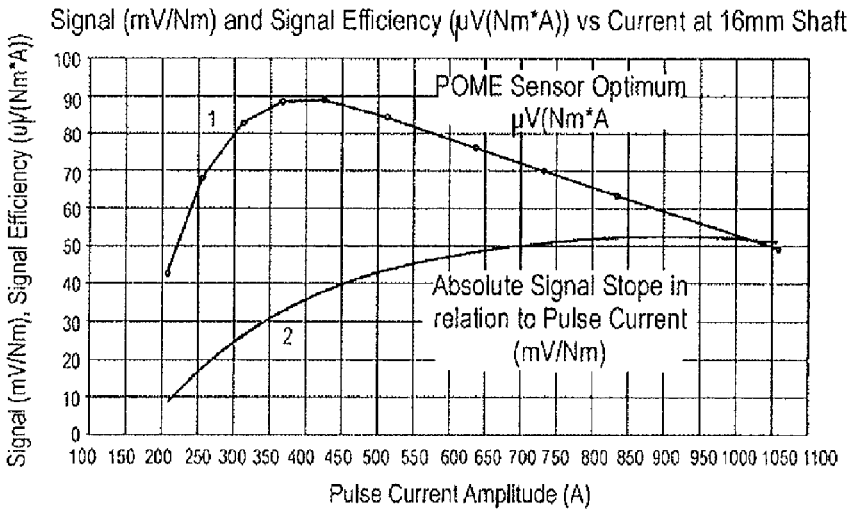
FIG. 31 shows a signal and signal efficiency versus current diagram in accordance with an exemplary embodiment of the present invention.

Referring to FIG. 31, a PCME Sensor-Output Signal-Slope optimization by identifying the right pulse current is illustrated.

At the very low end of the pulse current scale (0 to 75 A for a 15 mm diameter shaft, 14CrNi14 shaft material) the "Discharge-Current-Pulse type is not powerful enough to cross the magnetic threshold needed to create a lasting magnetic field inside the Ferro magnetic shaft. When increasing the pulse current amplitude the double circular magnetic field structure begins to form below the shaft surface. As the pulse current amplitude increases so does the achievable torque sensor-output signal-amplitude of the secondary sensor system. At around 400 A to 425 A the optimal PCME sensor design has been achieved (the two counter flowing magnetic regions have reached their most optimal distance to each other and the correct flux density for best sensor performances.

Figure 32:
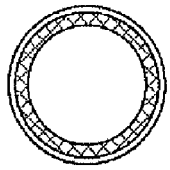
FIG. 32 is a cross-sectional view of a sensor element having a PCME electrical current density according to an exemplary embodiment of the present invention.

Referring to FIG. 32, Sensor Host (SH) cross section with the optimal PCME electrical current density and location during the encoding pulse is illustrated.

When increasing further the pulse current amplitude the absolute, torque force related, sensor signal amplitude will further increase (curve 2) for some time while the overall PCME-typical sensor performances will decrease (curve 1). When passing 900 A Pulse Current Amplitude (for a 15 mm diameter shaft) the absolute, torque force related, sensor signal amplitude will begin to drop as well (curve 2) while the PCME sensor performances are now very poor (curve 1).

Figure 33:
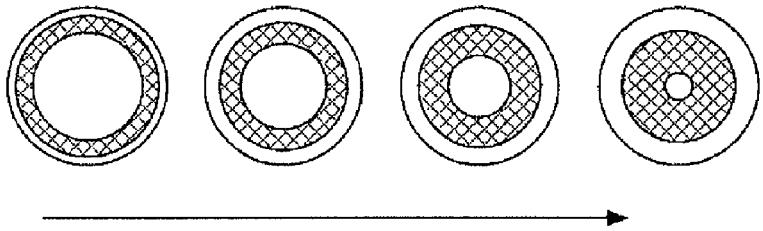
FIG. 33 shows a cross-sectional view of a sensor element and an electrical pulse current density at different and increasing pulse current levels according to an exemplary embodiment of the present invention.

Referring to FIG. 33, Sensor Host (SH) cross sections and the electrical pulse current density at different and increasing pulse current levels is shown.

As the electrical current occupies a larger cross section in the SH the spacing between the inner circular region and the outer (near the shaft surface) circular region becomes larger.

Figure 34:
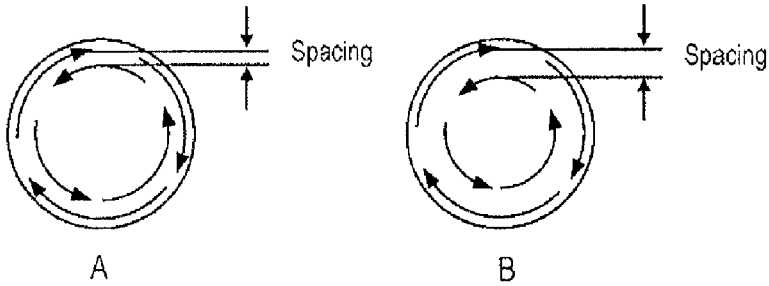
FIGS. 34*a* and 34*b* show a spacing achieved with different current pulses of magnetic flows in sensor elements according to the present invention.

Referring to FIG. 34, better PCME sensor performances will be achieved when the spacing between the Counter-Circular "Picky-Back" Field design is narrow (A).

The desired double, counter flow, circular magnetic field structure will be less able to create a close loop structure under torque forces which results in a decreasing secondary sensor signal amplitude.

Figure 35:
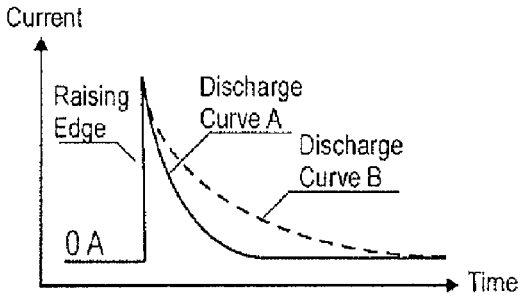
FIG. 35 shows a current versus time diagram of a current pulse as it may be applied to a sensor element according to an exemplary embodiment of the present invention.

Referring to FIG. 35, flattening-out the current-discharge curve will also increase the Sensor-Output Signal-Slope.

When increasing the Current-Pulse discharge time (making the current pulse wider) (B) the Sensor-Output Signal-Slope will increase. However the required amount of current is very high to reduce the slope of the falling edge of the current pulse. It might be more practical to use a combination of a high current amplitude (with the optimal value) and the slowest possible discharge time to achieve the highest possible Sensor-Output Signal Slope.

In the following, Electrical Connection Devices in the frame of Primary Sensor Processing will be described.

The PCME technology (it has to be noted that the term 'PCME' technology is used to refer to exemplary embodiments of the present invention) relies on passing through the shaft very high amounts of pulse-modulated electrical current at the location where the Primary Sensor should be produced. When the surface of the shaft is very clean and highly conductive a multi-point Cupper or Gold connection may be sufficient to achieve the desired sensor signal uniformity. Important is that the Impedance is identical of each connection point to the shaft surface. This can be best achieved when assuring the cable length (L) is identical before it joins the main current connection point (I).

Figure 36:
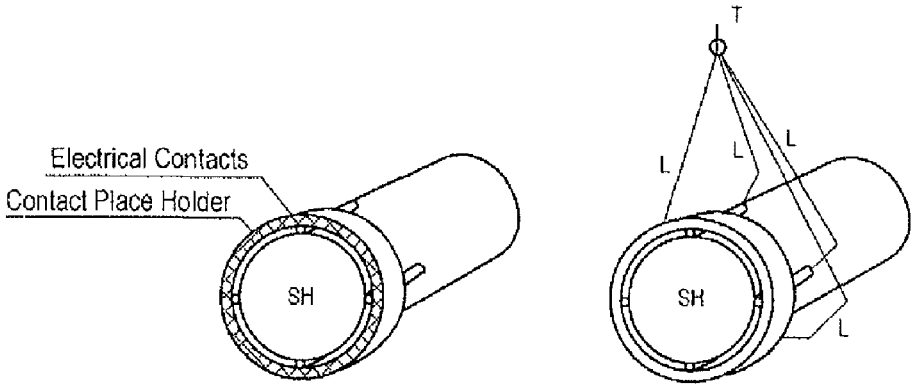
FIG. 36 shows an electrical multi-point connection to a sensor element according to an exemplary embodiment of the present invention.

Referring to FIG. 36, a simple electrical multi-point connection to the shaft surface is illustrated.

However, in most cases a reliable and repeatable multi-point electrical connection can be only achieved by ensuring that the impedance at each connection point is identical and constant. Using a spring pushed, sharpened connector will penetrate possible oxidation or isolation layers (maybe caused by finger prints) at the shaft surface.

Figure 37:
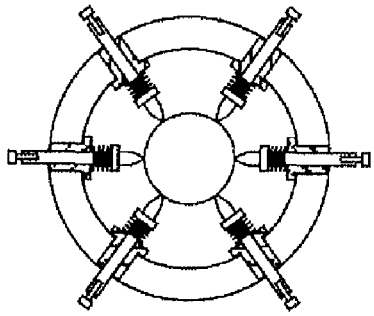
FIG. 37 shows a multi-channel electrical connection fixture with spring loaded contact points to apply a current pulse to the sensor element according to an exemplary embodiment of the present invention.

Referring to FIG. 37, a multi channel, electrical connecting fixture, with spring loaded contact points is illustrated.

When processing the shaft it is most important that the electrical current is injected and extracted from the shaft in the most uniform way possible. The above drawing shows several electrical, from each other insulated, connectors that are held by a fixture around the shaft. This device is called a Shaft-Processing-Holding-Clamp (or SPHC). The number of electrical connectors required in a SPHC depends on the shafts outer diameter. The larger the outer diameter, the more connectors are required. The spacing between the electrical conductors has to be identical from one connecting point to the next connecting point. This method is called Symmetrical-"Spot"-Contacts.

Figure 38:
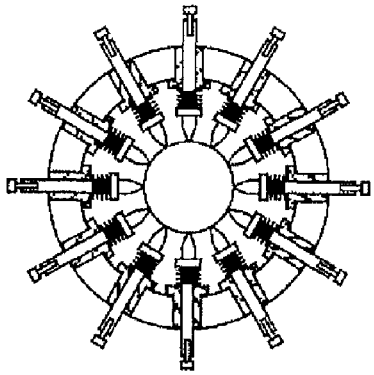
FIG. 38 shows an electrode system with an increased number of electrical connection points according to an exemplary embodiment of the present invention.

Referring to FIG. 38, it is illustrated that increasing the number of electrical connection points will assist the efforts of entering and exiting the Pulse-Modulated electrical current. It will also increase the complexity of the required electronic control system.

Figure 39:
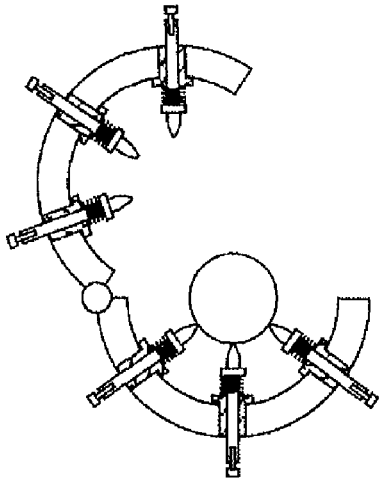
FIG. 39 shows an exemplary embodiment of the electrode system of FIG. 37.

Referring to FIG. 39, an example of how to open the SPHC for easy shaft loading is shown.

In the following, an encoding scheme in the frame of Primary Sensor Processing will be described.

The encoding of the primary shaft can be done by using permanent magnets applied at a rotating shaft or using electric currents passing through the desired section of the shaft. When using permanent magnets a very complex, sequential procedure is necessary to put the two layers of closed loop magnetic fields, on top of each other, in the shaft. When using the PCME procedure the electric current has to enter the shaft and exit the shaft in the most symmetrical way possible to achieve the desired performances.

Figure 40:
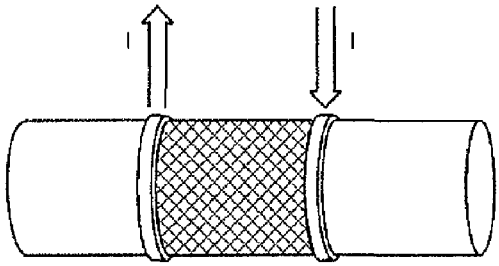
FIG. 40 shows shaft processing holding clamps used for a method according to an exemplary embodiment of the present invention.

Referring to FIG. 40, two SPHCs (Shaft Processing Holding Clamps) are placed at the borders of the planned sensing encoding region. Through one SPHC the pulsed electrical current (I) will enter the shaft, while at the second SPHC the pulsed electrical current (I) will exit the shaft. The region between the two SPHCs will then turn into the primary sensor.

This particular sensor process will produce a Single Field (SF) encoded region. One benefit of this design (in comparison to those that are described below) is that this design is insensitive to any axial shaft movements in relation to the location of the secondary sensor devices. The disadvantage of this design is that when using axial (or in-line) placed MFS coils the system will be sensitive to magnetic stray fields (like the earth magnetic field).

Figure 41:
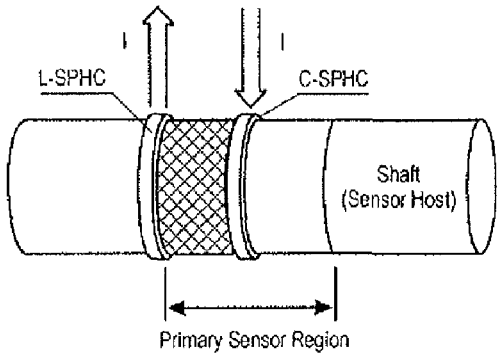
FIG. 41 shows a dual field encoding region of a sensor element according to the present invention.

Referring to FIG. 41, a Dual Field (DF) encoded region (meaning two independent functioning sensor regions with opposite polarity, side-by-side) allows cancelling the effects of uniform magnetic stray fields when using axial (or in-line) placed MFS coils. However, this primary sensor design also shortens the tolerable range of shaft movement in axial direction (in relation to the location of the MFS coils). There are two ways to produce a Dual Field (DF) encoded region with the PCME technology. The sequential process, where the magnetic encoded sections are produced one after each other, and the parallel process, where both magnetic encoded sections are produced at the same time.

The first process step of the sequential dual field design is to magnetically encode one sensor section (identically to the Single Field procedure), whereby the spacing between the two SPHC has to be halve of the desired final length of the Primary Sensor region. To simplify the explanations of this process we call the SPHC that is placed in the centre of the final Primary Sensor Region the Centre SPHC (C-SPHC), and the SPHC that is located at the left side of the Centre SPHC: L-SPHC.

Figure 42:
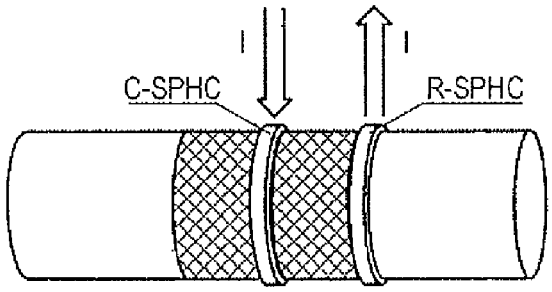
FIG. 42 shows a process step of a sequential dual field encoding according to an exemplary embodiment of the present invention.

Referring to FIG. 42, the second process step of the sequential Dual Field encoding will use the SPHC that is located in the centre of the Primary Sensor region (called C-SPHC) and a second SPHC that is placed at the other side (the right side) of the centre SPHC, called R-SPHC. Important is that the current flow direction in the centre SPHC (C-SPHC) is identical at both process steps.

Figure 43:
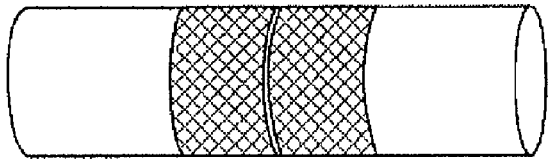
FIG. 43 shows another process step of the dual field encoding according to another exemplary embodiment of the present invention.

Referring to FIG. 43, the performance of the final Primary Sensor Region depends on how close the two encoded regions can be placed in relation to each other. And this is dependent on the design of the used centre SPHC. The narrower the in-line space contact dimensions are of the C-SPHC, the better are the performances of the Dual Field PCME sensor.

Figure 44:
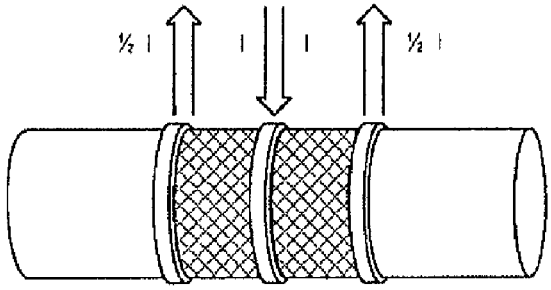
FIG. 44 shows another exemplary embodiment of a sensor element with an illustration of a current pulse application according to another exemplary embodiment of the present invention.

FIG. 44 shows the pulse application according to another exemplary embodiment of the present invention. As my be taken from the above drawing, the pulse is applied to three locations of the shaft. Due to the current distribution to both sides of the middle electrode where the current I is entered into the shaft, the current leaving the shaft at the lateral electrodes is only half the current entered at the middle electrode, namely ½ I. The electrodes are depicted as rings which dimensions are adapted to the dimensions of the outer surface of the shaft. However, it has to be noted that other electrodes may be used, such as the electrodes comprising a plurality of pin electrodes described later in this text.

Figure 45:
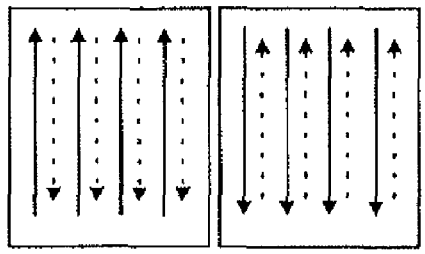
FIG. 45 shows schematic diagrams for describing magnetic flux directions in sensor elements according to the present invention when no stress is applied.

Referring to FIG. 45, magnetic flux directions of the two sensor sections of a Dual Field PCME sensor design are shown when no torque or linear motion stress is applied to the shaft. The counter flow magnetic flux loops do not interact with each other.

Figure 46:
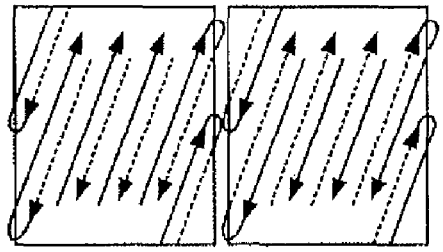
FIG. 46 shows magnetic flux directions of the sensor element of FIG. 45 when a force is applied.

Referring to FIG. 46, when torque forces or linear stress forces are applied in a particular direction then the magnetic flux loops begin to run with an increasing tilting angle inside the shaft. When the tilted magnetic flux reaches the PCME segment boundary then the flux line interacts with the counterflowing magnetic flux lines, as shown.

Figure 47:
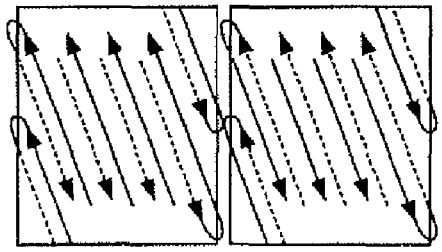
FIG. 47 shows the magnetic flux inside the PCM encoded shaft of FIG. 45 when the applied torque direction is changing.

Referring to FIG. 47, when the applied torque direction is changing (for example from clock-wise to counter-clockwise) so will change the tilting angle of the counterflow magnetic flux structures inside the PCM Encoded shaft.

In the following, a Multi Channel Current Driver for Shaft Processing will be described.

In cases where an absolute identical impedance of the current path to the shaft surface can not be guaranteed, then electric current controlled driver stages can be used to overcome this problem.

Figure 48:
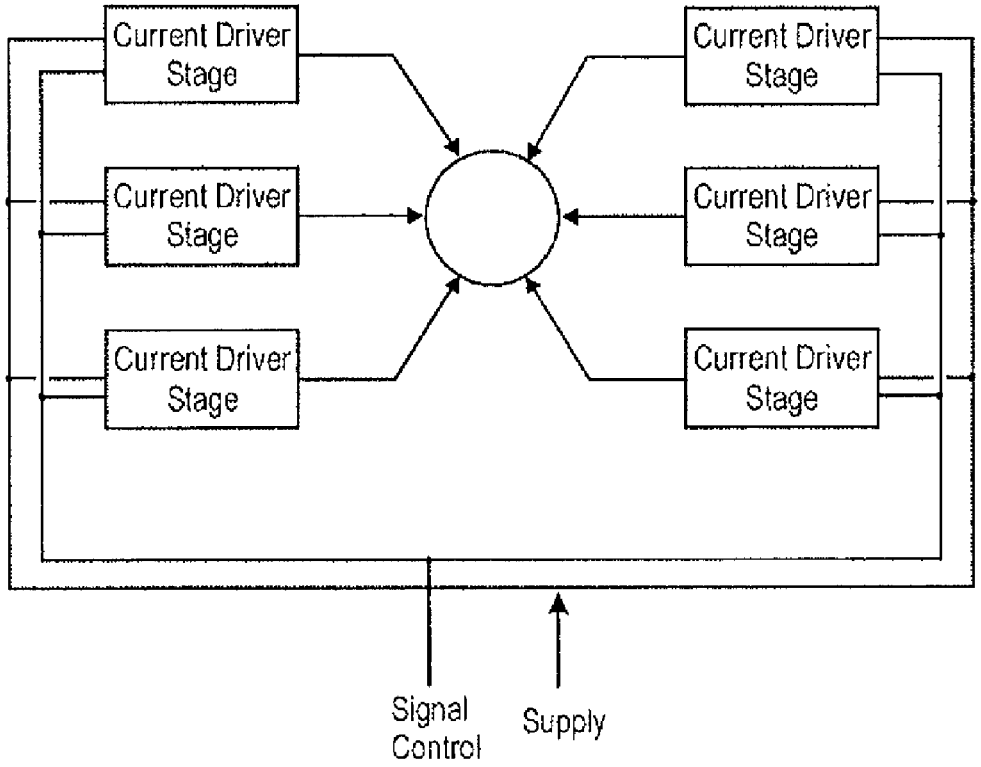
FIG. 48 shows a 6-channel synchronized pulse current driver system according to an exemplary embodiment of the present invention.

Referring to FIG. 48, a six-channel synchronized Pulse current driver system for small diameter Sensor Hosts (SH) is shown. As the shaft diameter increases so will the number of current driver channels.

In the following, Bras Ring Contacts and Symmetrical "Spot" Contacts will be described.

When the shaft diameter is relative small and the shaft surface is clean and free from any oxidations at the desired Sensing Region, then a simple "Bras"-ring (or Copper-ring) contact method can be chosen to process the Primary Sensor.

Figure 49:
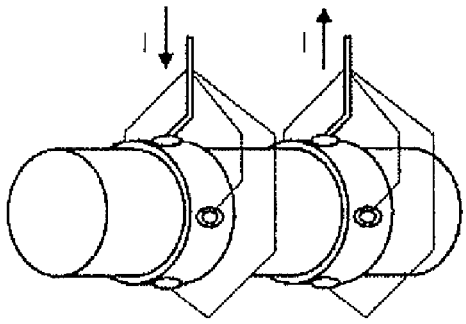
FIG. 49 shows a simplified representation of an electrode system according to another exemplary embodiment of the present invention.

Referring to FIG. 49, bras-rings (or Copper-rings) tightly fitted to the shaft surface may be used, with solder connections for the electrical wires. The area between the two Bras-rings (Copper-rings) is the encoded region.

However, it is very likely that the achievable RSU performances are much lower then when using the Symmetrical "Spot" Contact method.

In the following, a Hot-Spotting concept will be described.

A standard single field (SF) PCME sensor has very poor Hot-Spotting performances. The external magnetic flux profile of the SF PCME sensor segment (when torque is applied) is very sensitive to possible changes (in relation to Ferro magnetic material) in the nearby environment. As the magnetic boundaries of the SF encoded sensor segment are not well defined (not "Pinned Down") they can "extend" towards the direction where Ferro magnet material is placed near the PCME sensing region.

Figure 50:
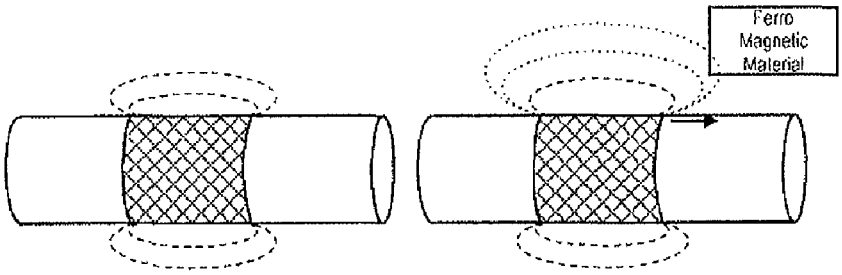
FIG. 50 is a representation of a sensor element according to an exemplary embodiment of the present invention.

Referring to FIG. 50, a PCME process magnetized sensing region is very sensitive to Ferro magnetic materials that may come close to the boundaries of the sensing regions.

To reduce the Hot-Spotting sensor sensitivity the PCME sensor segment boundaries have to be better defined by pinning them down (they can no longer move).

Figure 51:
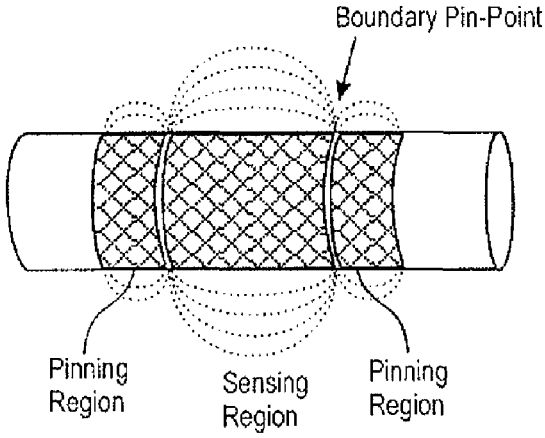
FIG. 51 is another exemplary embodiment of a sensor element according to the present invention having a PCME process sensing region with two pinning field regions.

Referring to FIG. 51, a PCME processed Sensing region with two "Pinning Field Regions" is shown, one on each side of the Sensing Region.

By placing Pinning Regions closely on either side the Sensing Region, the Sensing Region Boundary has been pinned down to a very specific location. When Ferro magnetic material is coming close to the Sensing Region, it may have an effect on the outer boundaries of the Pinning Regions, but it will have very limited effects on the Sensing Region Boundaries.

There are a number of different ways, according to exemplary embodiments of the present invention how the SH (Sensor Host) can be processed to get a Single Field (SF) Sensing Region and two Pinning Regions, one on each side of the Sensing Region. Either each region is processed after each other (Sequential Processing) or two or three regions are processed simultaneously (Parallel Processing). The Parallel Processing provides a more uniform sensor (reduced parasitic fields) but requires much higher levels of electrical current to get to the targeted sensor signal slope.

Figure 52:
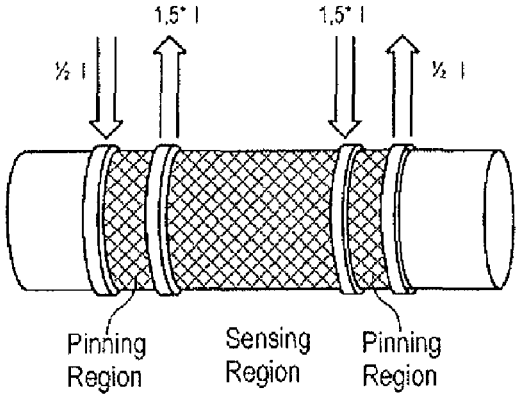
FIG. 52 is a schematic representation for explaining a manufacturing method according to an exemplary embodiment of the present invention for manufacturing a sensor element with an encoded region and pinning regions.

Referring to FIG. 52, a parallel processing example for a Single Field (SF) PCME sensor with Pinning Regions on either side of the main sensing region is illustrated, in order to reduce (or even eliminate) Hot-Spotting.

A Dual Field PCME Sensor is less sensitive to the effects of Hot-Spotting as the sensor centre region is already Pinned-Down. However, the remaining Hot-Spotting sensitivity can be further reduced by placing Pinning Regions on either side of the Dual-Field Sensor Region.

Figure 53:
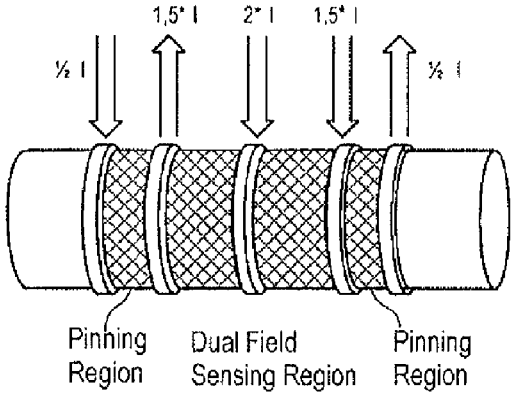
FIG. 53 is another schematic representation of a sensor element according to an exemplary embodiment of the present invention manufactured in accordance with a manufacturing method according to an exemplary embodiment of the present invention.

Referring to FIG. 53, a Dual Field (DF) PCME sensor with Pinning Regions either side is shown.

When Pinning Regions are not allowed or possible (example: limited axial spacing available) then the Sensing Region has to be magnetically shielded from the influences of external Ferro Magnetic Materials.

In the following, the Rotational Signal Uniformity (RSU) will be explained.

The RSU sensor performance are, according to current understanding, mainly depending on how circumferentially uniform the electrical current entered and exited the SH surface, and the physical space between the electrical current entry and exit points. The larger the spacing between the current entry and exit points, the better is the RSU performance.

Figure 54:
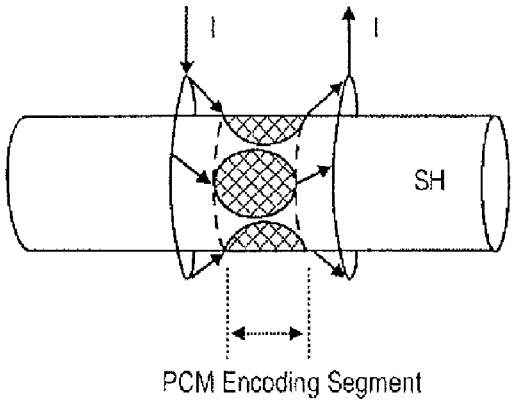
FIG. 54 is a simplified schematic representation for further explaining an exemplary embodiment of the present invention.

Referring to FIG. 54, when the spacings between the individual circumferential placed current entry points are relatively large in relation to the shaft diameter (and equally large are the spacings between the circumferentially placed current exit points) then this will result in very poor RSU performances. In such a case the length of the PCM Encoding Segment has to be as large as possible as otherwise the created magnetic field will be circumferentially non-uniform.

Figure 55:
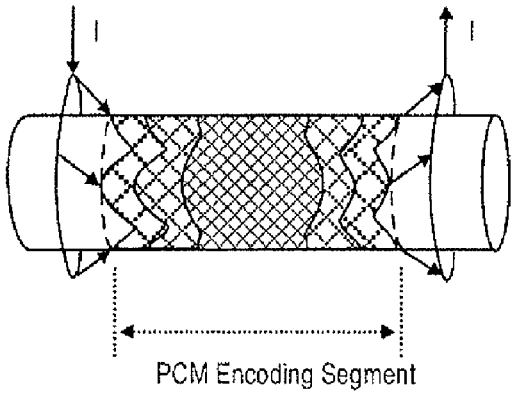
FIG. 55 is another simplified schematic representation for further explaining an exemplary embodiment of the present invention.

Referring to FIG. 55, by widening the PCM Encoding Segment the circumferentially magnetic field distribution will become more uniform (and eventually almost perfect) at the halve distance between the current entry and current exit points. Therefore the RSU performance of the PCME sensor is best at the halve way-point between of the current-entry/current-exit points.

Next, the basic design issues of a NCT sensor system will be described.

Without going into the specific details of the PCM-Encoding technology, the end-user of this sensing technology need to now some design details that will allow him to apply and to use this sensing concept in his application. The following pages describe the basic elements of a magnetostriction based NCT sensor (like the primary sensor, secondary sensor, and the SCSP electronics), what the individual components look like, and what choices need to be made when integrating this technology into an already existing product.

In principle the PCME sensing technology can be used to produce a stand-alone sensor product. However, in already existing industrial applications there is little to none space available for a "stand-alone" product. The PCME technology can be applied in an existing product without the need of redesigning the final product.

In case a stand-alone torque sensor device or position detecting sensor device will be applied to a motor-transmission system it may require that the entire system need to undergo a major design change.

In the following, referring to FIG. 56, a possible location of a PCME sensor at the shaft of an engine is illustrated.

Figure 56:
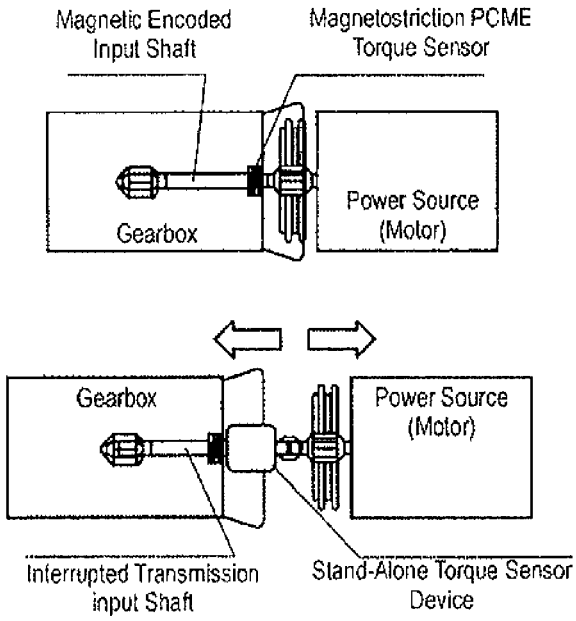
FIG. 56 shows an application of a torque sensor according to an exemplary embodiment of the present invention in a gear box of a motor.

FIG. 56 shows possible arrangement locations for the torque sensor according to an exemplary embodiment of the present invention, for example, in a gear box of a motorcar. The upper portion of FIG. 56 shows the arrangement of the PCME torque sensor according to an exemplary embodiment of the present invention. The lower portion of the FIG. 56 shows the arrangement of a stand alone sensor device which is not integrated in the input shaft of the gear box as is in the exemplary embodiment of the present invention.

As may be taken from the upper portion of FIG. 56, the torque sensor according to an exemplary embodiment of the present invention may be integrated into the input shaft of the gear box. In other words, the primary sensor may be a portion of the input shaft. In other words, the input shaft may be magnetically encoded such that it becomes the primary sensor or sensor element itself. The secondary sensors, i.e. the coils, may, for example, be accommodated in a bearing portion close to the encoded region of the input shaft. Due to this, for providing the torque sensor between the power source and the gear box, it is not necessary to interrupt the input shaft and to provide a separate torque sensor in between a shaft going to the motor and another shaft going to the gear box as shown in the lower portion of FIG. 56.

Due to the integration of the encoded region in the input shaft it is possible to provide for a torque sensor without making any alterations to the input shaft, for example, for a car. This becomes very important, for example, in parts for an aircraft where each part has to undergo extensive tests before being allowed for use in the aircraft. Such torque sensor according to the present invention may be perhaps even without such extensive testing being corporated in shafts in aircraft or turbine since, the immediate shaft is not altered. Also, no material effects are caused to the material of the shaft.

Furthermore, as may be taken from FIG. 56, the torque sensor according to an exemplary embodiment of the present invention may allow to reduce a distance between a gear box and a power source since the provision of a separate stand alone torque sensor between the shaft exiting the power source and the input shaft to the gear box becomes obvious.

Next, Sensor Components will be explained.

Figure 57:
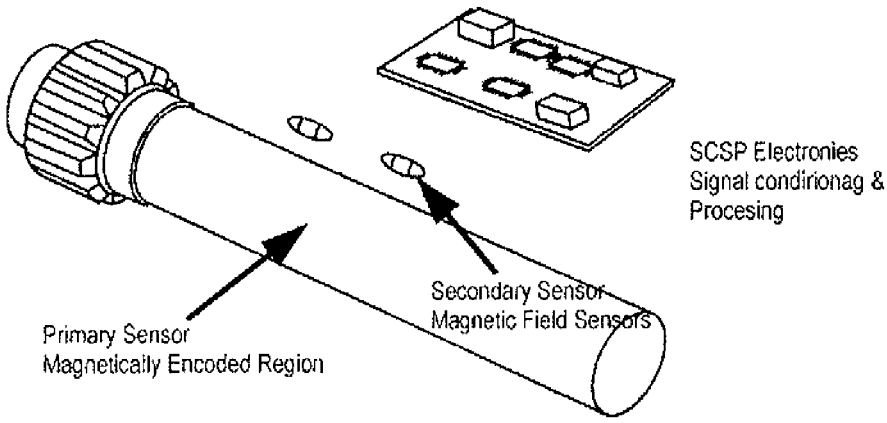
FIG. 57 shows a torque sensor according to an exemplary embodiment of the present invention.

A non-contact magnetostriction sensor (NCT-Sensor), as shown in FIG. 57, may consist, according to an exemplary embodiment of the present invention, of three main functional elements: The Primary Sensor, the Secondary Sensor, and the Signal Conditioning & Signal Processing (SCSP) electronics.

Depending on the application type (volume and quality demands, targeted manufacturing cost, manufacturing process flow) the customer can chose to purchase either the individual components to build the sensor system under his own management, or can subcontract the production of the individual modules.

Figure 58:
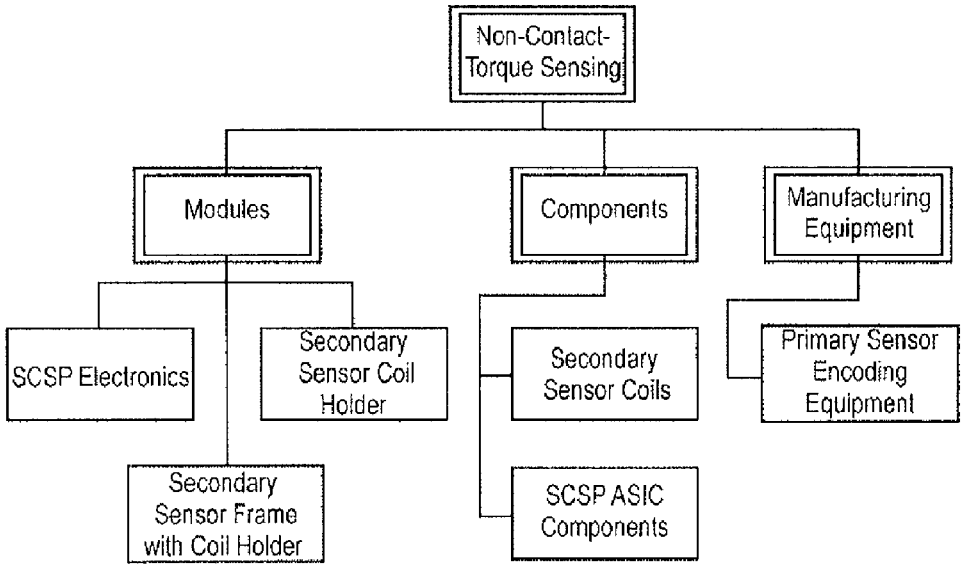
FIG. 58 shows a schematic illustration of components of a non-contact torque sensing device according to an exemplary embodiment of the present invention.

FIG. 58 shows a schematic illustration of components of a non-contact torque sensing device. However, these components can also be implemented in a non-contact position sensing device.

In cases where the annual production target is in the thousands of units it may be more efficient to integrate the "primary-sensor magnetic-encoding-process" into the customers manufacturing process. In such a case the customer needs to purchase application specific "magnetic encoding equipment".

In high volume applications, where cost and the integrity of the manufacturing process are critical, it is typical that NCTE supplies only the individual basic components and equipment necessary to build a non-contact sensor:

- ICs (surface mount packaged, Application-Specific Electronic Circuits)
- MFS-Coils (as part of the Secondary Sensor)
- Sensor Host Encoding Equipment (to apply the magnetic encoding on the shaft=Primary Sensor)

Depending on the required volume, the MFS-Coils can be supplied already assembled on a frame, and if desired, electrically attached to a wire harness with connector. Equally the SCSP (Signal Conditioning & Signal Processing) electronics can be supplied fully functional in PCB format, with or without the MFS-Coils embedded in the PCB.

Figure 59:
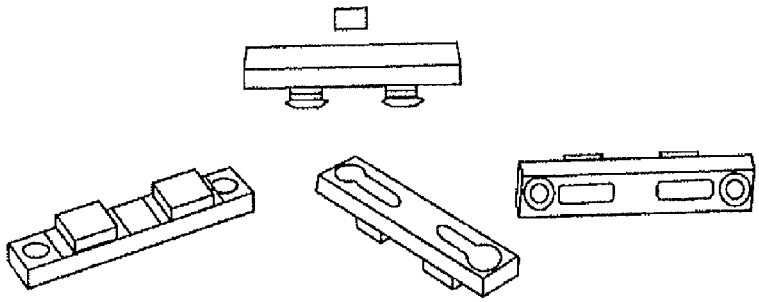
FIG. 59 shows components of a sensing device according to an exemplary embodiment of the present invention.

FIG. 59 shows components of a sensing device.

Figure 60:
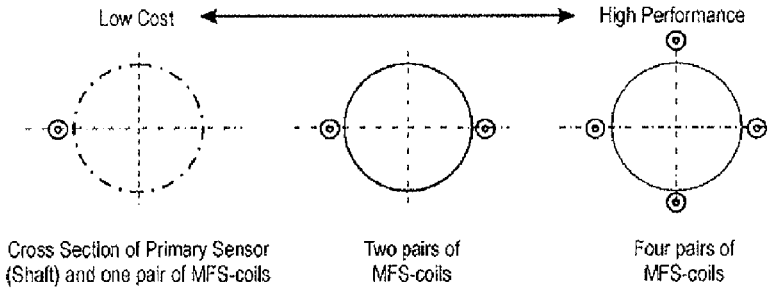
FIG. 60 shows arrangements of coils with a sensor element according to an exemplary embodiment of the present invention.

As can be seen from FIG. 60, the number of required MFS-coils is dependent on the expected sensor performance and the mechanical tolerances of the physical sensor design. In a well designed sensor system with perfect Sensor Host (SH or magnetically encoded shaft) and minimal interferences from unwanted magnetic stray fields, only 2 MFS-coils are needed. However, if the SH is moving radial or axial in relation to the secondary sensor position by more than a few tenths of a millimeter, then the number of MFS-coils need to be increased to achieve the desired sensor performance.

In the following, a control and/or evaluation circuitry will be explained.

The SCSP electronics, according to an exemplary embodiment of the present invention, consist of the NCTE specific ICs, a number of external passive and active electronic circuits, the printed circuit board (PCB), and the SCSP housing or casing. Depending on the environment where the SCSP unit will be used the casing has to be sealed appropriately.

Figure 61:
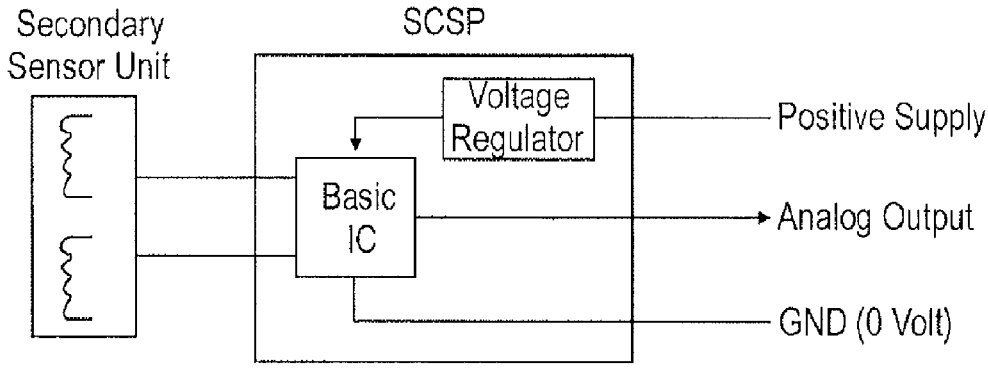
FIG. 61 shows a single channel sensor electronics according to an exemplary embodiment of the present invention.

Depending on the application specific requirements NCTE (according to an exemplary embodiment of the present invention) offers a number of different application specific circuits:

- Basic Circuit
- Basic Circuit with integrated Voltage Regulator
- High Signal Bandwidth Circuit
- Optional High Voltage and Short Circuit Protection Device
- Optional Fault Detection Circuit FIG. 61 shows a single channel, low cost sensor electronics solution.

As may be taken from FIG. 61, there may be provided a secondary sensor unit which comprises, for example, coils. These coils are arranged as, for example, shown in FIG. 60 for sensing variations in a magnetic field emitted from the primary sensor unit, i.e. the sensor shaft or sensor element when torque is applied thereto. The secondary sensor unit is connected to a basis IC in a SCST. The basic IC is connected via a voltage regulator to a positive supply voltage. The basic IC is also connected to ground. The basic IC is adapted to provide an analog output to the outside of the SCST which output corresponds to the variation of the magnetic field caused by the stress applied to the sensor element.

Figure 62:
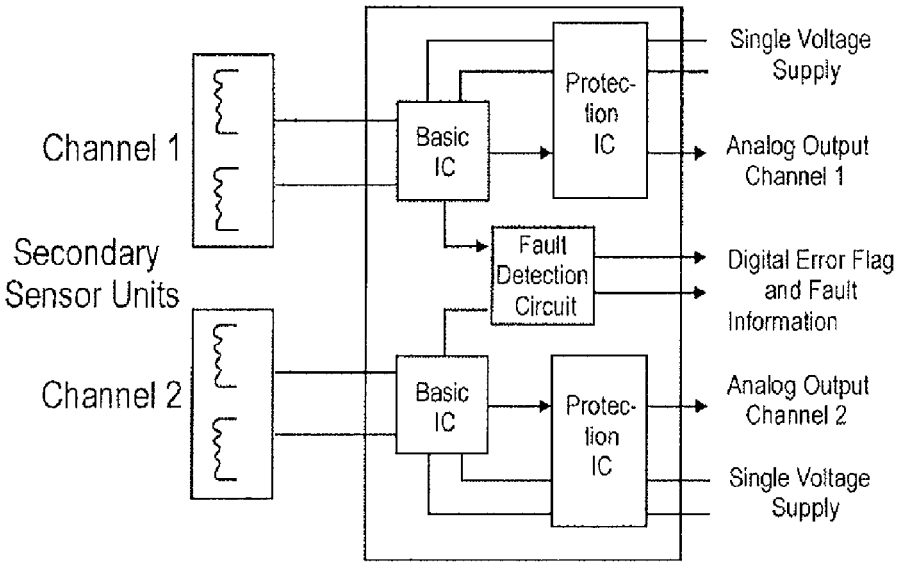
FIG. 62 shows a dual channel, short circuit protected system according to an exemplary embodiment of the present invention.

FIG. 62 shows a dual channel, short circuit protected system design with integrated fault detection. This design consists of 5 ASIC devices and provides a high degree of system safety. The Fault-Detection IC identifies when there is a wire breakage anywhere in the sensor system, a fault with the MFS coils, or a fault in the electronic driver stages of the "Basic IC".

Next, the Secondary Sensor Unit will be explained.

Figure 63:
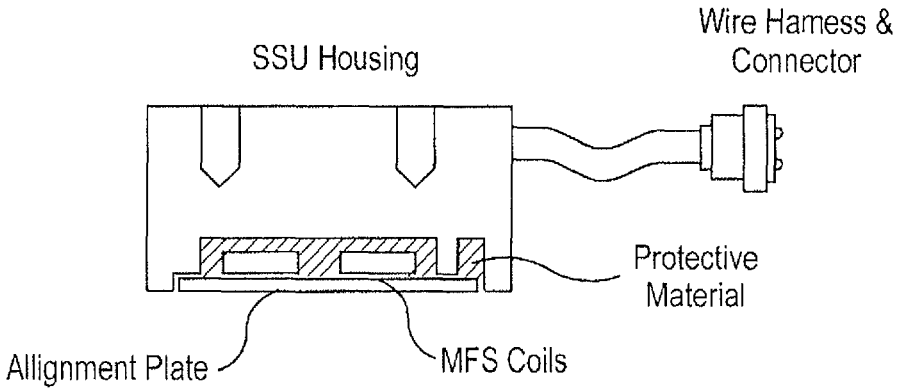
FIG. 63 shows a sensor according to another exemplary embodiment of the present invention.

The Secondary Sensor may, according to one embodiment shown in FIG. 63, consist of the elements: One to eight MFS (Magnetic Field Sensor) Coils, the Alignment-& Connection-Plate, the wire harness with connector, and the Secondary-Sensor-Housing.

The MFS-coils may be mounted onto the Alignment-Plate. Usually the Alignment-Plate allows that the two connection wires of each MFS-Coil are soldered/connected in the appropriate way. The wire harness is connected to the alignment plate. This, completely assembled with the MFS-Coils and wire harness, is then embedded or held by the Secondary-Sensor-Housing.

The main element of the MFS-Coil is the core wire, which has to be made out of an amorphous-like material.

Depending on the environment where the Secondary-Sensor-Unit will be used, the assembled Alignment Plate has to be covered by protective material. This material can not cause mechanical stress or pressure on the MFS-coils when the ambient temperature is changing.

In applications where the operating temperature will not exceed +110 deg C. the customer has the option to place the SCSP electronics (ASIC) inside the secondary sensor unit (SSU). While the ASIC devices can operated at temperatures above +125 deg C. it will become increasingly more difficult to compensate the temperature related signal-offset and signal-gain changes.

The recommended maximal cable length between the MFS-coils and the SCSP electronics is 2 meters. When using the appropriate connecting cable, distances of up to 10 meters are achievable. To avoid signal-cross-talk in multi-channel applications (two independent SSUs operating at the same Primary Sensor location=Redundant Sensor Function), specially shielded cable between the SSUs and the SCSP Electronics should be considered.

When planning to produce the Secondary-Sensor-Unit (SSU) the producer has to decide which part/parts of the SSU have to be purchased through subcontracting and which manufacturing steps will be made in-house.

In the following, Secondary Sensor Unit Manufacturing Options will be described. When integrating the NCT-Sensor into a customized tool or standard transmission system then the systems manufacturer has several options to choose from:

- custom made SSU (including the wire harness and connector)
- selected modules or components; the final SSU assembly and system test may be done under the customer's management.
- only the essential components (MFS-coils or MFS-core-wire, Application specific ICs) and will produce the SSU in-house.

Figure 64:
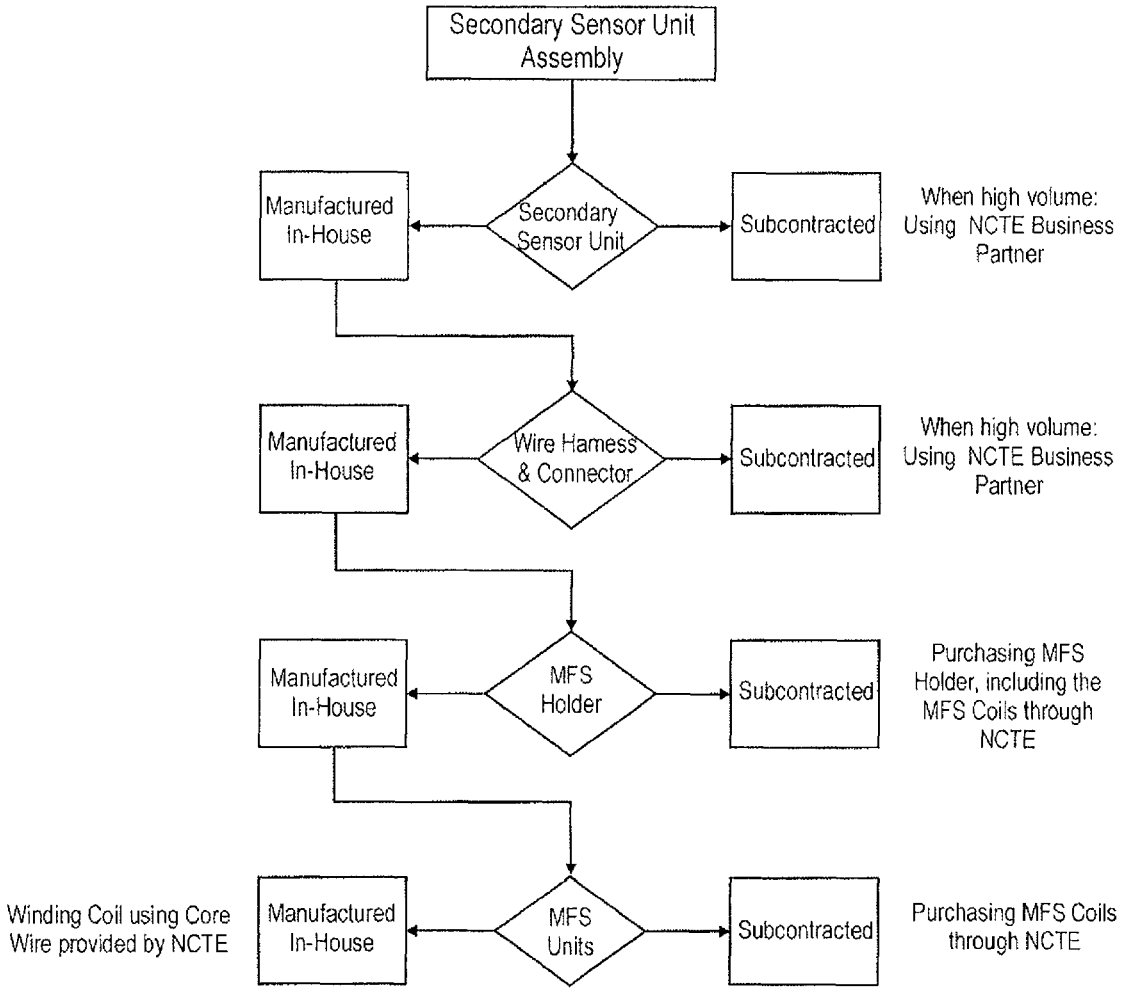
FIG. 64 illustrates an exemplary embodiment of a secondary sensor unit assembly according to an exemplary embodiment of the present invention.

FIG. 64 illustrates an exemplary embodiment of a Secondary Sensor Unit Assembly.

Next, a Primary Sensor Design is explained.

The SSU (Secondary Sensor Units) can be placed outside the magnetically encoded SH (Sensor Host) or, in case the SH is hollow, inside the SH. The achievable sensor signal amplitude is of equal strength but has a much better signal-to-noise performance when placed inside the hollow shaft.

Figure 65:
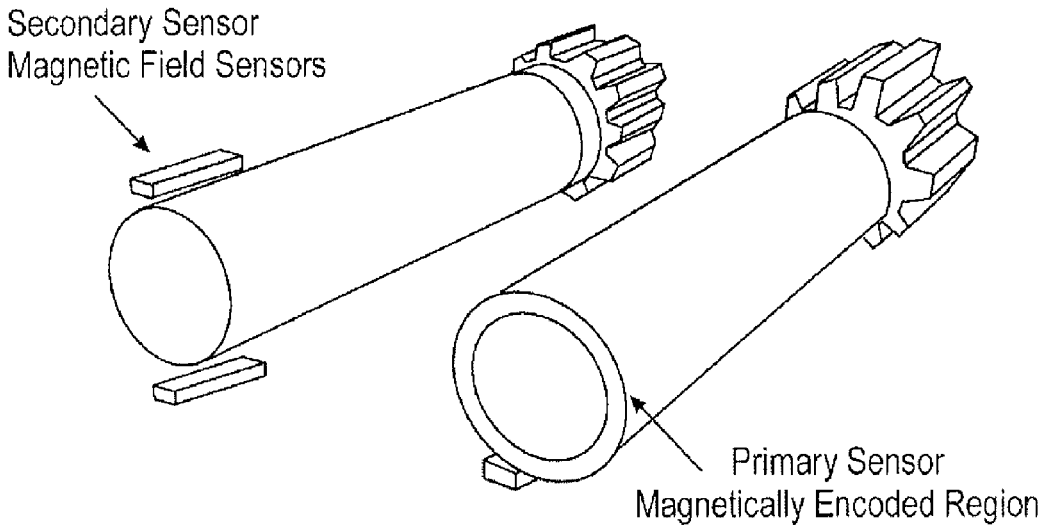
FIG. 65 illustrates two configurations of a geometrical arrangement of primary sensor and secondary sensor according to an exemplary embodiment of the present invention.

FIG. 65 illustrates two configurations of the geometrical arrangement of Primary Sensor and Secondary Sensor.

Improved sensor performances may be achieved when the magnetic encoding process is applied to a straight and parallel section of the SH (shaft). For a shaft with 15 mm to 25 mm diameter the optimal minimum length of the Magnetically Encoded Region is 25 mm. The sensor performances will further improve if the region can be made as long as 45 mm (adding Guard Regions). In complex and highly integrated transmission (gearbox) systems it will be difficult to find such space. Under more ideal circumstances, the Magnetically Encoding Region can be as short as 14 mm, but this bears the risk that not all of the desired sensor performances can be achieved.

Figure 66:
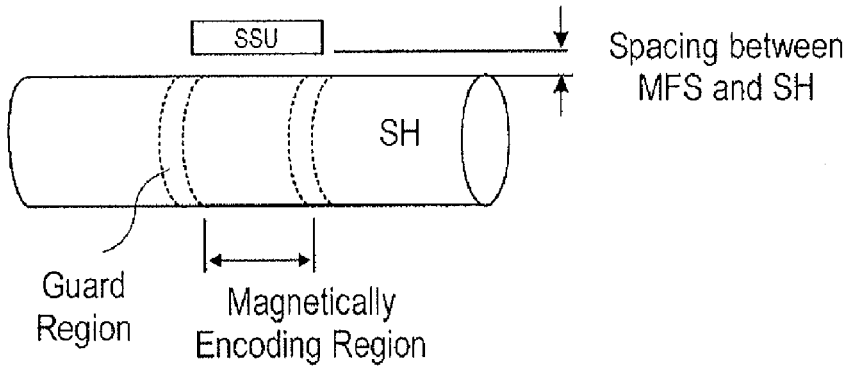
FIG. 66 is a schematic representation for explaining that a spacing between the secondary sensor unit and the sensor host is for example as small as possible.

As illustrated in FIG. 66, the spacing between the SSU (Secondary Sensor Unit) and the Sensor Host surface, according to an exemplary embodiment of the present invention, should be held as small as possible to achieve the best possible signal quality.

Next, the Primary Sensor Encoding Equipment will be described.

Figure 67:
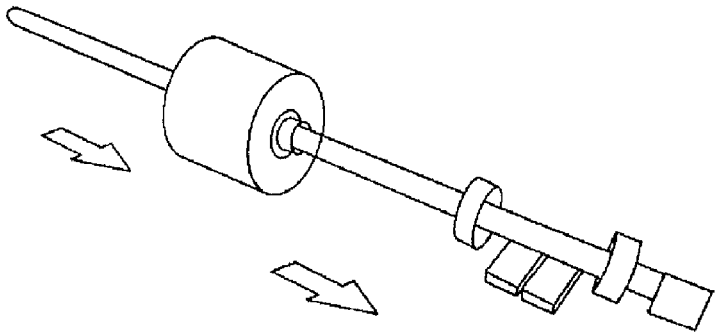
FIG. 67 is an embodiment showing a primary sensor encoding equipment.

An example is shown in FIG. 67.

Depending on which magnetostriction sensing technology will be chosen, the Sensor Host (SH) needs to be processed and treated accordingly. The technologies vary by a great deal from each other (ABB, FAST, FT, Kubota, MDI, NCTE, RM, Siemens, . . . ) and so does the processing equipment required. Some of the available magnetostriction sensing technologies do not need any physical changes to be made on the SH and rely only on magnetic processing (MDI, FAST, NCTE).

While the MDI technology is a two phase process, the FAST technology is a three phase process, and the NCTE technology a one phase process, called PCM Encoding.

One should be aware that after the magnetic processing, the Sensor Host (SH or Shaft), has become a "precision measurement" device and has to be treated accordingly. The magnetic processing should be the very last step before the treated SH is carefully placed in its final location.

The magnetic processing should be an integral part of the customer's production process (in-house magnetic processing) under the following circumstances:

- High production quantities (like in the thousands)
- Heavy or difficult to handle SH (e.g. high shipping costs)
- Very specific quality and inspection demands (e.g. defense applications)

In all other cases it may be more cost effective to get the SH magnetically treated by a qualified and authorized subcontractor, such as NCTE. For the "in-house" magnetic processing dedicated manufacturing equipment is required. Such equipment can be operated fully manually, semi-automated, and fully automated. Depending on the complexity and automation level the equipment can cost anywhere from EUR 20 k to above EUR 500 k.

In the following, referring to FIG. 68 to FIG. 74, a method for adjusting a magnetization of a magnetizable object according to the invention will be described.

Figure 68:
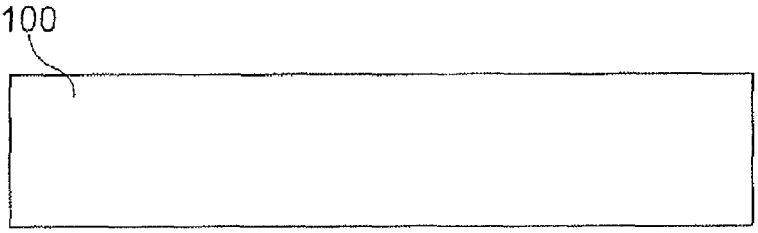
FIG. 68 to FIG. 74 show different views of a magnetizable shaft during a method for adjusting the magnetization of the shaft according to an embodiment of the invention.

FIG. 68 shows a cylindrical shaft 100 which is made of magnetizable industrial steel.

However, according to the scenario shown in FIG. 68, the steel shaft 100 is demagnetized.

Figure 69:
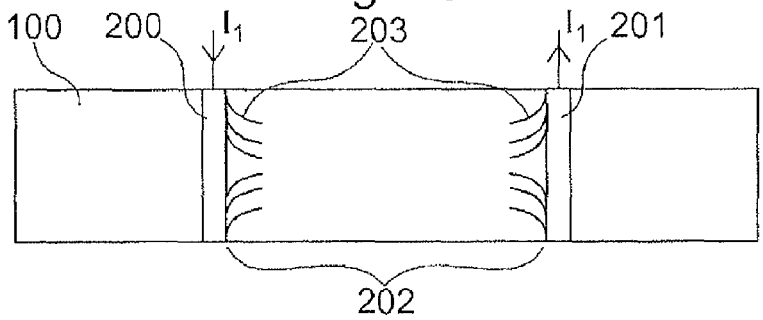

FIG. 69 shows a configuration in which the magnetizable shaft 100 is partially magnetized, by the so-called PCME technology. For this purpose, a first metallic ring 200 is applied directly to the magnetizable shaft 100, and a second metallic ring 201 is attached to another part of the shaft 100. Then, a pulse electric current $I_1$ is applied to the rings 200, 201 to magnetize a portion 202 of the shaft 100. The magnetized portion 202 of the shaft 100 is formed by applying two current pulses to the shaft 100, each of the current pulses having a fast railing edge and a slow falling edge, such that in a direction essentially perpendicular to a surface of the shaft 100, a magnetic field structure is generated such that there is a first magnetic flow in a first direction and a second magnetic flow in a second direction, wherein the first direction is opposite to the second direction. In a time versus current diagram, each of the at least two current pulses has a fast raising edge which is essentially vertical and has a slow falling edge.

FIG. 69 also shows schematic current paths 203 which are strongly curved in a vicinity of the rings 200, 201. Thus, the magnetization is not very homogeneous in a portion directly neighbouring the rings 200, 201.

Figure 70:
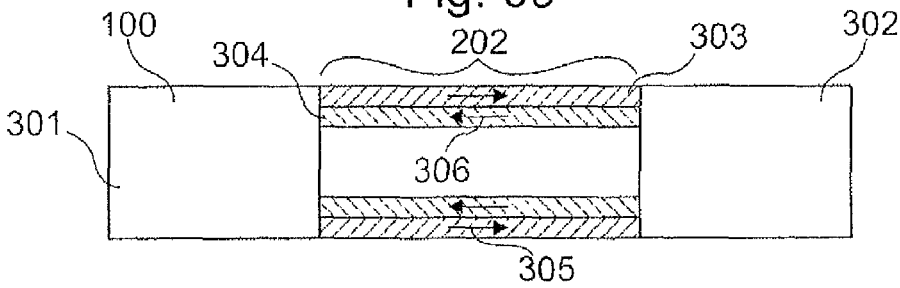

FIG. 70 shows schematically a cross-section of the shaft 100, wherein, in a portion in which beforehand the (now removed) rings 200, 201 had been attached, a magnetized region 202 is generated. The shaft 100 has a first unmagnetized portion 301 and has a second unmagnetized portion 302, the magnetized portion 202 being arranged between the first unmagnetized portion 301 and the second unmagnetized portion 302. As can be seen in FIG. 70, the magnetized portion 202 is formed by a first magnetic flow region 303 oriented in a first direction 305 and by a second magnetic region 304 oriented in a second direction 306, wherein the first direction 305 is opposite to the second direction 306. As can further be seen in FIG. 70, in a cross-sectional view of the shaft 100, the first circular magnetic flow 303 has the first direction 305 and a first radius, and the second circular magnetic flow 304 has the second direction 306 and a second radius, wherein the first radius is larger than the second radius.

However, when using the magnetized portion 202 as a magnetically encoded region for a torque sensor or a position sensor, only the central part of the magnetized region 202 can be used with for a high quality application, since only here the magnetization is homogeneous, whereas the magnetization is quite inhomogeneous at a border between one of the demagnetized regions 301, 302 and the magnetized region 202, i.e. a portion at which previously the rings 200, 201 had been attached.

Figure 71:
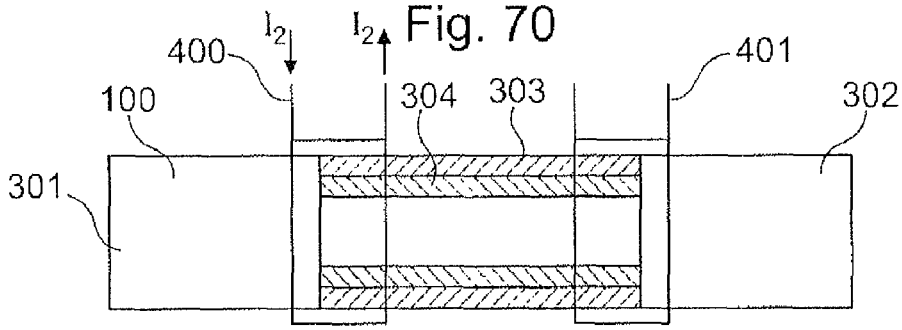

As can be seen in FIG. 71, the magnetization of the partially magnetized shaft 100 is adjusted by arranging a first degaussing coil 400 (coil axis parallel to shaft axis) adjacent the magnetic portion 202, i.e. at the border between the first unmagnetized portion 301 and the magnetized portion 202. Further, a second degaussing coil 401 (coil axis parallel to shaft axis) is arranged at a border between the magnetized region 202 and the second unmagnetized region 302.

As can be further seen in FIG. 71, the part of the magnetized portion 202 being covered by the first degaussing coil 400 is degaussed and thus demagnetized by activating the first degaussing coil 400 to adjust the magnetization of the magnetizable shaft 100 by forming a demagnetized portion 500 of the shaft 100 directly adjacent to a remaining magnetized portion 501 of the shaft 100. Further referring to FIG. 71, this is achieved by applying an alternating current $I_2$ to the first degaussing coil 400 with a frequency of 1 Hz. Thus, the elementary magnets within the demagnetized portion 500 are almost randomized to eliminate any magnetization in this region. At the border between the demagnetized portion 500 and the remaining magnetized portion 501 of the shaft 100, the magnetization profile can be described by a step function, since the part of the shaft 100 to be demagnetized is clearly defined.

Figure 72:
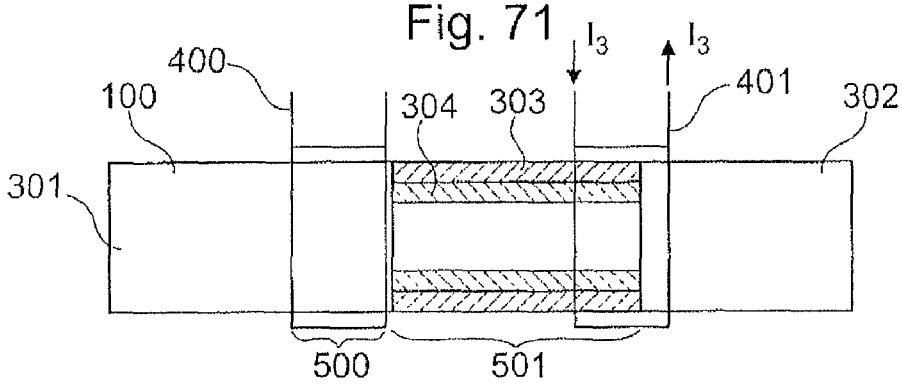

Referring to FIG. 72, the demagnetization procedure is repeated with the portion to be demagnetized between the magnetized region 200 and the second unmagnetized region 302. For this purpose, an alternating current $I_3$ is applied to the second degaussing coil 401 to generate a second demagnetized portion 600, to define a remaining magnetized portion 601 which is spatially clearly defined.

Figure 73:
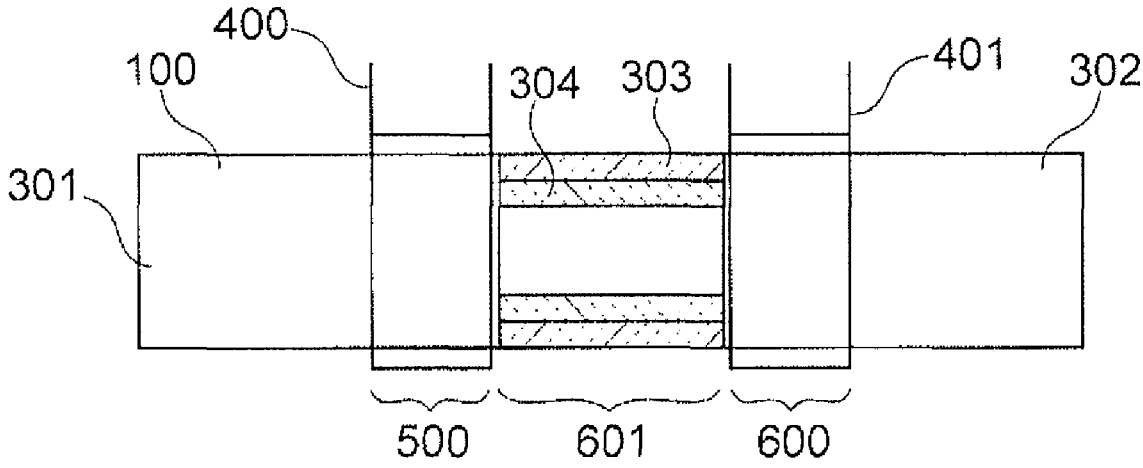

FIG. 73 shows a configuration after having deactivated the current flows.

Figure 74:
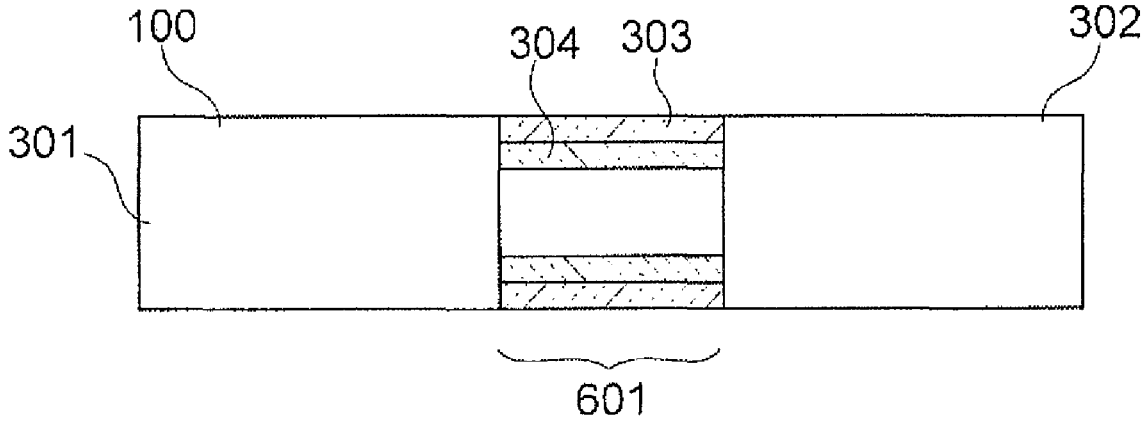

After removing the degaussing coils 400, 401, the configuration of FIG. 74 is obtained showing a remaining magnetized region 601 in the center of the shaft 100, having two circumferential magnetized portions 303, 304 with oppositely oriented magnetizing directions.

In the following, referring to FIG. 75, an array 800 for adjusting a magnetization of a shaft 100 according to a first embodiment of the invention will be described.

The array 800 for adjusting a magnetization of a magnetizable shaft 100 comprises the shaft 100 having a magnetized portion (not shown) extending along a part of the shaft 100. In the scenario of FIG. 75, the magnetized portion extends along the part of the shaft 100 extending between a first degaussing coil 801 and a second degaussing coil 802. The part of the shaft 100 being magnetized has previously been magnetized according to the PCME technology. A part of the magnetized portion is covered by the coils 801, 802 and will be demagnetized, as described in the following.

The first degaussing coil 801 is arranged adjacent to the magnetized portion, and the second degaussing coil 802 is arranged adjacent to the magnetized portion. Thus, the shaft 100 has a first unmagnetized portion and a second unmagnetized portion, the magnetized portion being arranged between the first unmagnetized portion and the second unmagnetized portion. The first degaussing coil 801 is arranged surrounding a portion of the magnetized portion adjacent the first unmagnetized portion, and the second degaussing coil 802 is arranged surrounding a portion of the magnetized portion adjacent the second unmagnetized portion. The first degaussing coil 801 has a first connection 803 and a second connection 804, and the second degaussing coil 802 has a first connection 805 and has a second connection 806. A voltage can be applied between the first connection 803 of the first degaussing coil 801 and the second connection 806 of the second degaussing 802. The second connection 804 of the first degaussing 801 is coupled with the first connection 805 of the second degaussing coil 802.

In the following, the method of demagnetizing a portion of the magnetized portion of the shaft 100 will be described.

Applying a PCME electrical encoding pulse to the shaft 100 turned a large part of the shaft 100 into a sensing element. While this has the benefit that the sensor performance is a highest (at the center of the shaft 100), it has the disadvantage that the shaft 100 being largely magnetized is very "hot spotting" sensitive, i.e. sensitive to a nearby ferromagnetic material.

This means that a large part of the shaft 100, almost from end to end, is sensitive to applied mechanical forces. Equally, the resulting magnetic field changes at the shaft 100 surface, stretch over the entire shaft 100 length. Such a dimensionally large magnetic field can be easily attracted or influenced in shaped by other ferromagnetic devices that are placed (or moved) near the magnetically encoded shaft 100.

Therefore, the magnetic encoded region should in axial direction kept reasonably short. Even better it will be to place pinning fields in either side of the magnetically encoded region. In the example shown in FIG. 75, a large part of the shaft 100 has been magnetically encoded, and subsequently, the magnetic encoding will be deleted on either side of the desired location of the remaining magnetized portion of the torque sensor shaft 100.

Figure 75:
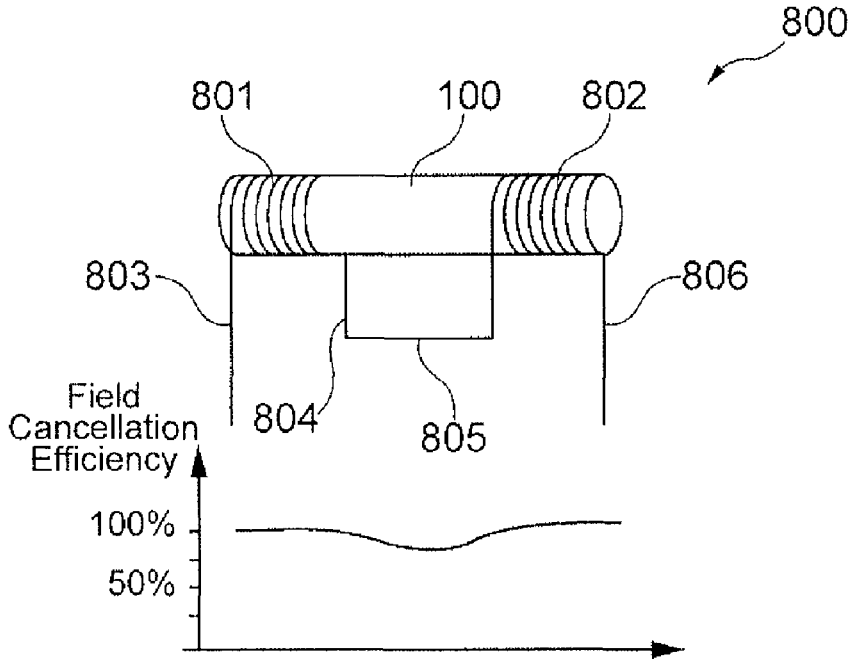
FIG. 75 shows an array for adjusting a magnetization of a shaft according to a first embodiment of the invention.

According to embodiment shown in FIG. 75, this is achieved by sliding the shaft ends into a radially tightly wound coil (inductor) 801, and 802, respectively. By applying an alternating electrical current through the inductors 801, 802, the magnetic sensor encoding will be reduced in strength, or even entirely erased. As can be seen, the field cancellation efficiency is almost 100% in the region of the shaft 100 which is surrounded by the degaussing coils 801, 802, and is smaller in the center of the shaft 100.

However, as seen in FIG. 75, applying the alternating current to both coils 801, 802 at the same time will to a larger degree have an effect also on the sensor region that lies between the two erasing coils 801, 802. With other words, this approach will not only delete the magnetic encoding at the shaft ends, but also partially in the middle section of the shaft 100.

Thus, when driving the magnetic field cancellation inductors 801, 802 simultaneously, the magnetic field cancellation efficiency is stretching beyond the location where the magnetic field cancellation inductors 801, 802 end. Consequently, the section between the degaussing coils 801, 802 will also be affected. This means that the magnetic encoding that may have been present in the section between the degaussing coils 801, 802 will be, to some extent, erased as well.

In the following, referring to FIG. 76, an array 900 for adjusting a magnetization of the shaft 100 according to a second embodiment of the invention will be described, which is further improved compared to the embodiment shown in FIG. 75.

Figure 76:
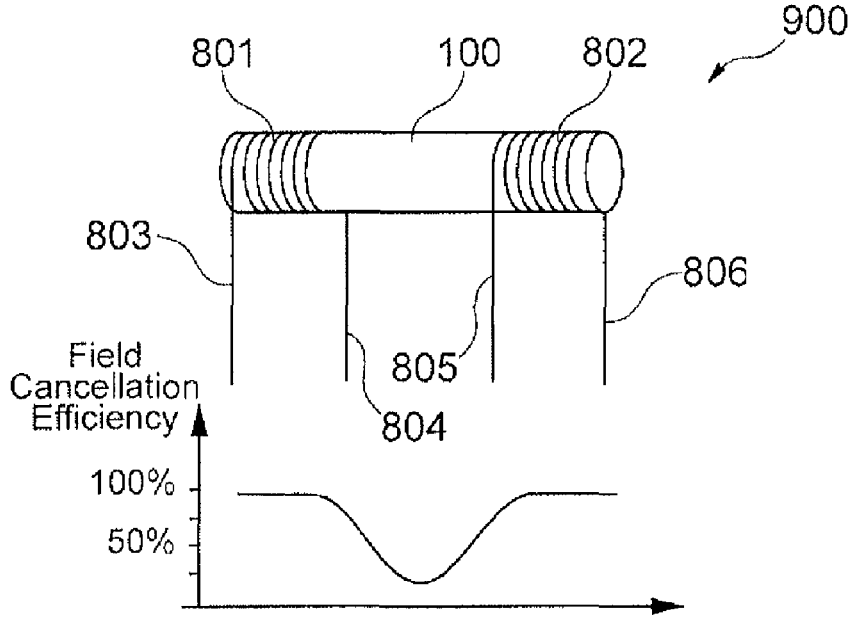
FIG. 76 shows an array for adjusting a magnetization of a shaft according to a second embodiment of the invention.

According to FIG. 76, only one of the coils 801, 802 at one time is connected to the alternating electrical current. In other words, according to FIG. 76, a first voltage may be applied between the first connection 803 and the second connection 804 of the first degaussing coil 801, and independently from this, a second voltage may be applied between the first connection 805 and the second connection 806 of the second degaussing coil 802, one voltage being applied after the other.

As can be seen from the graph in FIG. 76, the field cancellation efficiency is significantly reduced in the area between the coils 801, 802 compared to the array 800, so that the portion related to the remaining magnetization in the center of shaft 100 is prevented from being demagnetized in an improved manner.

According to FIG. 76, even better results are achieved when operating the magnetic field cancellation inductors 801, 802 one after each other. The magnetic field cancellation efficiency is dropping noticeably in the spacing between the two degaussing coils 801, 802. However, the magnetic encoding that may have been present in the section between the two degaussing coils 801, 802 may still be erased to a smaller extent in a non-uniform way.

In the following, referring to FIG. 77A, an array 1000 for adjusting a magnetization of the shaft 100 according to a third embodiment of the invention will be described.

Figure 77A:
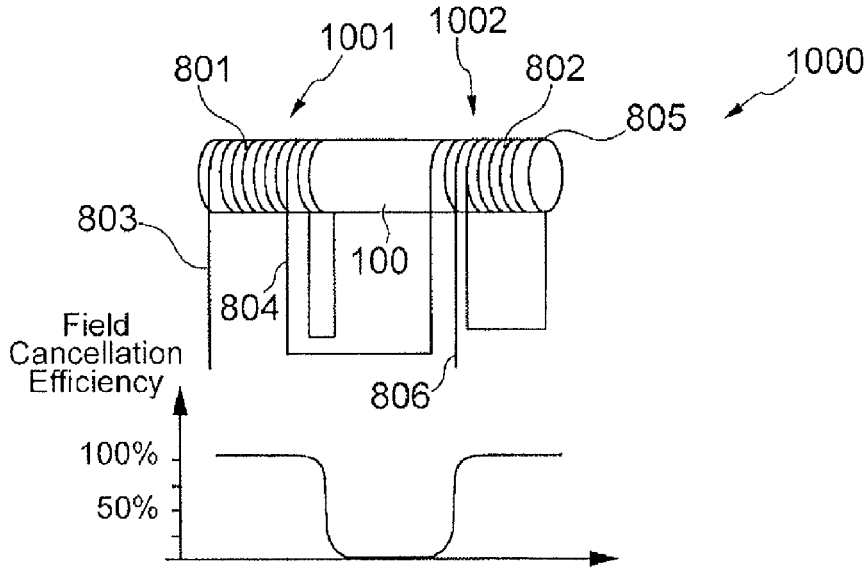
FIG. 77A, FIG. 77B show an array for adjusting a magnetization of a shaft according to a third embodiment of the invention.

According to the embodiment shown in FIG. 77A, the array has a first stopper coil 1001 and has a second stopper coil 1002, the first stopper coil 1001 being arranged surrounding a portion of the magnetized portion adjacent the first degaussing coil 801, and the second stopper coil 1002 is arranged surrounding a portion of the magnetized portion adjacent the second degaussing coil 802 in such a manner that the first and second stopper coils 1001, 1002 are arranged between (intermediate, i.e. sandwiched between) the first and second degaussing coils 801, 802, wherein such a voltage can be applied to the first and second stopper coils 1001, 1002 that the region between the first and second stopper coils 1001, 1002 is prevented from being demagnetized when the degaussing elements 801, 802 are magnetized.

As can be seen in FIG. 77A, when using stopper inductors 1001, 1002 (these are inductors that are placed at a specific end of the magnetic field cancellation inductors 801, 802, and the inductivity of the stopper inductors 1001, 1002 is significantly lower than the inductivity of the magnetic field inductors 801, 802), the area which is affected by the magnetic field cancellation inductors 801, 802 can be much clearer defined. An additional benefit is such that a magnetic field cancellation system design can be operated in one step (no sequential operation of applying voltages is necessary).

Figure 77B:
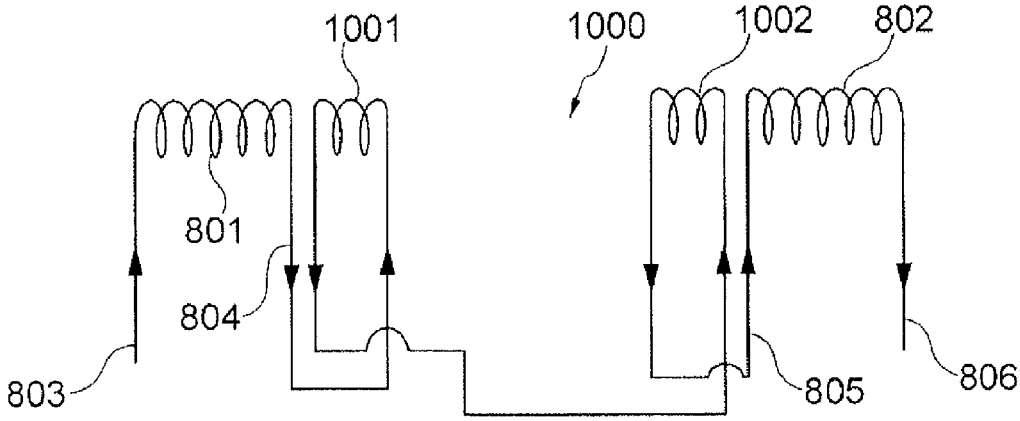

As one can see from FIG. 77A, FIG. 77B, a single current signal is applied to the coils 801, 802, 1001, 1002, and the current flows between the first connection 803 of the first degaussing coil 801 and the second connection 806 of the second degaussing coil 802. After having flown through the first degaussing coil 801 and before flowing through the second degaussing coil 802, the current flows through the first stopper coil 1001 and the second stopper coil 1002. However, the flowing direction of the current in the degaussing coils 801, 802 is the same, and the flowing direction of the current in the stopper coils 1001, 1002 is the same. The flowing direction of the current in any of the degaussing coils 801, 802 is opposite to the flowing direction of the current in any of the stopper coils 1001, 1002. The number of windings of each of the degaussing coils 801, 802 is larger than the number of windings of each of the stopper coils 1001, 1002. Thus, the strength of the magnetic field generated by any of the coils 801, 802, 1001, 1002 is adjusted by selecting the number of windings, and by adjusting the amplitude of the applied current, to achieve proper magnetic field values generated by any of the coils 801, 802, 1001, 1002.

In the following, referring to FIG. 77C, an array 1050 for adjusting a magnetization of the shaft 100 according to a forth embodiment of the invention will be described.

Figure 77C:
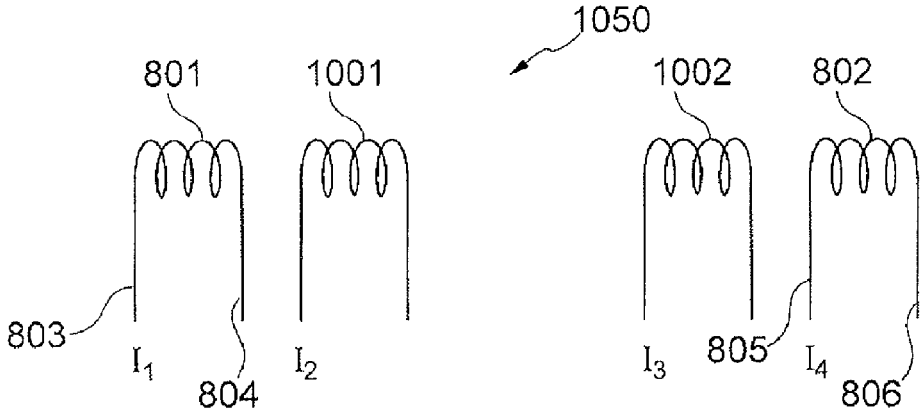
FIG. 77C shows an array for adjusting a magnetization of a shaft according to a forth embodiment of the invention.

According to the embodiment shown in FIG. 77C, each of the coils 801, 802, 1001, 1002 has two connections with separate current sources $I_1$, $I_2$, $I_3$, $I_4$. Thus, the current to flow through any of the coils 801, 802, 1001, 1002 can be adjusted separately for any of the coils 801, 802, 1001, 1002. The strength of each of these currents may be adjusted individually to allow to set the magnetization profile along the shaft 100 in desired manner. According to the embodiment of FIG. 77C, the current values are selected as follows: $I_1=I_4$, $I_2=I_3$, $|I_2|<|I_1|$. According to FIG. 77C, the number of windings (4) is identical for each of the coils 801, 802, 1001, 1002.

In the following, referring to FIG. 78A to FIG. 78C, a background and explanation for the invention is given.

Figure 78A:
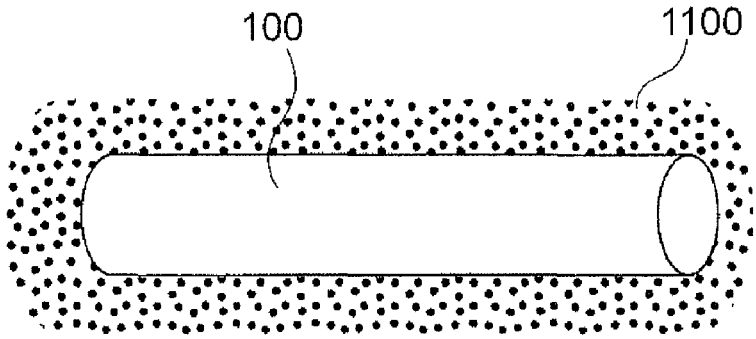
FIG. 78A to FIG. 78C show schemes for illustrating the invention.

FIG. 78A shows a magnetized shaft 100 and a magnetic field profile 1100 around the shaft 100. When the PCME encoding signal has been applied to the entire shaft, then the magnetized shaft 100 is stretching from end to end.

Figure 78B:
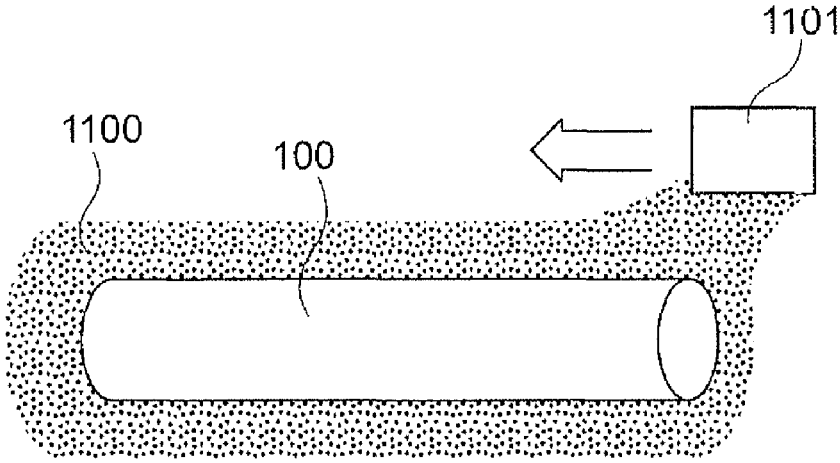
Figure 78C:
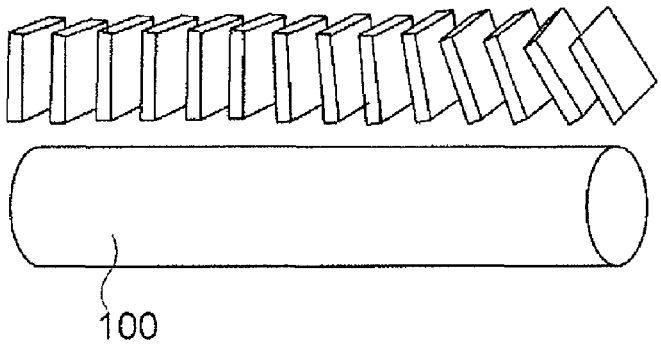

As can be seen in FIG. 78B, when a ferromagnetic object 1101 is located in a surrounding area of the magnetized shaft 100, "hot spotting" may occur, i.e. a strong sensitivity to nearby ferromagnetic material 1101. In such a case a magnetic encoded sensor may be (but does not have to be) very sensitive when a ferromagnetic object 1101 will touch one of the shaft 100 ends or is changing its position near the shaft 100. (Example: rotating gear tooth wheel). As can be seen in FIG. 78C, a domino effect can occur. Such effects may be reduced or eliminated by the invention.

In the following, referring to FIG. 79, an array 1200 for magnetizing a magnetizable steel shaft 100 will be described according to an exemplary embodiment of the invention.

The array 1200 for magnetizing the magnetizable shaft comprises an electrical signal source 1201 and an electrical connection element 1202, 1203 for electrically coupling the electrical signal source 1201 with the magnetizable shaft 100. The electrical connection element 1202, 1203 is realized as two electrically conducting elements which are attached to surfaces of the cylindrical shaft 100 to form, in conjunction with cables 1204, 1205, an ohmic electrical connection between the shaft 100 and the electrical signal source 1201.

The electrical signal source is adapted to carry out a method for magnetizing the shaft 100 with the following method steps.

In a first step, a first degaussing signal (see diagram 1300 of FIG. 80) is applied to the magnetizable shaft 100 to degauss the magnetizable shaft 100 completely, wherein the first degaussing signal is an alternating electrical signal having a first frequency and a first amplitude.

Figure 80:
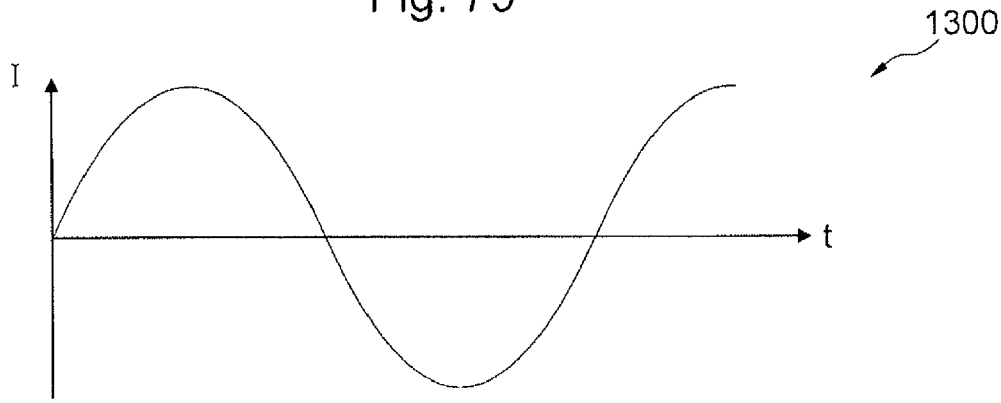
FIG. 80 to FIG. 82 illustrate current-versus-time diagrams according to a method for magnetizing a shaft according to an exemplary embodiment of the invention.

FIG. 80 shows a current-versus-time diagram 1300 (current I, time t) showing the first degaussing signal (having a low frequency and a high amplitude) which may be applied by the electrical signal source 1201 to the shaft 100. In other words, the current is directly flowing between the two electrical connection elements 1202, 1203 through the shaft 100, wherein the low frequency and the high amplitude of the first degaussing signal reliably demagnetizes the entire shaft 100. Thus, this first step can also be denoted as some kind of cleaning step.

According to the described embodiment, the shaft 100 has a diameter of 50 mm, and the first degaussing frequency shown in FIG. 80 is between 1 Hz and 2 Hz.

Figure 81:
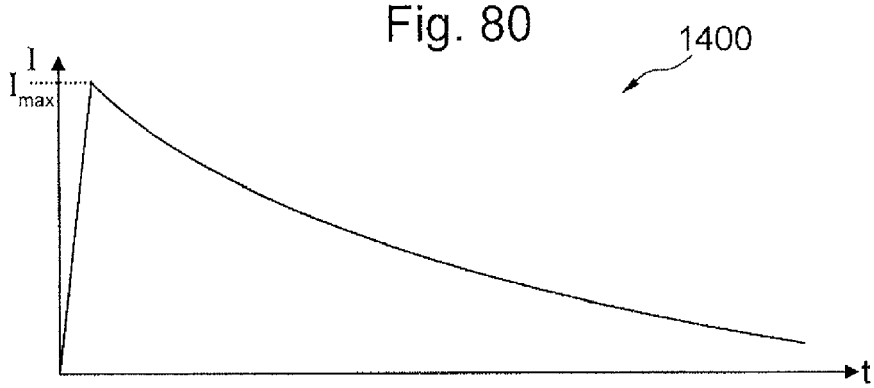

In a subsequent method step, the electrical signal source 1201 may apply a magnetizing signal to the magnetizable shaft 100 to magnetize the magnetizable shaft 100. This PCME encoding magnetizing step is shown in a diagram 1400 of FIG. 81, showing a current-versus-time diagram having a fast raising edge and a slow falling edge. Two of such current pulses may be applied subsequently (see above description of the PCME technology) so as to enable an encoding of the shaft 100 along essentially the entire length of the magnetizable shaft 100.

However, after this PCME encoding step, it may happen that a surface region of the magnetized shaft 100 is magnetized in an inhomogeneous manner, that is to say that a sensor response is not exactly the same along the entire circumference of the shaft 100.

Figure 82:
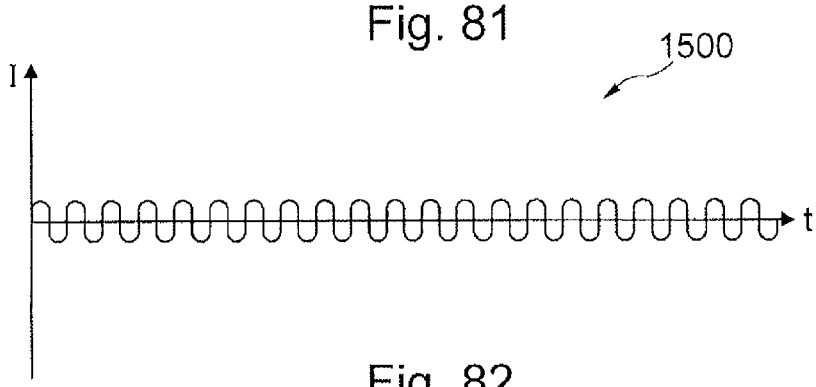

To remove surface magnetization being an origin of undesired inhomogeneities, a second degaussing signal (as shown in FIG. 82) can be applied, by the electric signal source 1201, to the magnetized magnetizable shaft 100 to partially degauss the magnetized magnetizable shaft 100, wherein the second degaussing signal is an alternating electrical signal having a second frequency and a second amplitude. As shown in diagram 1500 in FIG. 82, the second degaussing signal may have an amplitude which is much less than the amplitude of the first degaussing signal shown in diagram 1300 of FIG. 80. Further, the frequency of the second degaussing signal is much larger than the frequency of the first degaussing signal.

In the described embodiment with a shaft 100 having a diameter of 50 mm, the second frequency of the second degaussing signal shown in diagram 1500 is 300 Hz, and the amplitude of the second degaussing signal is 5 A.

Further, the maximum value $I_{max}$ shown in FIG. 81 is 90 A for a shaft having a diameter of 5 mm, and is 4500 A for a shaft having a diameter of 50 mm.

After having applied the second degaussing signal shown in FIG. 82, a surface magnetization of the shaft 100 may be cancelled, eliminated or reduced, so that homogeneity is improved and artefacts in parasitic effects are efficiently suppressed.

Figure 83:
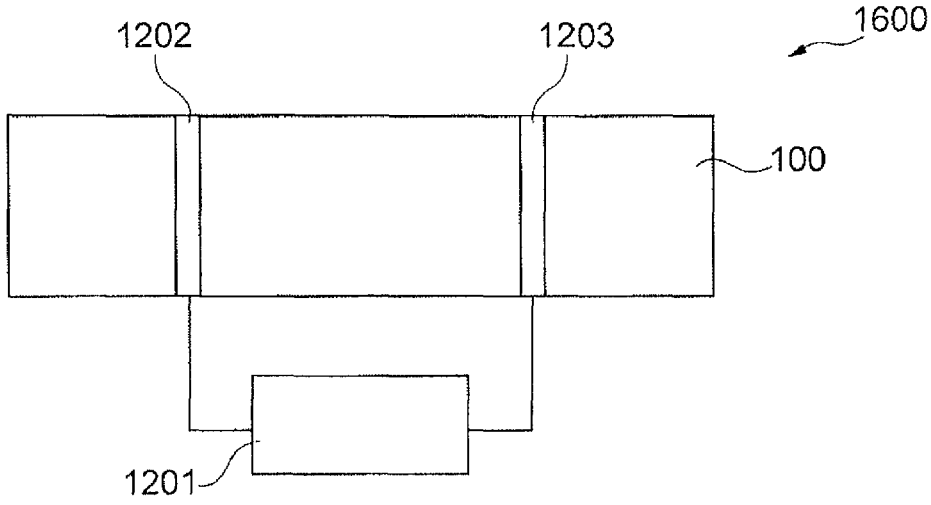
FIG. 83 shows an array for magnetizing a shaft according to an exemplary embodiment of the invention.

FIG. 83 shows an array 1600 for magnetizing the shaft 100 according to another exemplary embodiment of the invention.

According to this embodiment, the electrical connection elements 1202, 1203 are realized as rings which circumferentially contact the cylindrical shaft 100. This configuration allows to treat essentially only the portion of the shaft 100 between the two rings 1202, 1203.

Figure 79:
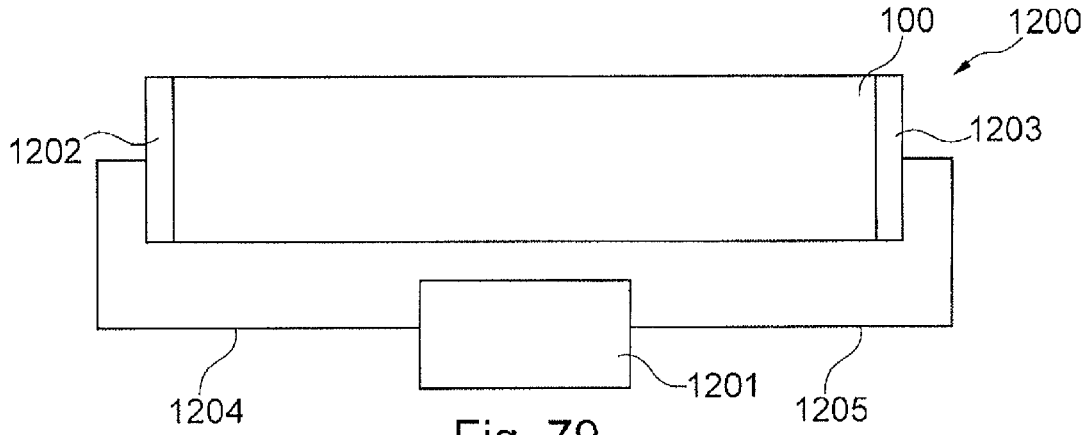
FIG. 79 shows an array for magnetizing a shaft according to an exemplary embodiment of the invention.

It is noted that, after having treated the shaft 100 with the array shown in FIG. 79 or FIG. 83, border portions of the magnetized region may be cancelled or degaussed according to the method as described above referring to FIG. 71 to FIG. 74. Also the embodiments shown in FIG. 75 to FIG. 77C can be used for this purpose.

In the following, referring to FIG. 84, an array 1700 according to another exemplary embodiment of the invention will be described.

Figure 84:
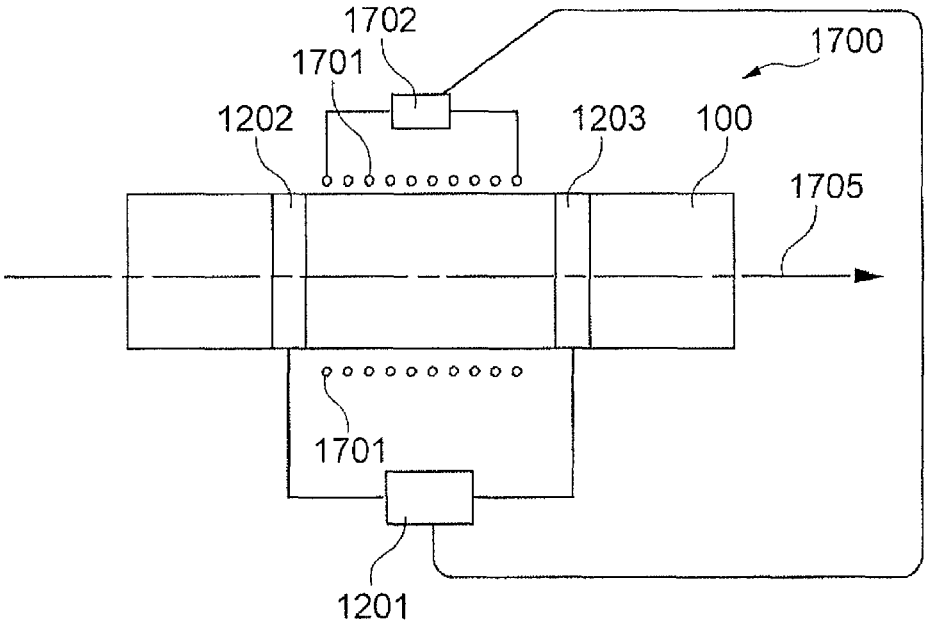
FIG. 84 shows an array for magnetizing a shaft according to an exemplary embodiment of the invention.

The difference between the embodiment shown in FIG. 84 and the embodiment shown in FIG. 83 is that the two degaussing signals are not directly applied to the shaft but are applied by applying a current through a coil 1701 which is supplied with electrical energy by an electrical energy unit 1702. This electrical power supply 1702 can be controlled by the electrical signal source 1201.

Summarizing, the magnetization definition scheme according to the array 1700 is as follows. First, a signal similar to that shown in FIG. 80 is applied to the coil 1701. Then, a current is introduced directly into the shaft 100 via the electrical connections 1202, 1203 so that a magnetization of the shaft 100 is generated (for instance with a signal similar to that of FIG. 81). After that, a signal similar to that shown in FIG. 82 is applied to the coil 1701. Optionally, a further degaussing step may be carried out in a manner as described above referring to FIG. 71 to FIG. 74. Also the embodiments shown in FIG. 75 to FIG. 77C in order to restrict the magnetization in an extension direction 1705 of the shaft 100. Thus, the coil 1701 is used for degaussing the shaft 100, and the contacts 1202, 1203 are used for magnetizing the shaft 100.

However, this functionality may also be inversed, as described in the following. According to the latter aspect, it is possible to apply a magnetizing current (similar to FIG. 81) through the coil 1701 which is supplied with electrical energy by the electrical energy unit 1702. This electrical power supply 1702 can be controlled by the electrical signal source 1201.

Then, the magnetization definition scheme according to the array 1700 is as follows. First, a signal similar to that shown in FIG. 80 is applied directly to the shaft 100 via the electrical contacts 1202, 1203. Then, a current is introduced into the coil 1701 so that a longitudinal magnetization of the shaft 100 is generated. After that, a signal similar to that shown in FIG. 82 is applied directly to the shaft 100 by applying this signal between the two contacts 1202, 1203. Optionally, a further degaussing step may be carried out in a manner as described above referring to FIG. 71 to FIG. 74. Also the embodiments shown in FIG. 75 to FIG. 77C in order to restrict the magnetization in an extension direction 1705 of the shaft 100.

In the following, referring to FIG. 85 and FIG. 86, it will be described how it is possible, according to the magnetizing scheme of the invention, to improve homogeneity and to suppress parasitic effects.

Figure 85:
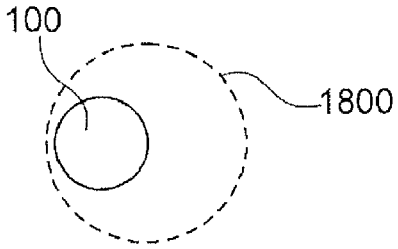
FIG. 85 is a schematic cross-sectional view of a magnetized shaft.

FIG. 85 shows a cross-section of the shaft 100 magnetized without performing a second degaussing step in a manner as shown in FIG. 82. In such a case, signal inhomogeneities may occur. These are shown schematically in FIG. 85 and are denoted with reference number 1800 in FIG. 85. In other words, when the magnetized shaft 100 is used as a magnetic torque sensor, the signal is inhomogeneous along a circumferential trajectory surrounding the cross-section of the shaft 10.

Figure 86:
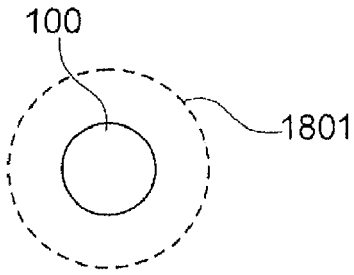
FIG. 86 is a schematic cross-sectional view of a magnetized shaft magnetized according to an exemplary embodiment of the invention.

As can be seen in FIG. 86, with the magnetizing scheme according to the invention, the signal distribution around the magnetized object 100 is more homogeneous and symmetrical, so that sensor artefacts resulting from parasitic surface magnetization contributions are suppressed or even eliminated.

It is noted that the concept according to the invention is very easy to implement, since the entire magnetizing steps can be carried out without changing the configuration of the shaft, that is to say all signals can directly flow through the shaft. It is dispensible that contacts are removed or attached between different method steps, and the sequence of signals may easily be automated.

Figure 87:
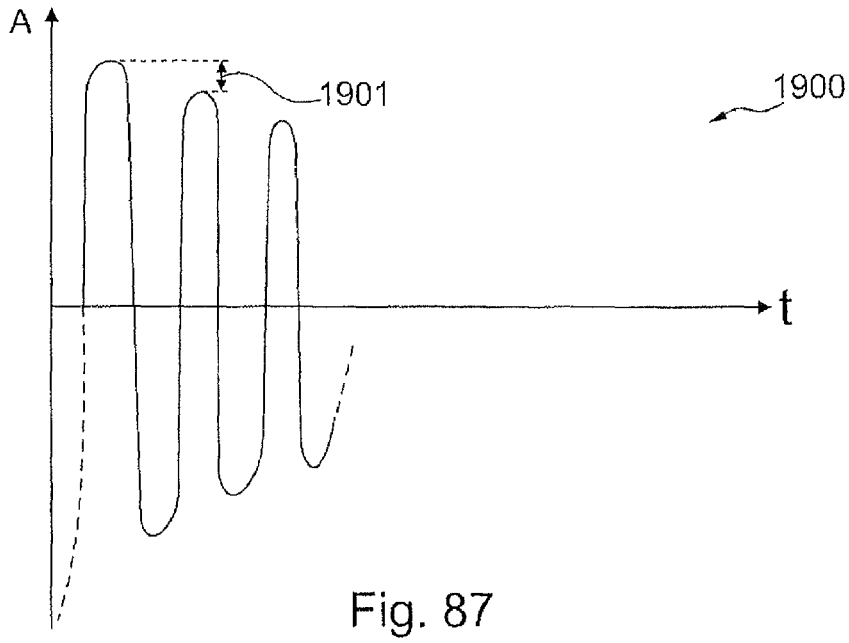
FIG. 87 illustrates a current-versus-time diagram according to a method for magnetizing a shaft according to an exemplary embodiment of the invention showing an alternative to the current-versus-time diagram according to FIG. 80 or FIG. 82.

FIG. 87 illustrates a current-versus-time diagram 1900 according to a method for magnetizing a shaft according to an exemplary embodiment of the invention showing an alternative to the current-versus-time diagram according to FIG. 80 or FIG. 82.

"A" denotes an amplitude. In the current-versus-time diagram 1900, the oscillating current has an envelope so that the signal falls to lower values at later times. The envelope may be an exponential function, for instance. The signal decrease 1901 between two successive oscillations should be less then 4%, preferably less then 1%. An oscillation with a frequency of 2 Hz may be applied to a shaft for 300 s. The signal of FIG. 87 is used as a first degaussing signal. Particularly with a higher oscillation frequency and with a lower amplitude, it may be used as well as a second degaussing signal, as an alternative to FIG. 82.

Figure 88:
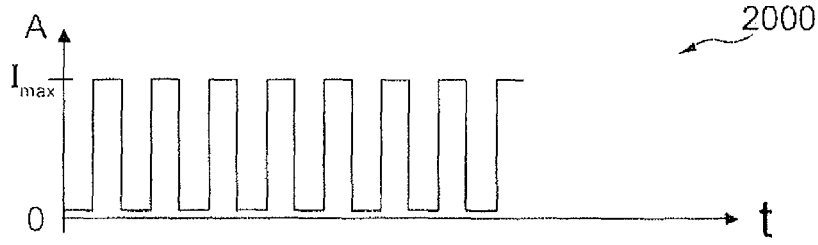
FIG. 88 illustrates a current-versus-time diagram according to a method for magnetizing a shaft according to an exemplary embodiment of the invention showing an alternative to the current-versus-time diagram according to FIG. 81.

FIG. 88 illustrates a current-versus-time diagram 2000 according to a method for magnetizing a shaft according to an exemplary embodiment of the invention showing an alternative to the current-versus-time diagram according to FIG. 81.

According to FIG. 88, a step function is applied to the shaft, wherein the step function can take one of the two values Imax or zero. Such a magnetizing signal can be applied directly to the shaft in via contacts 1202, 1203.

Figure 89:
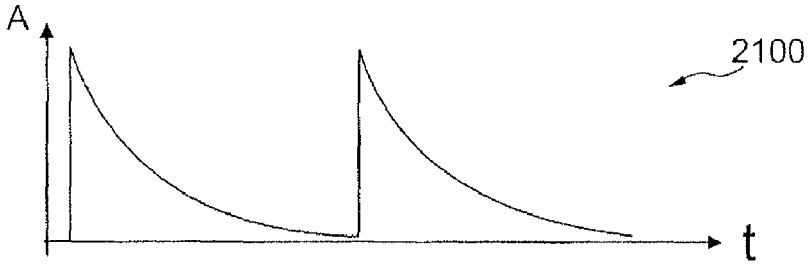
FIG. 89 illustrates a current-versus-time diagram according to a method for magnetizing a shaft according to an exemplary embodiment of the invention showing a further alternative to the current-versus-time diagram according to FIG. 81.

FIG. 89 illustrates a current-versus-time diagram 2100 according to a method for magnetizing a shaft according to an exemplary embodiment of the invention showing a further alternative to the current-versus-time diagram according to FIG. 81.

This PCME encoding magnetizing step according to the current-versus-time diagram 2100 has two subsequent parts each having a fast raising edge and a slow falling edge. Thus, two of the current pulses of FIG. 81 are applied subsequently (see above description of the PCME technology) so as to enable an encoding of the shaft.

Figure 90:
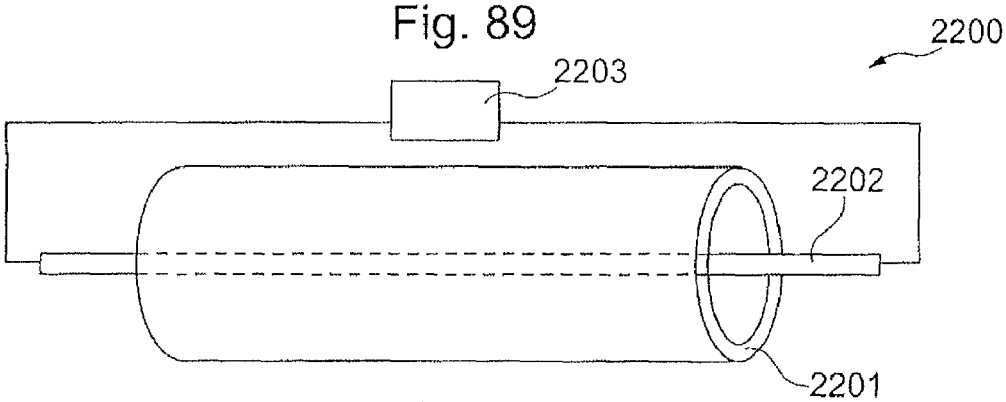
FIG. 90 shows an array for magnetizing a shaft according to an exemplary embodiment of the invention.

FIG. 90 shows an array 2200 for magnetizing a hollow shaft 2201 according to an exemplary embodiment of the invention.

According to this embodiment, the hollow shaft 2201 to be magnetized surrounds a magnetizing cylinder 2202. Via an electrical signal source 2203, electrical signals for magnetizing or degaussing the shaft 2201 may be applied to the cylindrical conductor 2202.

For instance, the three signals according to FIG. 80, FIG. 81, FIG. 82 may be applied subsequently to the cylinder 2202. Alternatively, the three signals according to FIG. 87, FIG. 81, FIG. 87 may be applied subsequently to the cylinder 2202. Further alternatively, the three signals according to FIG. 87, FIG. 88, FIG. 82 may be applied subsequently to the cylinder 2202.

In the following, referring to FIG. 91 to FIG. 93, a flow sensor 2300 according to an exemplary embodiment of the invention will be described.

FIG. 91 shows a flow sensor 2300 comprising a support 2301 at which a bendable object 2302 is fastened. In a connection region of the support 2301 and the bendable object 2302, a magnetically encoded region 2303 is provided. This magnetically encoded region 2303 may be encoded according to the PCME technology.

As shown in FIG. 92, when a fluid (for instance a liquid or a gas) passes the flow sensor 2300, which is indicated by an arrow 2400, the bendable object 2302 is bent due to mechanical forces caused by the flow of the fluid. Consequently, mechanical stresses 2401 caused through the bending forces occur at the magnetically encoded region 2303.

This stress 2401 can be measured by a magnetic field detector (for instance one or more coils, not shown in the figure) provided in the vicinity of the magnetically encoded region 2303. From the received signal, the flow of fluid can be estimated, since the bending forces are a measure for the flow of fluid.

The bendable object 2302 of FIG. 92 has a thin part connected to the magnetically encoded region 2303 and has a thick part at an end portion of the bendable object 2302 which end portion is in functional contact with the flowing fluid. The thin part allows for a bending even in case of a slow flow, and the thickened end portion provides an efficient interaction with flowing fluid. In an alternative embodiment, the thick part and the thin part may be substituted by an essentially rectangular plate (similar like a sheet or a tongue). Such a configuration may provide both stability due to a robust part connected to the magnetically encoded region 2303 and high TO sensitivity due to the high area (sail-like) end portion.

With such a flow meter, it is possible to measure small forces arising from flowing fluid. The small sensor signals involved with such a measurement may need electronic amplification before a further processing. Apart from characterising a fluid flow, it is also possible with a similar geometry to measure pressure in a tube. Resolution or accuracy may be 20 Pa or less. The range of measurable pressure values is up to 10 bar and more.

Any kind of stress acting on a planar surface may be detected. For instance, the force distribution within a tube may be monitored or characterized with such a measurement. Also, the uplift of an airplane may be monitored or characterized with such a measurement.

FIG. 93 shows the entire system, including a tube or pipe 2501 through which liquid 2500 is flowing.

Thus, one aspect of the present invention is a bending sensor system solution. It is attained a non-contact Proof-of-Concept Bending Sensing Sensor solution based on magnetostriction principles that will detect and measure the applied bending forces in any environment. An exemplary application is a shaft in an industrial follow meter.

A first task is to design, machine and to integrate the specific components and modules required for a Non-Contact Bending measurement in a "large scale" flow meter module.

The Proof-of-Concept (POC) system solution includes Signal Conditioning Signal Processing (SCSP) electronics with an analog signal output. The large-scale POC bending sensor can be used to test the sensitivity of a magnetostriction principle based bending sensor in this specific application.

A second task is a real scale bending sensor system for the targeted flow meter design.

A main element of the "Large Scale" flow sensor system 2300 is a specific designed beam 2302 that is placed through a hole into the center of the pipe 2501. The liquid 2500 that flows through this pipe 2501 will find physical resistance when trying to flow around the beam 2302. The higher the liquids viscosity, and the higher the speed with which the liquid is flowing through the pipe 2501, the higher the bending forces that act on the beam 2302.

It is believed that the optimal location for measuring the bending forces, that act on the beam 2302, is at the upper side of the beam mounting plate 2301. It is desired that the material used for the beam 2302 and the beam mounting plate 2301 has the desired magnetic properties. One of the aspects of the "Large-Scale" POC Flow-Sensor System design is to identify the optimal Non-Contact sensing location near or at the top end of the beam 2302 or at the thin membrane that builds the beam mounting plate 2301.

The bending forces applied to the measurement beam 2302 will cause very specific stress patterns at the beam mounting plate 2301.

Main benefits of focusing on a "Large-Scale" model are that it is easier to perform tests and to make design modifications then on a smaller design, and that the resulting overall system costs are lower.

However, it is also possible to apply this technology to a "Real-Scale" Flow Sensor design.

The POC may comprise at least a part of the following items:

- Magnetically encoded Sensor Host (Shaft), also called Primary Sensor
- Secondary Sensor Unit (MFS coil holder) with interface cable
- Signal Conditioning & Signal Processing Electronics
- Optional: Data Logger
- Optional: Operating System, Software Referring to the Primary Sensor, the sensor technology will utilize the magnetic properties of a transmission shaft. After the magnetic encoding has been applied to the transmission shaft, the shaft can be freely rotated at any desired rotational speed. The mechanical properties of the transmission shaft remain unchanged so that the application typical stresses may be applied to the transmission shaft.

To apply the magnetostriction sensor successfully at the transmission shaft, a uniform section of a specific length (in axial direction) is located on the transmission shaft that can be magnetically encoded using one of the above described encoding processes. The axial spacing required depends on several factors, including but not limited to targeted sensor performance, the proximity to Ferro magnetic devices that are located near the encoded region, and expected interference from unwanted magnetic sources.

Referring to the Secondary Sensor, MFS (Magnetic Field Sensing) coils may be used that have to be placed or fitted in the MFS coil holder. The MFS coil holder itself may also be called SSU. The material for the MFS coil holder should not interact with the magnetic signal from the Primary Sensor. Preferred is to use a synthetic material that has no magnetic properties. Alternatively, Aluminium or non-magnetic steel can be used.

The wire length between the Secondary Sensor (MFS coil holder) and the SCSP electronics should not exceed approximately 2 Meters. In general, the Secondary Sensor Unit.

Depending on the environmental conditions, it may be necessary to provide signal shielding. Such a shielding function will be implemented at the MFS coil holder and/or in the SCSP electronics and the system wirings.

Referring to the SCSP Electronics Interface, this electronics may be supplied with an analog output signal interface. The SCSP electronics internal supply ($V_{cc}$) is +5.00 Volts. Consequently, the output signal range from rail-to-rail in relation to $V_{cc}$. Under normal circumstances the "zero"-signal output voltage is $\frac{1}{2}V_{cc}$ (approximately +2.50 Volts).

The analog output signal is protected and suitable to communicate directly with standard data acquisition interface systems. When using the SCSP on-board 5.00 V reference voltage, the output signal is an "absolute" value and will not change even when the systems supply voltage is moving up or down (within the specified limits, like within +6.5V to +16V). However, when the regulated +5 V supply is applied directly to the SCSP electronics internal supply system, the "zero"-signal will behave ratiometric. Meaning that changes of the +5 V supply will be seen proportionally at the analog output signal.

Optionally, a Data Logger system may be provided that meets the application specific requirement. The main function of the Data Logger system is to buffer and store the measurement results, generated by the Secondary Sensor SCSP Electronics for a specific time. The Data Logger is powered by a rechargeable battery. The system can be supplied in assembled & tested PCB format, ready for integration in a particular casing, or the Data Logger can be supplied as a completely assembled system, in its own, water and dirt proof housing.

After having triggered the Data Logger data storage process, the Data Logger will continuously record/store the measurements from the connected SCSP Electronics. One can either interrupt the recording operation or let the system decide when to end the recording mode (when the on-board max data storage capacity has been reached).

Depending on the systems specification, one can download the information stored in the Data Logger's on-board storage facilities, to a Windows operated PC or Laptop system. The data transfer can be wire-bound (like RS232c, serial interface), or can be performed wireless. There is the option to change the sensor system settings when being connected to a PC or Laptop.

If desired, standard control or advanced data processing software may be provided. Such software will be written for a custom SCSP electronics board or the Data Logger. In most cases the software functions are special signal processing (like: filtering or signal pattern analysis) and user programmable system control functions.

Potential magnetic stray-field interferences (example: electric motor nearby) may make it necessary that some of the sensor components or modules need to be protected through additional magnetic shielding.

The Sensor System may be specified as follows:

| Flow Meter Specification | | | |
|---|---|---|---|
| Nominal flow speed | FS | m/sec | +/−2 |
| Expected maximal flow speed | Overload | m/sec | +/−4 |
| Existing/Planned SH material (Name, Composition) | SH Material | % Ni | TBD |

-continued

| | | | |
|---|---|---|---|
| Objections to change this material | | Subject of material eval | |
| Hardening requirements | Hardening | Procedure | TBD |
| Required absolute accuracy | Absolute Accuracy | % of FS | +/−7.5 |
| Maximal tolerable signal hysteresis | Hysteresis | % of FS | +/−4 |
| Expected sensor sensitivity in relation to FS | Measurement Resolution | % of FS | >0.5 |
| Electronics (per channel) | | | |
| SCSP output signal for −FS signal (Sensor Output) | −FS Output Signal | V | +0.2 |
| SCSP output signal for +FS signal (Sensor Output) | +FS Output Signal | V | +4.8 |
| SCSP output signal for Zero Torque (Sensor Output) | Zero Point Output Signal | V | +2.5 |
| Output signal resolution | Output Signal Resolution | Bits or mV | 10 Bit |
| Output signal noise level | Signal-to-Noise-Ratio | | TBD |
| SCSP Signal Band-Width | Signal Band-Width | Hz | 1 |
| SCSP Required Start-up supply current | Start-up Current | mA | 80 |
| SCSP Required Start-up supply current | Operating Current | mA | <10 |
| SCSP Required Single Supply Voltage (regulated) | Supply Voltage | V | 5 |
| Interfering factors: Magnetic Stray Field | Magneti Stray Field | Gauss | yes |
| Interfering factors: Magnetic active parts moving near by | Magnetic Moving Parts | | TBD |
| Operating Conditions: Temperature Range | Operating Temp Range | deg C. | 0 to +80 |
| Available mechanical space for sensor system | Available Axial Space | mm | TBD |
| Available mechanical space for sensor system | Available Radial Space | mm | TBD |
| Maximal axial shift of SH in relation to MFS position | Axial Shift | mm | TBD |
| Maximal radial shift of SH in relation to MFS position | MFS spacing | mm | TBD |

According to an exemplary embodiment of the invention, a sequence of (completely) degaussing a magnetizable object by applying a low-frequency high-amplitude degaussing signal, magnetizing the degaussed magnetizable object, and (partly) degaussing the magnetizable object by applying a high-frequency low-amplitude degaussing signal is provided (see FIG. 80 to FIG. 82).

For the second degaussing step, the frequency f should not be too small in order to avoid penetration of the field into too deep regions of the object. For a similar reason, the intensity/amplitude should not be too high. This may allow to suppress or eliminate disturbing hysteresis effects.

An additional (second) degaussing may be performed as well permanently during a measurement or directly before performing a measurement. For example, this may include arranging a single-layer degaussing coil tightly wound around the object which may be activated for a predetermined time interval before a measurement, or permanently. Such a degaussing coil may be provided additionally to one or more measurement coils arranged for measuring a torque-dependent magnetic signal.

When such a single-layer degaussing coil is tightly wound to surround the object, torque may be applied and the second degaussing may be performed shortly before starting the actual measurement. It is presently believed that this measure may allow individual Weiss domains conventionally causing hysteresis effects to be forced into a modified orientation. In other words, by applying a high-frequency low-amplitude signal, these disturbing Weiss domains may be brought into an essentially statistical orientation, thus suppressing undesired hysteresis effects.

Figure 94:
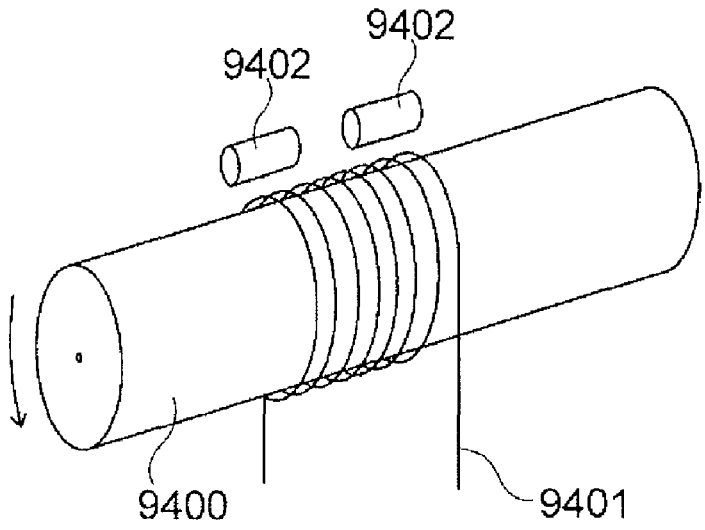
FIG. 94 illustrates a degaussing coil arranged at a sensor device.

FIG. 94 shows a configuration of a magnetizable shaft 9400 being rotatable. Further, FIG. 94 shows a hysteresis-suppressing degaussing coil 9401 and two measurement coils 9402.

Figure 95:
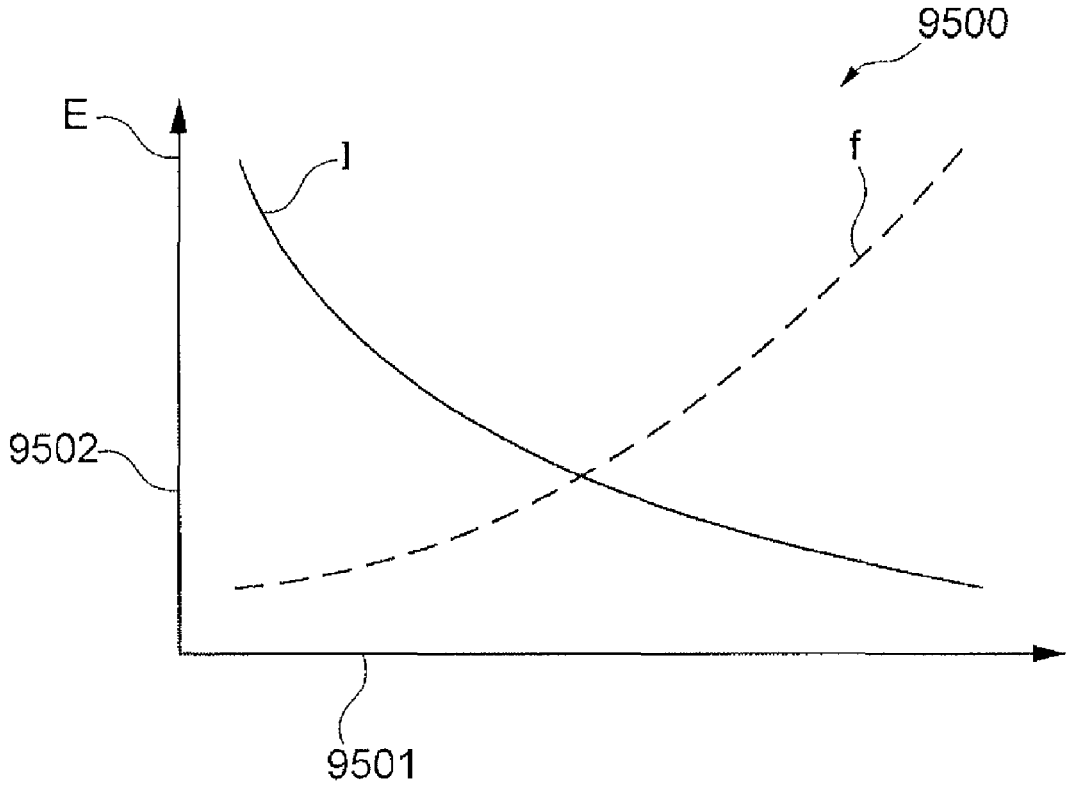
FIG. 95 shows a diagram illustrating hysteresis suppression in dependence of the operation state of the degaussing coil of FIG. 94

FIG. 95 shows a diagram 9500 having an abscissa 9501 along which the degaussing frequency f and the degaussing intensity I are plotted. Along an ordinate 9502, the anti-hysteresis efficiency E is plotted. As can be taken from FIG. 95, a high efficiency E can be obtained with a sufficiently large f and with a sufficiently small I.

It should be noted that the term "comprising" does not exclude other elements or steps and the "a" or "an" does not exclude a plurality. Also elements described in association with different embodiments may be combined.

The invention claimed is:

1. A method for magnetizing a magnetizable object, comprising:

applying a first degaussing signal to the magnetizable object to degauss the magnetizable object, the first degaussing signal being an alternating electrical signal having a first frequency and a first amplitude;

applying a magnetizing signal to the degaussed magnetizable object to magnetize the magnetizable object; and applying a second degaussing signal to the magnetized magnetizable object to partially degauss the magnetized magnetizable object, the second degaussing signal being an alternating electrical signal having a second frequency and a second amplitude.

2. The method according to claim 1, wherein at least one of the first degaussing signal, the magnetizing signal and the second degaussing signal is applied directly to the magnetizable object.

3. The method according to claim 1, wherein at least one of the first degaussing signal, the magnetizing signal and the second degaussing signal is an electrical current which is injected into the magnetizable object.

4. The method according to claim 1, wherein the first frequency is smaller than the second frequency.

5. The method according to claim 1, wherein the first amplitude is larger than the second amplitude.

6. The method according to claim 1, wherein the first frequency is less than or equal to 50 Hz.

7. The method according to claim 1, wherein the second frequency is larger than or equal to 100 Hz.

8. The method according to claim 1, wherein the first amplitude is larger than or equal to 20 A.

9. The method according to claim 1, wherein the second amplitude is less than or equal to 10 A.

10. The method according to claim 1 to 9, wherein the second degaussing signal is selected in such a manner that parasitic effects are suppressed.

11. The method according to claim 1, wherein the second degaussing signal is selected in such a manner that only a surface magnetization is selectively removed from the magnetizable object.

12. The method according to claim 1, wherein the alternating electrical signals according to at least one of the first degaussing signal and the second degaussing signal are selected from the group consisting of a sine signal, a cosine signal, a triangle signal, a saw tooth signal, a pulse signal and a rectangular signal.

13. The method according to claim 1, further comprising:

after having applied the second degaussing signal, adjusting the magnetization of the magnetizable object by arranging at least one degaussing element adjacent to the magnetized object; and degaussing a part of the magnetized object by activating the degaussing element to adjust the magnetization of the magnetizable object by forming a demagnetized portion of the object directly adjacent to a remaining magnetized portion of the object.

14. The method according to claim 13, wherein at least one of the at least one degaussing element is a degaussing coil.

15. The method according to claim 14, wherein the degaussing coil is arranged to surround a portion of the magnetized object to be demagnetized.

16. The method according to claim 13, wherein at least one of the at least one degaussing element is an electromagnet.

17. The method according to claim 14, wherein the at least one degaussing element is activated by applying a time-varying electric signal.

18. The method according to claim 14, wherein the at least one degaussing element is activated by applying one of an alternating current and an alternating voltage.

19. The method according to claim 18, wherein one of the alternating current and the alternating voltage alternates with a frequency which is substantially smaller than 50 Hz.

20. The method according to claim 18, wherein one of the alternating current and the alternating voltage alternates with a frequency less than 5 Hz.

21. The method according to claim 13, wherein at least one of the at least one degaussing element is a permanent magnet.

22. The method according to claim 21, wherein the permanent magnet is activated by moving the permanent magnet in the vicinity of the object in a time-varying manner.

23. The method according to claim 1, wherein the step of applying a magnetizing signal to magnetize the magnetizable object includes the substep of activating a magnetizing coil which is arranged to surround the object to be magnetized.

24. The method according to claim 23, wherein the magnetizing coil is activated by applying one of a direct current and a direct voltage.

25. The method according to claim 1, wherein the step of applying a magnetizing signal to magnetize the magnetizable object includes the substep of applying at least two current pulses to the object such that in a direction essentially perpendicular to a surface of the object, a magnetic field structure is generated such that there is a first magnetic flow in a first direction and a second magnetic flow in a second direction, wherein the first direction is opposite to the second direction.

26. The method according to claim 25, wherein, in a time versus current diagram, each of the at least two current pulses has a fast raising edge which is essentially vertical and has a slow falling edge.

27. The method according to claim 1, wherein a shaft is provided as the object.

28. The method according to claim 27, wherein the shaft is one of the group consisting of an engine shaft, a reciprocable work cylinder, and a push-pull-rod.

29. The method according to claim 13, wherein only one of the at least one degaussing element is activated at a time.

30. The method according to claim 13, wherein at least two degaussing elements are activated at a time.

31. The method according to claim 1, wherein the first degaussing signal is applied to the magnetizable object in such a manner as to degauss the entire magnetizable object.

32. The method according to claim 1, wherein the first degaussing signal is a damped alternating electrical signal.

33. The method according to claim 1, wherein the second degaussing signal is a damped alternating electrical signal.

34. An array for magnetizing a magnetizable object, comprising:

an electrical signal source applies:

(a) a first degaussing signal to the magnetizable object to degauss the magnetizable object, the first degaussing signal being an alternating electrical signal having a first frequency and a first amplitude;

(b) a magnetizing signal to the degaussed magnetizable object to magnetize the magnetizable object; and (c) a second degaussing signal to the magnetized magnetizable object to partially degauss the magnetized magnetizable object, the second degaussing signal being an alternating electrical signal having a second frequency and a second amplitude.

35. The array according to claim 34, further comprising:

an electrical connection element electrically connecting the electrical signal source with a magnetizable object.

36. The array according to claim 34, further comprising:

an electrical conductor, the electrical conductor one of (a) surrounds a magnetizable object and (b) is surrounded by a magnetizable object.

* * * * *